US006905284B2

(12) United States Patent
Christensen et al.

(10) Patent No.: US 6,905,284 B2
(45) Date of Patent: Jun. 14, 2005

(54) APPARATUS AND METHOD FOR MANUFACTURING A COLLATED ARRAY OF TEMPORARY RAISED PAVEMENT MARKERS (TRPMS) FOR FACILITATING THE SERIAL APPLICATION OF SUCH TEMPORARY RAISED PAVEMENT MARKERS (TRPMS) TO ROADWAY SURFACES

(75) Inventors: Michael Christensen, Parkers Prairie, MN (US); Jeffrey Rogers, Alexandria, MN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/646,883

(22) Filed: Aug. 25, 2003

(65) Prior Publication Data

US 2005/0047865 A1 Mar. 3, 2005

(51) Int. Cl.[7] ..... E01C 23/16
(52) U.S. Cl. ..... 404/72; 404/94
(58) Field of Search ..... 404/9, 10, 12, 404/15, 16, 72, 73, 93, 94; 221/1

(56) References Cited

U.S. PATENT DOCUMENTS

| | | | |
|---|---|---|---|
| 1,766,073 | A | 6/1930 | Hartzler et al. |
| 1,833,124 | A | 11/1931 | Rand |
| 3,380,428 | A | 4/1968 | Abrams |
| 3,963,362 | A | 6/1976 | Hollis |
| 4,111,581 | A | 9/1978 | Auriemma |
| 4,445,803 | A | 5/1984 | Dixon |
| 4,521,129 | A | 6/1985 | Krech et al. |
| 4,534,673 | A | 8/1985 | May |
| 4,542,709 | A | 9/1985 | Spaugh |
| 4,645,168 | A | 2/1987 | Beard |
| 4,895,428 | A | 1/1990 | Nelson et al. |
| 4,991,994 | A | 2/1991 | Edouart |
| 5,327,850 | A | 7/1994 | Sly et al. |
| 5,392,728 | A | 2/1995 | Speer et al. |
| 5,393,166 | A | 2/1995 | Stock et al. |
| 5,460,115 | A | 10/1995 | Speer et al. |
| 5,515,807 | A | 5/1996 | Speer et al. |
| 5,788,405 | A | 8/1998 | Beard |
| 6,109,820 | A | 8/2000 | Hughes, Sr. |
| 2002/0004135 | A1 | 1/2002 | Buccellato et al. |
| 2003/0091815 | A1 | 5/2003 | Buccellato et al. |

FOREIGN PATENT DOCUMENTS

| | | |
|---|---|---|
| WO | WO95/2731 | 1/1995 |

*Primary Examiner*—Gary S. Hartmann
(74) *Attorney, Agent, or Firm*—Schwartz & Weinrieb

(57) ABSTRACT

Apparatus is disclosed for forming a serial array of temporary raised pavement markers (TRPMs), which are disposed upon a single, common release liner, into a collated and nested array of the temporary raised pavement markers (TRPMs) such that the collated and nested array of temporary raised pavement markers (TRPMs) can be supplied to apparatus for dispensing and applying the temporary raised pavement markers (TRPMs) onto pavement surfaces. In accordance with a first embodiment of the apparatus, the plurality of temporary raised pavement markers (TRPMs) are formed from a single temporary raised pavement marker (TRPM) extrusion, the extrusion is cut, and subsequently, the markers are mounted upon the single, common release sheet or release liner which has a plurality of adhesive patches previously disposed thereon. The assembly, comprising the plurality of temporary raised pavement markers (TRPMs) and the common release liner, is then formed into a collated and nested array. In accordance with a second embodiment of the apparatus, a plurality of pre-formed temporary raised pavement markers (TRPMs), having adhesive patches already disposed thereon, are serially deposited and adhered onto a single, common release liner, and subsequently, the assembly, comprising the plurality of temporary raised pavement markers (TRPMs) and the common release sheet or release liner, are formed into a collated and nested array.

31 Claims, 25 Drawing Sheets

APPARATUS AND METHOD FOR MANUFACTURING A COLLATED ARRAY OF TEMPORARY RAISED PAVEMENT MARKERS (TRPMS) FOR FACILITATING THE SERIAL APPLICATION OF SUCH TEMPORARY RAISED PAVEMENT MARKERS (TRPMS) TO ROADWAY SURFACES

CROSS-REFERENCE TO RELATED PATENT APPLICATIONS

This patent application is related to U.S. patent application Ser. No. 10/302,994 which was filed on Nov. 25, 2002 and which is entitled COLLATED ROAD MARKER ASSEMBLY, AND SYSTEM AND METHOD FOR AUTOMATICALLY APPLYING COLLATED ROAD MARKERS TO ROADWAY SURFACES, and is also related to U.S. patent application Ser. No. 10/422,000 which was filed on Apr. 25, 2003 and which is entitled COLLATED ROAD MARKER ASSEMBLY, AND SYSTEM AND METHOD FOR AUTOMATICALLY APPLYING COLLATED ROAD MARKERS TO ROADWAY SURFACES.

FIELD OF THE INVENTION

The present invention relates generally to temporary raised pavement markers (TRPMs) which are adapted to be fixedly secured to roadway surfaces in order to, for example, temporarily define traffic lanes or the like within construction zones, work sites, or maintenance or repair areas, and more particularly to a new and improved apparatus and method for manufacturing a collated array of temporary raised pavement markers (TRPMs) so as to facilitate the serial application of such collated temporary raised pavement markers (TRPMs) to roadway surfaces in order to in fact temporarily define the traffic lanes or the like within the construction zones, work sites, or maintenance or repair areas.

BACKGROUND OF THE INVENTION

Various types of roadway markers have been utilized in connection with a variety of traffic control applications. Many roadway markers are adapted to be permanently attached or secured to the road surface so as to permanently delineate traffic lanes upon the roadway, while other roadway markers are adapted to be temporarily attached or secured to particular road surfaces in order to temporarily delineate traffic lanes within construction zones or other work areas. Accordingly, the latter type of roadway markers are known as temporary roadway markers and are usually attached or secured to the road surface by means of a suitable adhesive that can retain the roadway marker in its place upon the road surface during the temporary life of the roadway marker. More particularly, temporary roadway markers can serve, for example, as a means for identifying edge portions of the roadway, or alternatively, to delineate traffic lane lines and thereby demarcate separate lanes of traffic from each other in and around construction sites and other work zones. After the construction or other road work is completed, the temporary roadway markers are removed. To be effective the temporary roadway markers must clearly be capable of alerting motorists to the fact that they are nearing or entering a construction zone or work area, and therefore, the temporary roadway markers must in fact be effective both during daytime hours, nighttime hours, sunny conditions, cloudy conditions, inclement weather conditions, and the like. More particularly, one type of temporary roadway marker that has been extremely successful or effective in providing short-term temporary markings upon roadways both during daytime and nighttime hours, and which has also been able to adequately withstand the various impact forces that are normally impressed thereon by daily roadway vehicular traffic so as to in fact provide the desired service life required in connection with the installation of such temporary roadway markers, has been that type of temporary roadway marker which is known in the industry as a temporary raised pavement marker (TRPM).

Examples of such temporary raised pavement markers (TRPMs) are disclosed, for example, within U.S. Pat. No. 6,109,820 which issued to Hughes, Sr. on Aug. 29, 2000, U.S. Pat. No. 5,788,405 which issued to Beard on Aug. 4, 1998, U.S. Pat. No. 5,460,115 which issued on Oct. 24, 1995 to Speer et al., U.S. Pat. No. 4,991,994 which issued to Edouart on Feb. 12, 1991, and U.S. Pat. No. 4,445,803 which issued to Dixon on May 1, 1984. As can readily be appreciated from FIG. 1, which corresponds substantially to FIG. 1 of the Speer et al. patent, it is briefly noted that an exemplary temporary raised pavement marker (TRPM) 10 is seen to have a substantially L-shaped configuration wherein the horizontally disposed leg portion 12 thereof is adapted to be fixedly secured or attached to the road surface by means of a suitable adhesive which is allowed to set, while the vertically upstanding leg portion 14 is adapted to be visually seen by the oncoming motorist. A transition region 26 flexibly interconnects the vertically upstanding leg portion 14 to the fixed horizontally disposed leg portion or base member 12. A pair of rib members or ledges 28,28 extend substantially perpendicular to the upstanding leg member 14 and serve to define a space or channel 22 therebetween. A suitable reflective strip 23 is adapted to be fixedly disposed within the space or channel 22 so as to reflect sunlight or a vehicle's lights in order to provide the oncoming motorist, as indicated by the arrow 25, with a visual indication of a traffic lane, or alternatively, that the motorist is entering or approaching a construction zone or work area. Alternatively; in lieu of the reflective strip 23, the entire marker 10 may simply be brightly colored so as to similarly provide the oncoming motorist with the necessary visual warning.

With reference being further made to FIG. 2, a typical, conventional, PRIOR ART temporary raised pavement marker (TRPM), which is similar to the temporary raised pavement marker (TRPM) 10 disclosed in FIG. 1 of the present drawings, as well as within FIG. 1 of the Speer et al. patent, is disclosed at 110 and is seen to likewise have a substantially L-shaped configuration. In particular, the temporary raised pavement marker (TRPM) 110 comprises a horizontally disposed leg or base member 112, and a vertically upstanding leg member 114 integrally connected to the horizontally disposed leg or base member 112 by means of a transitional region 116. A block or slab of adhesive 118 is fixedly secured to an undersurface or lower face portion of the horizontally disposed leg or base member 112, and in turn, a release sheet 120 is secured to an undersurface or lower face portion of the adhesive slab 118 so as to prevent the adhesive slab 118 from being inadvertently adhesively bonded to any surface, other than that particular location or portion of the roadway to which the temporary raised pavement marker (TRPM) 110 is to be fixedly secured, prior to the actual fixation of the temporary raised pavement marker (TRPM) 110 upon a selected location or portion of the roadway. As was the case with the temporary raised pavement marker (TRPM) 10 of FIG. 1 of the present drawings, as well as those of Speer et al., the upper end portion of the vertically upstanding leg member 114 of the temporary raised pavement marker (TRPM) 110 also comprises a pair of horizontally disposed rib members 122,122 which define a space or channel 124 therebetween for housing or accommodating a suitable reflector strip, not shown. Alternatively, the entire extrusion comprising the temporary raised pavement marker (TRPM) 110 may be fabricated from a suitable plastic material which is brightly colored, that is, it may be fabricated from a suitable resin material which is white or yellow.

The temporary raised pavement markers (TRPMs) 110 are normally placed upon the roadway surface during an extended period of time that construction or other road work is being performed upon the roadway surface, and therefore, the temporary raised pavement markers (TRPMs) 110 are normally placed upon the roadway surface prior to the completion of the entire construction or other road work as well as the application of the permanent traffic lane lines to the roadway surface. Accordingly, in order to protect the reflector strip, not shown, which is adapted to be disposed, housed, or accommodated within the space or channel 124 defined between the pair of horizontally disposed rib members 122,122, or alternatively, in order to protect the upper portion of the vertically upstanding leg member 114, when such portion of the temporary raised pavement marker (TRPM) 110 is to be used as the visual warning to oncoming motorists, from road paving materials, debris, and the like, a protective cover 126, fabricated from a suitable clear plastic material and having a substantially inverted U-shaped configuration, is disposed over the upper free edge portion of the temporary raised pavement marker (TRPM) 110 and is secured thereto by means of a suitable fastener or staple 128 which is applied thereto by means of a suitable stitching process or operation.

When the temporary raised pavement markers (TRPMs) 110 are to be subsequently used in conjunction with, for example, their traffic lane delineation functions, the protective covers 126 are removed, and still further, when the need for the temporary raised pavement markers (TRPMs) 110 is no longer required in view of the completion of the construction or other roadwork, and the application of the permanent traffic lane lines to the roadway surface has been performed, the temporary raised pavement markers (TRPMs) 110 themselves will obviously be removed from the roadway surface. Until now, the process for mounting and securing the temporary raised pavement markers (TRPMs) 110 upon the road-way surfaces has been accomplished manually whereby, for example, construction workmen or other personnel would have to manually deposit the temporary raised pavement markers (TRPMs) 110 onto the roadway surface as a result of, for example, removing the release sheet 120 from the undersurface portion of the adhesive slab 118 and pressing the temporary raised pavement marker (TRPM) 110 onto the roadway surface so as to cause the adhesive bonding of the temporary raised pavement marker (TRPM) 110 to the roadway surface. In view of the fact that the construction workmen or other personnel are physically present upon the particular roadway surface during the performance of such temporary raised pavement marker (TRPM) application operations onto the roadway surface, the workmen or personnel are undesirably exposed to dangerous vehicular conditions present upon the roadway. In addition, the temporary raised pavement marker (TRPM) 110 application procedures are quite tedious, time-consuming, and problematic.

More particularly, it is noted that in connection with one conventional technique for currently fabricating temporary raised pavement markers (TRPMs), the temporary raised pavement markers (TRPMs) are initially manufactured as elongated structures having the aforenoted substantially L-shaped cross-sectional configuration, and the adhesive material and release liner components are then applied to the undersurface portions of the relatively short, normally horizontally disposed leg members thereof. Subsequently, the elongated structures are cut at predetermined locations thereof so as to provide finalized temporary raised pavement markers (TRPMs) having predetermined width dimensions. As can be readily appreciated, however, as a result of such cutting or severing operations, the adhesive material and release liner components, as disposed upon the finalized temporary raised pavement markers (TRPMs), will have the same lateral extents, and therefore, the end portions of the release liner will not project laterally beyond the end portions of the adhesive material. Accordingly, the end portions of the adhesive material are effectively uncovered and exposed which presents problems in connection with the mechanical feeding of the temporary raised pavement markers (TRPMs) within automated machinery, as well as in connection with the packaging of the temporary raised pavement markers (TRPMs). Still further, it is to be noted and appreciated that when the adhesive material is applied to or deposited upon the undersurface portion of the relatively short leg of the elongated temporary raised pavement marker (TRPM) structure, the adhesive is applied or deposited in a heated state.

Subsequently, the adhesive material will cool, and as a result of the cooling process, the adhesive material undergoes a predetermined amount of shrinkage or contraction. Such shrinkage or contraction effectively forms a bond between the primary mass of the adhesive material and the release liner which effectively defines a line of demarcation or boundary which is known as a feather-edge bond. The feather-edge bond is very flexible and tends to bend along with the release liner. Accordingly, when it is attempted to remove the release liner from the adhesive material, in preparation for the application of each one of the temporary raised pavement markers (TRPMs) to the pavement surface, the feather-edge bond structure is placed in tension, and it has been noted that the tensile strength characteristics of the feather-edge bond structure are greater than the force levels normally required to peel the release liner from the adhesive material as well as the tensile or shear strength characteristics of the release liner per se. It can therefore be appreciated further that when the release liner is desired to be removed from its associated temporary raised pavement marker (TRPM), not only is such an operation difficult to achieve, but it often happens that the release liner and/or the adhesive material disposed upon the undersurface portion of the temporary raised pavement marker (TRPM) is damaged which can render the use of the particular temporary raised pavement marker (TRPM) unsuitable.

A need therefore existed in the art for a new and improved collated assembly of temporary raised pavement markers (TRPMs), and a system and method for automatically applying such collated assemblies of temporary raised pavement markers (TRPMs) to the roadway surfaces, and this need was met by means of the new and improved collated assembly of temporary raised pavement markers (TRPMs), and the system and method for automatically applying such collated assemblies of temporary raised pavement markers (TRPMs) to the roadway surfaces, as are disclosed within the previously noted related U.S. patent application Ser. No. 10/302,994 which was filed on Nov. 25, 2002 and which is entitled COLLATED ROAD MARKER ASSEMBLY, AND SYSTEM AND METHOD FOR AUTOMATICALLY APPLYING COLLATED ROAD MARKERS TO ROADWAY SURFACES, wherein the aforenoted structural and operational drawbacks and disadvantages characteristic of conventional or PRIOR ART temporary raised pavement markers (TRPMs), and the methods and techniques for applying such conventional or PRIOR ART temporary raised pavement markers (TRPMs) to roadway surfaces, were effectively overcome. Accordingly, however, a need still exists in the art for an apparatus or system, and method, for manufacturing collated assemblies of such temporary raised pavement markers (TRPMs) which will enable the new and improved collated assemblies of such temporary raised pavement markers (TRPMs) to be advantageously fabricated and packaged in such a manner as to subsequently enable the temporary raised pavement markers (TRPMs) to be automatically applied to the roadway surfaces, by means of the system and method disclosed within the previously noted related U.S. patent application Ser. No. 10/302,994 which was filed on Nov. 25, 2002 and which is entitled COLLATED ROAD MARKER ASSEMBLY, AND SYSTEM AND METHOD FOR AUTOMATICALLY APPLYING COLLATED ROAD MARKERS TO ROADWAY SURFACES.

OBJECTS OF THE INVENTION

Accordingly, it is an object of the present invention to provide a new and improved apparatus and method for manufacturing a collated array of temporary raised pavement markers (TRPMs) so as to facilitate the serial application of such collated temporary raised pavement markers (TRPMs) to roadway surfaces in order to in fact temporarily define traffic lanes or the like within construction zones, work sites, or maintenance or repair areas.

Another object of the present invention is to provide a new and improved apparatus and method for manufacturing a collated array of temporary raised pavement markers (TRPMs), for facilitating the serial application of the collated temporary raised pavement markers (TRPMs) to roadway surfaces in order to in fact temporarily define traffic lanes or the like within construction zones, work sites, or maintenance or repair areas, such that the manufactured collated array of temporary raised pavement markers (TRPMs) will effectively overcome the various operational drawbacks and disadvantages characteristic of conventional PRIOR ART temporary raised pavement markers (TRPMs).

An additional object of the present invention is to provide a new and improved apparatus and method for manufacturing a collated array of temporary raised pavement markers (TRPMs), for facilitating the serial application of the collated temporary raised pavement markers (TRPMs) to roadway surfaces in order to in fact temporarily define traffic lanes or the like within construction zones, work sites, or maintenance or repair areas, wherein the apparatus of the present invention can either place a plurality of serially spaced individual temporary raised pavement markers (TRPMs), having blocks or pads of adhesive already disposed upon a bottom surface portion thereof, upon a single release sheet common to all of the temporary raised pavement markers (TRPMs), or alternatively, can successively apply leading end portions of a single temporary raised pavement marker (TRPM) extrusion onto pads or blocks of adhesive material, predisposed upon a single or common release sheet, while substantially simultaneously severing such leading end portions of the single temporary raised pavement marker (TRPM) extrusion from the residual portion of the single temporary raised pavement marker (TRPM) extrusion so as to define the plurality of serially spaced individual temporary raised pavement markers (TRPMs).

A further object of the present invention is to provide a new and improved apparatus and method for manufacturing a collated array of temporary raised pavement markers (TRPMs), for facilitating the serial application of the collated temporary raised pavement markers (TRPMs) to roadway surfaces in order to in fact temporarily define traffic lanes or the like within construction zones, work sites, or maintenance or repair areas, wherein the apparatus of the present invention can either place a plurality of serially spaced individual temporary raised pavement markers (TRPMs), having blocks or pads of adhesive already disposed upon a bottom surface portion thereof, upon a single release sheet common to all of the temporary raised pavement markers (TRPMs), or alternatively, can successively apply leading end portions of a single temporary raised pavement marker (TRPM) extrusion onto pads or blocks of adhesive material, predisposed upon a single or common release sheet, while substantially simultaneously severing such leading end portions of the single temporary raised pavement marker (TRPM) extrusion from the residual portion of the single temporary raised pavement marker (TRPM) extrusion so as to define the plurality of serially spaced individual temporary raised pavement markers (TRPMs), whereby the plurality of serially spaced individual temporary raised pavement markers (TRPMs) can be properly collated so as to effectively avoid any problems in connection with the development of the featheredge bond region between the release sheet and the blocks or pads of adhesive.

A last object of the present invention is to provide a new and improved apparatus and method for manufacturing a collated array of temporary raised pavement markers (TRPMs), for facilitating the serial application of the collated temporary raised pavement markers (TRPMs) to roadway surfaces in order to in fact temporarily define traffic lanes or the like within construction zones, work sites, or maintenance or repair areas, wherein the apparatus of the present invention can either place a plurality of serially spaced individual temporary raised pavement markers (TRPMs), having blocks or pads of adhesive already disposed upon a bottom surface portion thereof, upon a single release sheet common to all of the temporary raised pavement markers (TRPMs), or alternatively, can successively apply leading end portions of a single temporary raised pavement marker (TRPM) extrusion onto pads or blocks of adhesive material, predisposed upon a single or common release sheet, while substantially simultaneously severing such leading end portions of the single temporary raised pavement marker (TRPM) extrusion from the residual portion of the single temporary raised pavement marker (TRPM) extrusion so as to define the plurality of serially spaced individual temporary raised pavement markers (TRPMs) upon the single release sheet, whereby the plurality of serially spaced individual temporary raised pavement markers (TRPMs) can be properly collated so as to effectively avoid any problems in connection with the packaging of the collated temporary raised pavement markers (TRPMs) within a magazine to be utilized for serially supplying the plurality of temporary raised pavement markers (TRPMs) toward the roadway surface.

SUMMARY OF THE INVENTION

The foregoing and other objectives are achieved in accordance with the teachings and principles of the present invention through the provision of a new and improved apparatus and method for manufacturing a collated array of temporary raised pavement markers (TRPMs), for facilitating the serial application of the collated temporary raised pavement markers (TRPMs) to roadway surfaces in order to in fact temporarily define traffic lanes or the like within construction zones, work sites, or maintenance or repair areas, wherein, in accordance with a first embodiment of the apparatus of the present invention, leading end portions of a single temporary raised pavement marker (TRPM) extrusion are serially applied onto pads, blocks, or patches of adhesive material, predisposed upon a single or common release sheet, while substantially simultaneously therewith, the leading end portions of the single temporary raised pavement marker (TRPM) extrusion are severed from the residual portion of the single temporary raised pavement marker (TRPM) extrusion so as to define the plurality of serially spaced individual temporary raised pavement markers (TRPMs) disposed upon the single release sheet, whereas alternatively, in accordance with a second embodiment of the apparatus of the present invention, a plurality of serially spaced individual temporary raised pavement markers (TRPMs), having blocks, patches, or pads of adhesive already disposed upon a bottom surface portion thereof, are placed upon a single release sheet common to all of the temporary raised pavement markers (TRPMs). In connection with either embodiment of the apparatus of the present invention, the plurality of temporary raised pavement markers (TRPMs), serially spaced upon the single release sheet, are then collated and disposed within a suitable container so as to effectively form a supply magazine of temporary raised pavement markers (TRPMs).

BRIEF DESCRIPTION OF THE DRAWINGS

The claim of this patent contains at least one drawing executed in color.

Various other objects, features, and attendant advantages of the present invention will be more fully appreciated from the following detailed description when considered in connection with the accompanying drawings in which like reference characters designate like or corresponding parts throughout the several views, and wherein:

FIG. 23 is an end perspective view of one of the release paper supply rolls as disclosed within FIG. 18 and illustrating a brake mechanism operatively associated with the release paper supply roll so as to impress a predetermined amount of braking resistance upon the release paper supply roll and thereby ensure the proper supply and unreeling of the release paper from the release paper supply roll;

FIG. 30 is an enlarged, partial top plan view, similar to that of FIG. 29, showing, however, the slidable mounting of the conveyor system, and its drive components, upon the main framework of the apparatus, as being disposed at its retracted position with respect to the extruder discharge tunnel such that the individual temporary raised pavement markers (TRPMs) can simply be discharged from the extruder discharge channel and collected upon a floor platform, within a suitable container, or the like.

DETAILED DESCRIPTION OF THE ILLUSTRATED EMBODIMENTS

Figure 3:
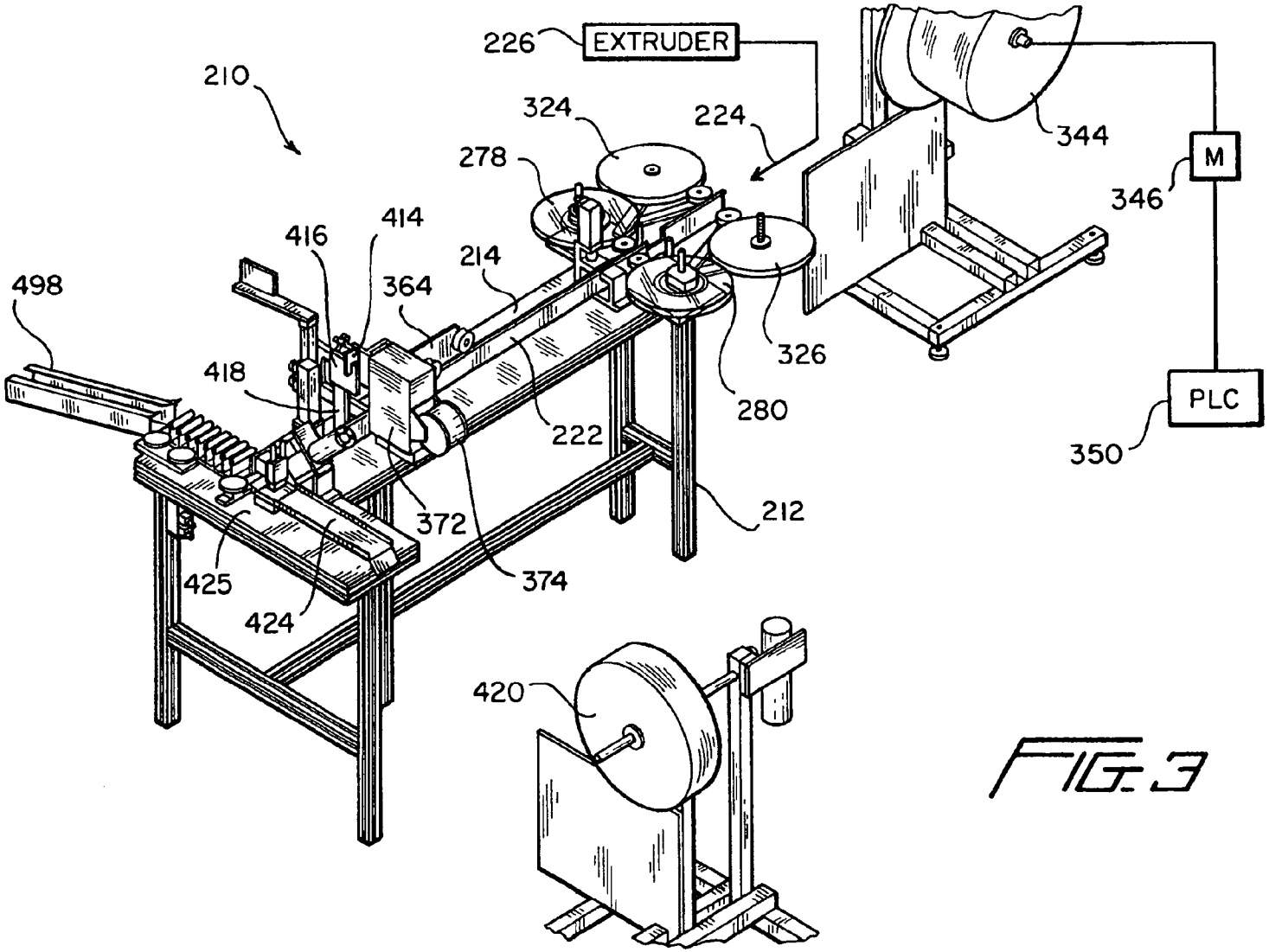
FIG. 3 is a perspective view of a first embodiment of a new and improved apparatus or system, for manufacturing a collated array of temporary raised pavement markers (TRPMs), constructed in accordance with the principles and teachings of the present invention and showing the cooperative parts thereof, including means for indexably feeding a continuous temporary raised pavement marker (TRPM) extrusion from an extruder toward a downstream end portion of the apparatus or system; means for applying continuous reflective strips or tapes to opposite sides of the continuous temporary raised pavement marker (TRPM) extrusion; means for applying a continuous protective cover, having a substantially inverted U-shaped configuration, over the continuous temporary raised pavement marker (TRPM) extrusion so as to effectively protect the continuous reflective tapes or strips disposed upon the opposite sides of the continuous temporary raised pavement marker (TRPM) extrusion; means for indexably feeding a continuous release sheet having patches of adhesive material disposed thereon at predetermined longitudinally spaced locations thereof; means for impressing the leading end portion of the continuous temporary raised pavement marker (TRPM) extrusion onto one of the adhesive patches disposed upon the continuous release sheet, and for immediately severing such leading end portion of the temporary raised pavement marker (TRPM) extrusion from the residual continuous temporary raised pavement marker (TRPM) extrusion so as to form an individual temporary raised pavement marker (TRPM), whereby a plurality of individual temporary raised pavement markers (TRPMs) are serially disposed upon the continuous release sheet; and means for forming the plurality of individual temporary raised pavement markers (TRPMs), serially disposed upon the continuous release sheet, into a collated array of temporary raised pavement markers (TRPMs) for deposition within a container, carton, or magazine to serve as a supply of temporary raised pavement markers (TRPMs) for apparatus for serially applying the temporary raised pavement markers (TRPMs) onto a roadway surface.
Figure 4:
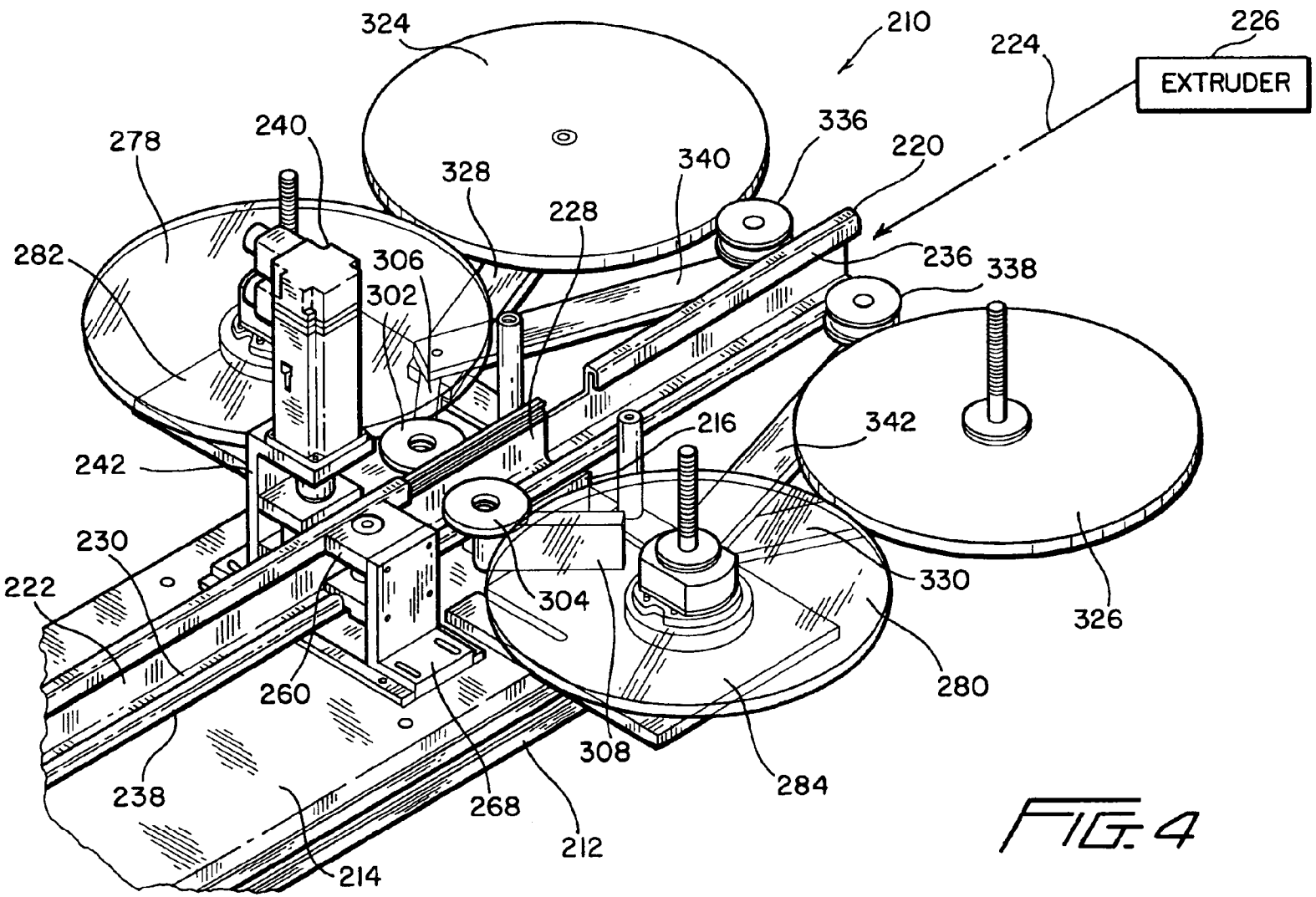
FIG. 4 is a partial, enlarged, top perspective view of the upstream end portion of the apparatus or system as disclosed within FIG. 3 and showing a first one of the servo-drive mechanisms for indexably feeding the continuous temporary raised pavement marker (TRPM) extrusion from the extruder toward the downstream end portion of the apparatus or system, and of the auxiliary mechanism for applying the continuous reflective strips or tapes onto the opposite sides of the continuous temporary raised pavement marker (TRPM) extrusion.
Figure 7:
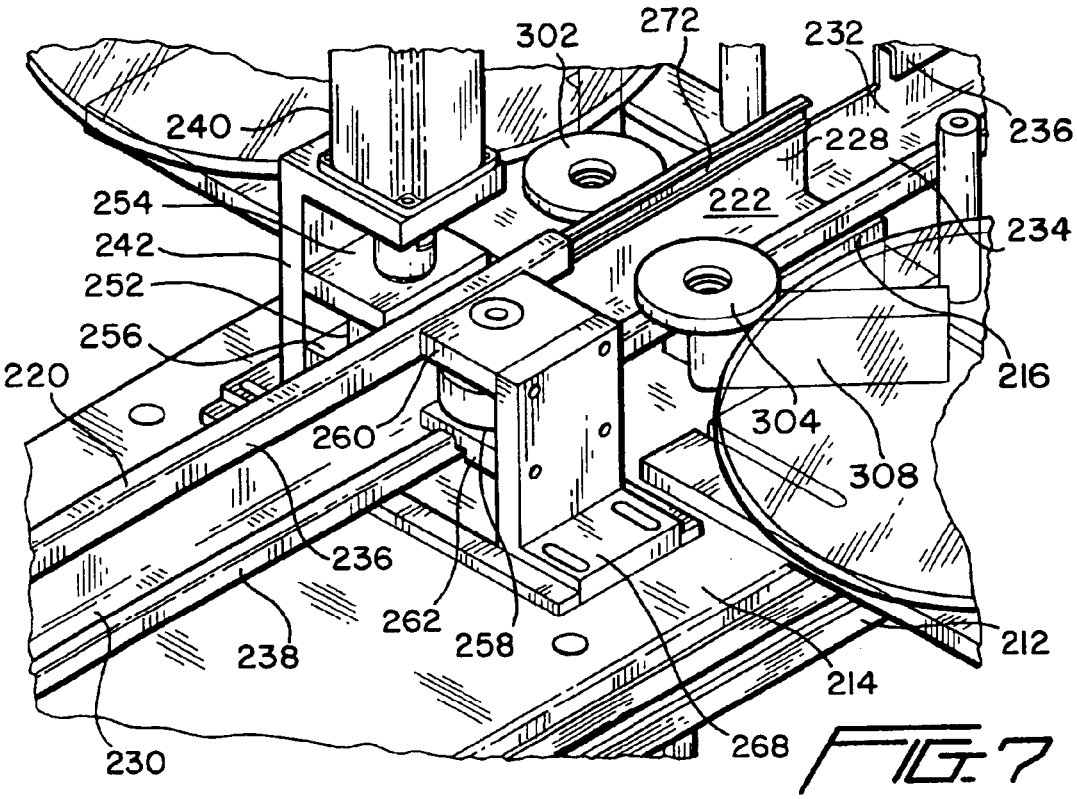
FIG. 7 is a view, similar to that of FIG. 4, showing, in particular, the details of the first servo-drive mechanism for feeding the continuous temporary raised pavement marker (TRPM) extrusion in the downstream direction.
Figure 10:
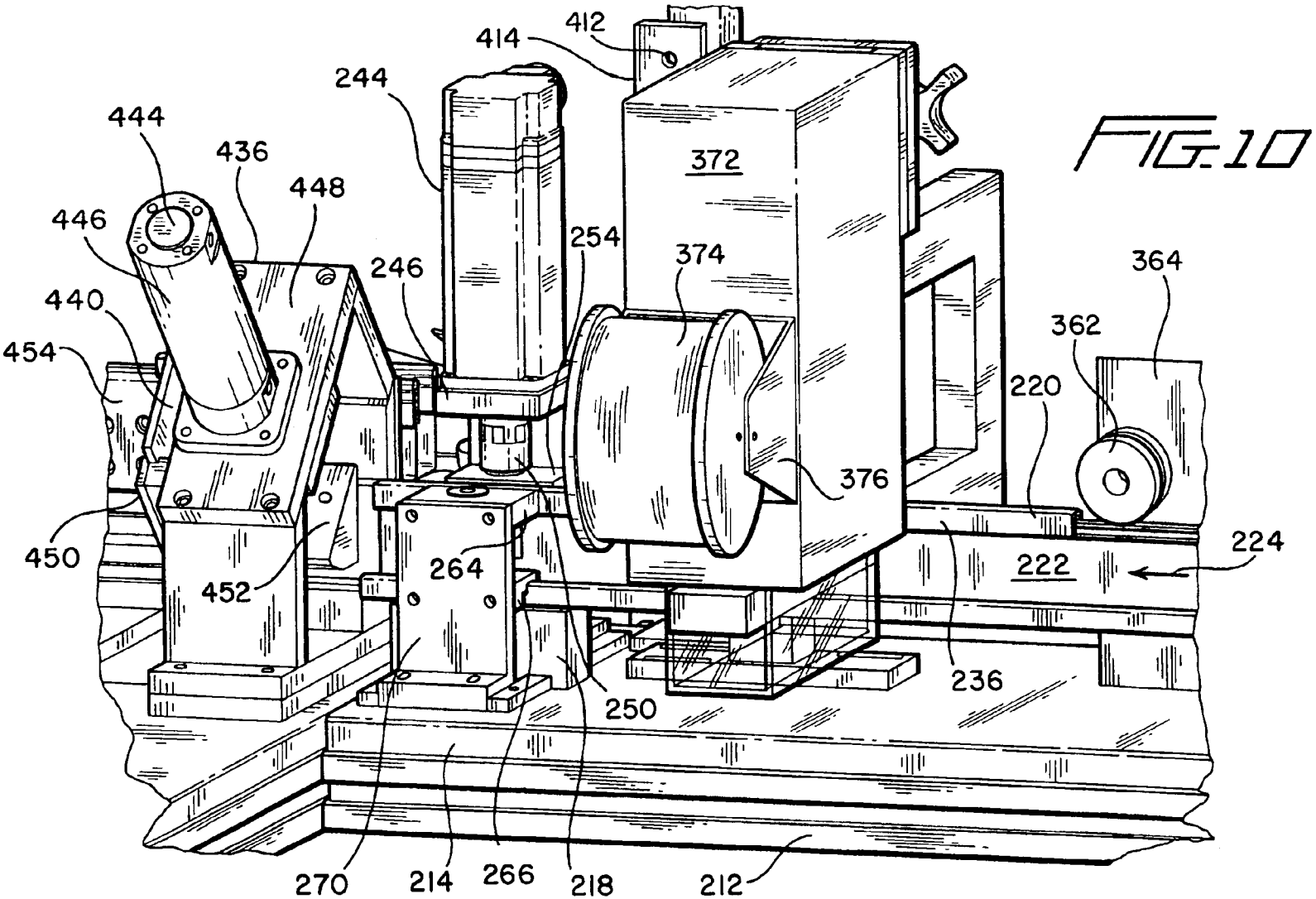
FIG. 10 is a partial, enlarged side perspective view of the apparatus or system as disclosed within FIG. 3 and showing the stitching mechanism, the second servo-drive mechanism for feeding the continuous temporary raised pavement marker (TRPM) extrusion in the downstream direction, and the applicator and cutter mechanisms for serially applying the end portions of the continuous temporary raised pavement marker (TRPM) extrusion onto the continuous release sheet, and for serially severing such end portions of the continuous temporary raised pavement marker (TRPM) extrusion as applied onto the continuous release sheet, such that a plurality of longitudinally spaced individual temporary raised pavement markers (TRPMs) are disposed upon the continuous release sheet.

Referring now to the drawings, and more particularly to FIG. 3 thereof, a first embodiment of a new and improved apparatus or system constructed in accordance with the principles and teachings of the present invention for manufacturing a collated array of temporary raised pavement markers (TRPMs), and showing the cooperative parts thereof, is disclosed and is generally indicated by the reference character 210. More particularly, it is seen that the new and improved apparatus or system 210 for manufacturing the collated array of temporary raised pavement markers (TRPMs) comprises a framework 212 upon which there is disposed a longitudinal, axially oriented support surface or table 214. At least two, longitudinally spaced support stands or mounting blocks 216,218, as best seen in FIGS. 4,7, and 10, are fixedly mounted at respective upstream and downstream locations upon the support surface or table 214 so as to fixedly support a longitudinal, axially oriented guide track 220 thereon. In turn, the guide track 220 is provided so as to support a continuous, longitudinal temporary raised pavement marker (TRPM) extrusion 222 which is adapted to be axially conveyed along an axially extending conveyor flow path 224 after being extruded from an extruder mechanism 226.

Figure 1:
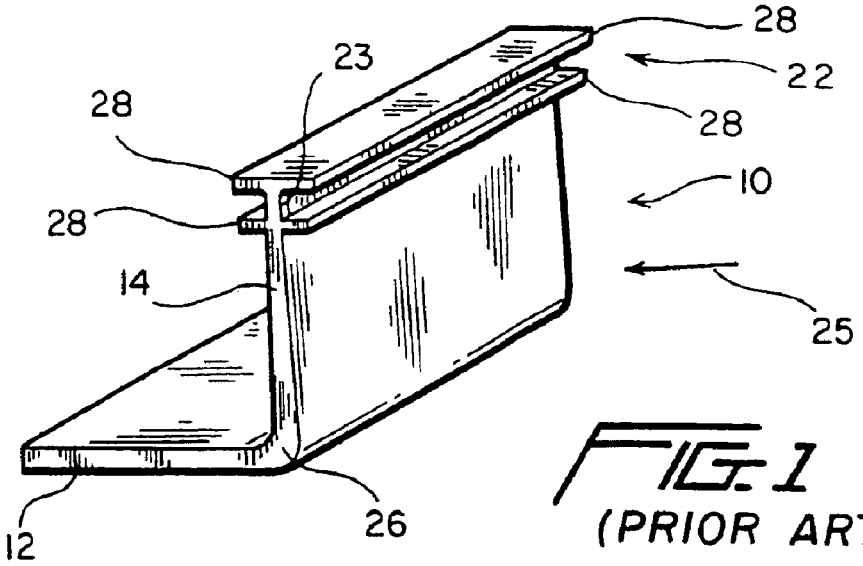
FIG. 1 (PRIOR ART)
FIG. 1 is a perspective view of a first conventional PRIOR ART temporary raised pavement marker (TRPM)
Figure 2:
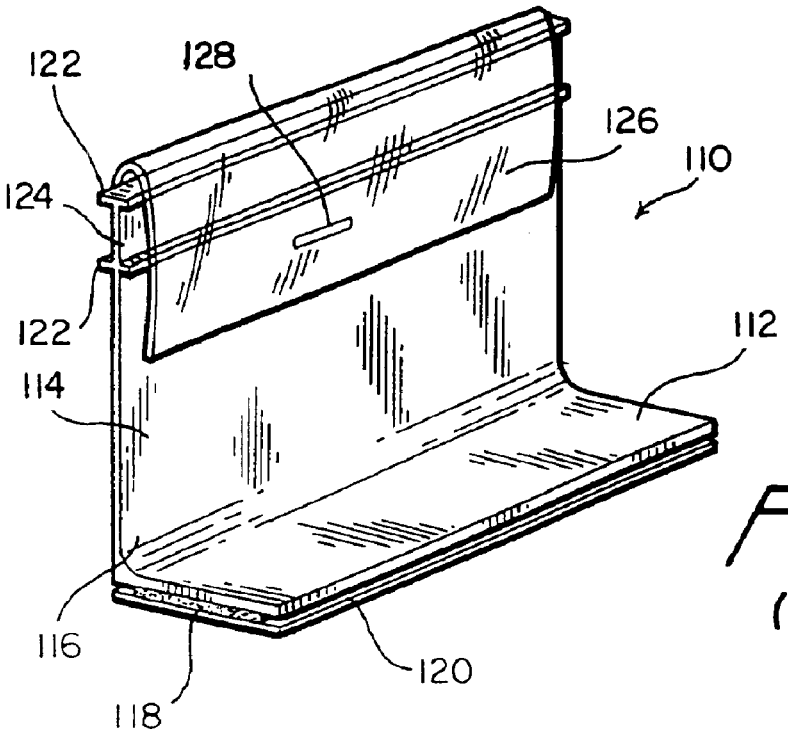
FIG. 2 (PRIOR ART)
FIG. 2 is a perspective view of a second conventional PRIOR ART temporary raised pavement marker (TRPM) which has a protective covering disposed thereon.

As can best be appreciated from FIGS. 4 and 7, the temporary raised pavement marker (TRPM) extrusion 222 has a substantially L-shaped cross-sectional configuration, comprising an upstanding or vertically oriented leg portion 228 and a horizontally oriented leg portion 230, whereby the temporary raised pavement marker (TRPM) extrusion 222 is similar in structure to the temporary raised pavement markers (TRPMs) 10,110 as respectively disclosed within FIGS. 1 and 2. In a similar manner, the guide track 220 is likewise seen to have a substantially L-shaped cross-sectional configuration, comprising an upstanding or vertically oriented leg portion 232 and a horizontally oriented leg portion 234. In addition, it is seen that the vertically oriented or upstanding leg portion 232 has a substantially inverted U-shaped vertical channel portion 236 integrally connected thereto at predetermined longitudinally spaced locations, while the horizontally oriented leg portion 234 likewise has a substantially C-shaped channel portion 238 integrally connected thereto. In this manner, the upstanding or vertically oriented leg portion 228 of the temporary raised pavement marker (TRPM) extrusion 222 is adapted to be conveyingly supported upon the upstanding or vertically oriented leg portion 232 of the guide track 220, with the upper edge section of the upstanding or vertically oriented leg portion 228 of the temporary raised pavement marker (TRPM) extrusion 222 being disposed within the vertical channel portion 236 of the guide track 220, while the horizontally oriented leg portion 230 of the temporary raised pavement marker (TRPM) extrusion 222 is adapted to be conveyingly supported upon the horizontally oriented leg portion 234 of the guide track 220, with the horizontal edge section of the horizontally oriented leg portion 230 of the temporary raised pavement marker (TRPM) extrusion 222 being disposed within the horizontal channel portion 238 of the guide track 220.

In order to in fact convey the temporary raised pavement marker (TRPM) extrusion 222 along the conveyor path 224, first and second, upstream and downstream, temporary raised pavement marker (TRPM) extrusion drive means are provided along the conveyor path 224. More particularly, as can best be seen in FIGS. 4,7, and 10, the first upstream temporary raised pavement marker (TRPM) extrusion drive means comprises a servo motor 240 which is fixedly attached to a mounting bracket 242 that has a substantially Z-shaped cross-sectional configuration, while the second downstream temporary raised pavement marker (TRPM) extrusion drive means comprises a servo motor 244 which is fixedly attached to a mounting bracket 246 that likewise has a substantially Z-shaped cross-sectional configuration. The mounting brackets 242,246 are both adapted to be fixedly secured to the table or support surface 214 in an adjustable manner, and the servo motors 240,244 are respectively provided with dependent rotary drive couplers 248,250 which are respectively adapted to drivingly engage drive rollers for engaging the back or rear side surface of the upstanding or vertically oriented leg portion 228 of the temporary raised pavement marker (TRPM) extrusion 222. Only the drive roller 252, operatively associated with the rotary drive coupler 248 of the servo motor 240, is visible, as can in fact be seen in FIG. 7, and the drive roller 252, as well as the drive roller, not shown but operatively associated with the rotary drive coupler 250 of the servo motor 244, is adapted to be rotatably mounted within a pair of vertically spaced support plates 254,256 which are respectively attached to the mounting brackets 242,246, it being additionally noted that only the support plate 254 for the drive coupler 250 is visible in FIG. 10. It is also noted that the upstanding or vertical oriented leg portion 232 of the guide track 220 is provided with suitable apertures, not shown, in order to permit each one of the drive rollers 252 to project therethrough in order to drivingly engage the back or rear side surface of the upstanding or vertically oriented leg portion 228 of the temporary raised pavement marker (TRPM) extrusion 222.

Continuing further, idler rollers 258 are also provided for operative cooperation in conjunction with the drive rollers 252, it being noted that only the idler roller 258, for operative cooperation in conjunction with the drive roller 252 operatively driven by means of the rotary drive coupler 248 of the servo motor 240, is visible as shown in FIG. 7. The idler rollers 258 are respectively adapted to be rotatably mounted within a pair of vertically spaced support plates 260,262, and 264,266, and each pair of vertically spaced support plates 260,262, and 264,266, are respectively attached to substantially L-shaped mounting brackets 268, 270 which are adapted to be fixedly secured to the table or support surface 214 in an adjustable manner. As a result of the adjustable fixation of the L-shaped mounting brackets 268,270 upon the table or support surface 214, each one of the idler rollers 258 is able to properly engage the front side surface of the upstanding or vertically oriented leg portion 228 of the temporary raised pavement marker (TRPM) extrusion 222 and thereby operatively cooperate with the drive rollers 252 in conveying the temporary raised pavement marker (TRPM) extrusion 222 along the conveyor path 224.

Figure 5:
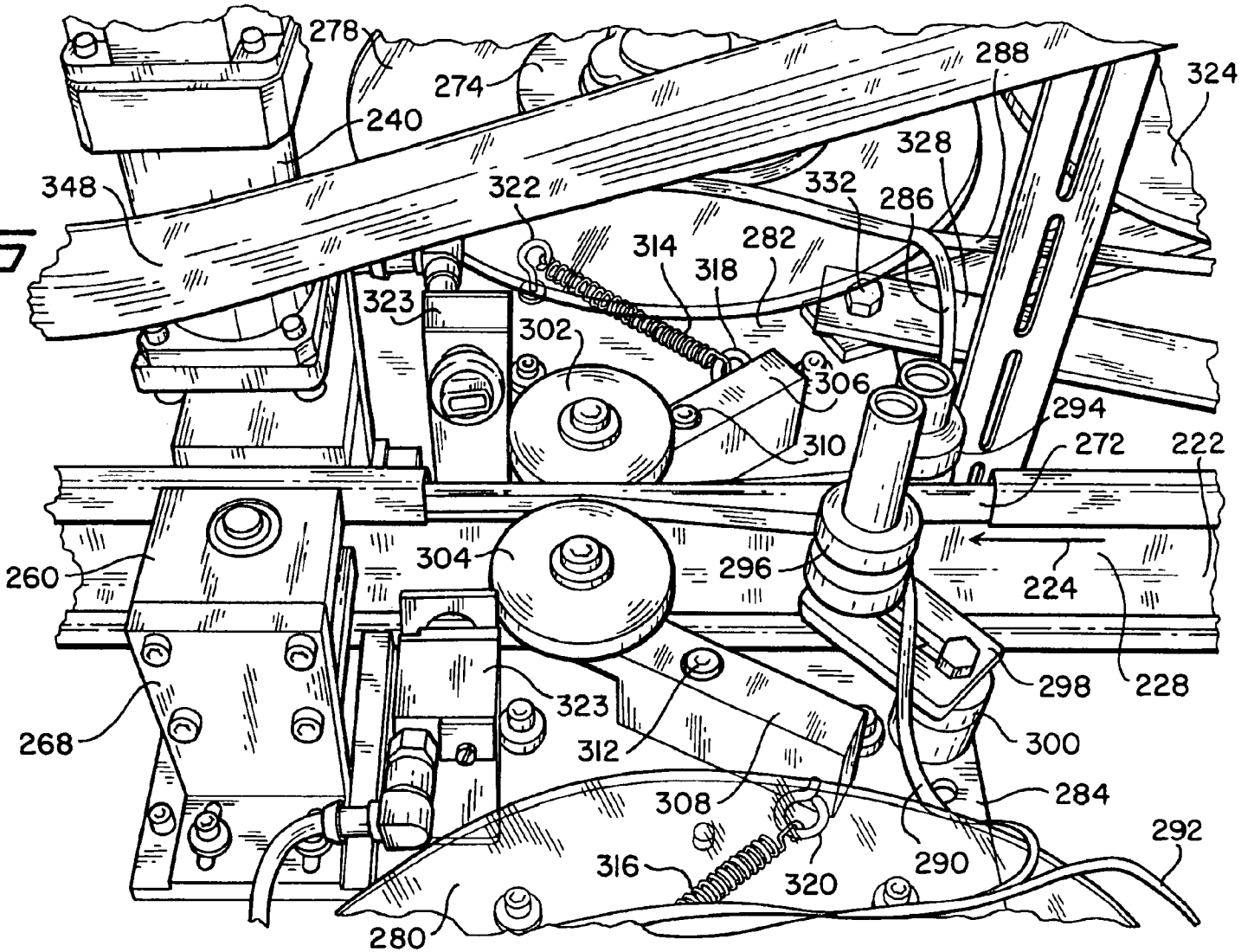
FIG. 5 is a view, similar to that of FIG. 4, showing additional details of the mechanisms for feeding the reflective strips or tapes from their supply reels, and for applying the same onto the opposite sides of the continuous temporary raised pavement marker (TRPM) extrusion.
Figure 6:
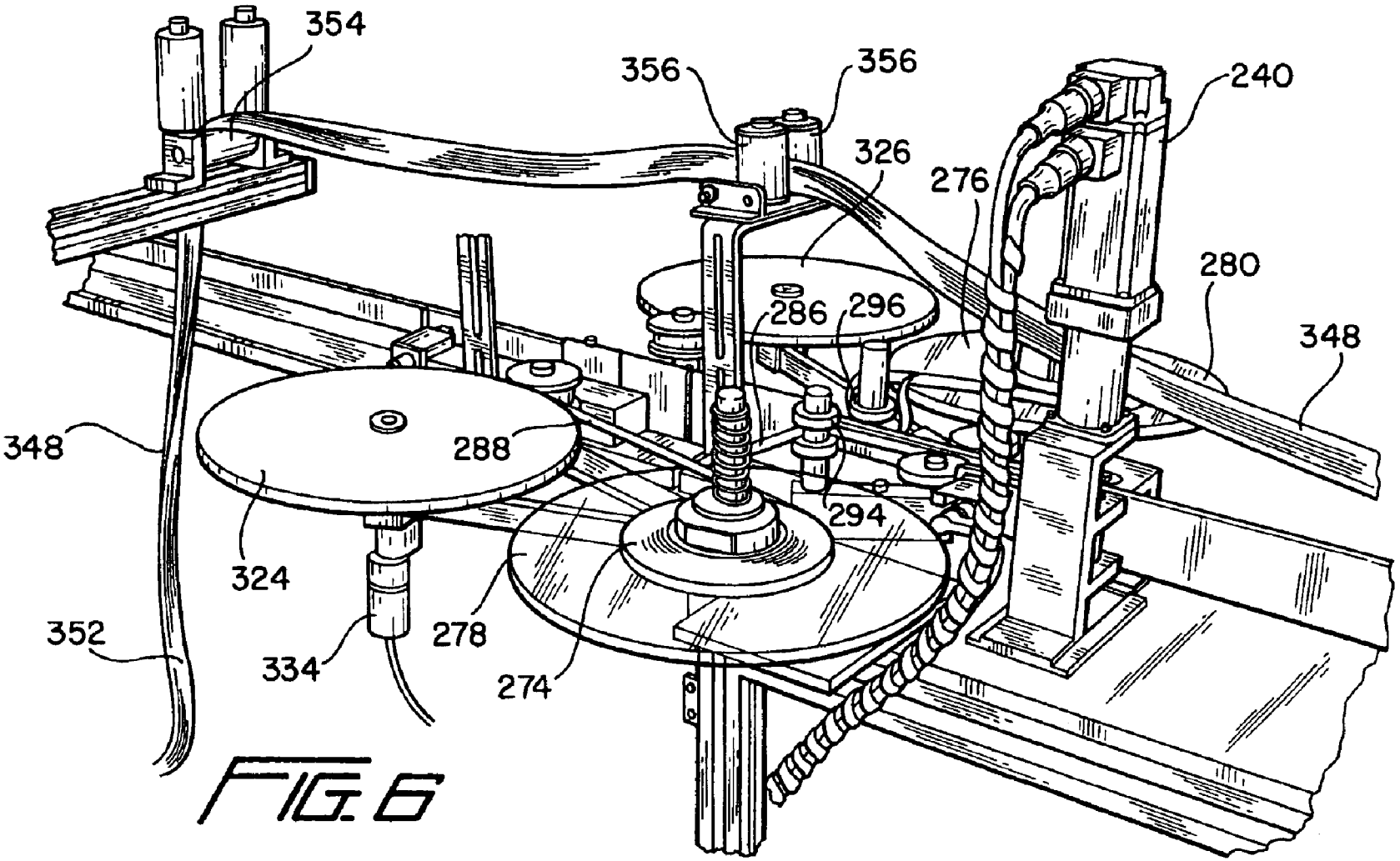
FIG. 6 is a view, similar to those of FIGS. 4 and 3, but viewed from the opposite side of the flow path along which the continuous temporary raised pavement marker (TRPM) extrusion is fed, showing still additional details of the mechanisms for feeding the reflective strips or tapes from their supply reels, and for applying the same onto the opposite sides of the continuous temporary raised pavement marker (TRPM) extrusion, as well as the mechanism for in-feeding the continuous protective cover to be deposited onto the continuous temporary raised pavement marker (TRPM) extrusion.

As was disclosed in connection with the temporary raised pavement markers (TRPMs) 10,110 respectively disclosed within FIGS. 1 and 2, reflective strips or tapes were adapted to be fixedly mounted within the channels 22,124 defined upon the opposite sides of the upstanding or vertically oriented leg portions 14,114 of the temporary raised pavement markers (TRPMs) 10,110, and in a similar manner, adhesive-backed reflective strips or tapes are adapted to be fixedly mounted within channels 272 which are defined upon the upper opposite sides of the upstanding or vertically oriented leg portion 228 of the temporary raised pavement marker (TRPM) extrusion 222 as is best seen in FIGS. 5 and 7. More particularly, as can best be seen in FIGS. 4–7, separate supply rolls of the reflective tape or strip laminates are disclosed at 274 and 276, and the supply rolls 274,276 are disposed upon support disks 278,280. The support disks 278,280 are rotatably mounted upon support plates 282, 284 which are bolted to the upstream end of the table or support surface 214, and it is seen that the reflective tape or strip laminate being conveyed toward the temporary raised pavement marker (TRPM) extrusion 222 from the supply roll 274 actually comprises an adhesive-backed reflective tape or strip 286 and a release liner 288, while the reflective tape or strip laminate being conveyed toward the temporary raised pavement marker (TRPM) extrusion 222 from the supply roll 276 actually comprises an adhesive-backed reflective tape or strip 290 and a release liner 292. The release liners 288, 292 are separated from the reflective tapes or strips 286, 290 shortly after the reflective tape or strip laminates are unreeled from the supply rolls 274,276, and in this manner, the reflective tapes or strips 286,290 can in fact be conveyed toward the respective sides of the temporary raised pavement marker (TRPM) extrusion 222 while the release liners 288,292 are conveyed away from the temporary raised pavement marker (TRPM) extrusion 222 so as to ultimately be discarded.

In particular, each reflective tape or strip 286, 290 is routed through an arcuate guide channel which is respectively defined between a pair or set of vertically spaced guide rollers 294,296 which are respectively disposed upon opposite sides of the conveyor flow path 224 along which the temporary raised pavement marker (TRPM) extrusion 222 is conveyed. As best seen in FIG. 5, the pair or set of guide rollers 296 is rotatably disposed upon a slotted mounting bracket 298, and the slotted mounting bracket 298 is adjustably mounted upon an upstanding post 300 which is fixedly mounted upon the support plate 284. In this manner, the pair or set of guide rollers 296 can be optimally positioned with respect to the temporary raised pavement marker (TRPM) extrusion 222 so as to in fact properly guide the reflective tape or strip 290 toward the temporary raised pavement marker (TRPM) extrusion 222. It is noted that while only the slotted mounting bracket 298 and the upstanding post 300 operatively associated with the pair or set of guide rollers 296 are visible, a similar mounting bracket and upstanding post are of course operatively provided in conjunction with the pair or set of guide rollers 294.

Still further, it is seen that an application roller 302,304 is respectively disposed upon each side of the conveyor flow path 224 along which the temporary raised pavement marker (TRPM) extrusion 222 is conveyed, and that each one of the application rollers 302,304 is respectively mounted upon one end of an arm 306,308 which is respectively pivotally mounted upon each one of the support plates 282, 284 by means of a pivot pin 310,312. A coil spring 314,316 is respectively connected at a first end thereof to the opposite end of each arm 306,308 by means of a first suitable eyehook fastener 318,320, and the second end of each coil spring 314,316 is fixedly connected to a respective one of the support plates 282,284 by means of a second suitable eyehook fastener, only the second eyehook fastener operatively associated with the coil spring 314 being visible in FIG. 5 at 322. In this manner, the arms 306,308 are caused to pivot around their respective pivot pins 310,312 so as to effectively bias the application rollers 302,304 into operative engagement with the channels 272 of the temporary raised pavement marker (TRPM) extrusion 222 whereby as a result of the operative cooperation between the application rollers 302,304 and the channels 272 of the temporary raised pavement marker (TRPM) extrusion 222, the reflective strips or tapes 286,290 are forced into and adhered within the channels 272 of the temporary raised pavement marker (TRPM) extrusion 222 as the temporary raised pavement marker (TRPM) extrusion 222 is conveyed along the conveyor flow path 224 by means of the servo motor drive assemblies 240,244. It is of course also noted, as can best be appreciated from FIG. 5, that a portion of the substantially inverted U-shaped vertical channel portion 236 of the guide track 220 is effectively discontinued so as to in fact permit the application rollers 302,304 to operatively engage the channels 272 of the temporary raised pavement marker (TRPM) extrusion 222 and thereby apply and adhere the adhesive-backed reflective strips or tapes 286,290 within the channels 272 of the temporary raised pavement marker (TRPM) extrusion 222. It is also noted, as best seen in FIG. 5, that suitable photodetector mechanisms 323,323 are disposed upon opposite sides of the conveyor flow path 224, along which the temporary raised pavement marker (TRPM) extrusion 222 is being conveyed, so as to in fact confirm that the reflective strips or tapes 286,290 have in fact been deposited within the channels 272 of the temporary raised pavement marker (TRPM) extrusion 222.

It is to be appreciated still further that means are also provided for effectively discarding or removing the release liners 288,292 once they have effectively been separated from the adhesive-backed reflective strips or tapes 286,290. More particularly, as can best be appreciated from FIGS. 4 and 6, a pair of drive disks 324,326 are disposed upon opposite sides of the conveyor flow path 224 and are rotatably mounted upon first end portions of first support arms 328,330 which have second opposite ends thereof respectively bolted to the support plates 282,284 by means of a suitable bolt fastener, although only the bolt fastener operatively associated with the first support arm 328 is visible at 332 in FIG. 5. A drive motor is disposed beneath each one of the first support arms 328,330 and is respectively drivingly connected to each one of the drive disks 324,326, although only the drive motor operatively connected to the drive disk 324 is visible in FIG. 6 as at 334. In addition, a pair of flanged idler rollers 336,338 are likewise disposed upon opposite sides of the conveyor flow path 224 and are rotatably mounted upon first end portions of second support arms 340,342 which have second opposite ends thereof likewise bolted to the support plates 282, 284 by means of the same bolt fasteners securing the first support arms 328,330 to the support plates 282,284, such as, for example, bolt fastener 332. It is to be noted that the outer peripheral edge portion of each drive disk 324,326 is adapted to be disposed within, and operatively engaged with, the annular recess portions defined between the upper and lower flanges of the flanged idler rollers 336,338, and in this manner, when the release liners 288,292 are interposed between the outer peripheral edge portions of the drive disks 324,326 and the flanged idler rollers 336,338, the release liners 288,292 will effectively be drivingly separated and removed from the adhesive-backed reflective strips or tapes 286,290 so as to ultimately be discarded.

Continuing still further, it will also be recalled, in connection with the discussion of the second embodiment of the conventional PRIOR ART temporary raised pavement marker (TRPM) 110 as disclosed within FIG. 2, that a substantially inverted U-shaped protective covering 126 was adapted to be disposed over the upper end portion of the temporary raised pavement marker (TRPM) 110 so as to effectively protect the reflective strips or tapes until the temporary raised pavement markers (TRPMs) 110 were actually ready to be used upon the roadway surfaces. Accordingly, in conjunction with the temporary raised pavement marker (TRPM) extrusion 222, a protective covering, similar to the protective covering 126 utilized in conjunction with the temporary raised pavement marker (TRPM) 110, is adapted to be positioned over the upper end portion of the temporary raised pavement marker (TRPM) extrusion 222 so as to effectively protect the reflective strips or tapes 286,290 which have been previously applied within the channel regions 272 defined upon the opposite sides of the temporary raised pavement marker (TRPM) extrusion 222 as has been heretofore described and disclosed within FIGS. 5 and 6. More particularly, as disclosed within FIG. 1, a supply roll of protective covering material is disclosed at 344, and a drive motor 346 is operatively connected to the supply roll 344 of the protective covering material so as to periodically cause rotation of the same in order to unreel a suitable supply of the protective covering material 348, as disclosed within FIGS. 5,6, and 8, which is to be conveyed toward and applied onto the temporary raised pavement marker (TRPM) extrusion 222.

The drive motor 346 is, in turn, under the control of a programmable logic controller (PLC) 350, and it is noted further that the programmable logic controller (PLC) 350 is utilized to control all of the motor drive or operative movements of all of the various components, which have already been disclosed and described, which will hereinafter be disclosed and described, and which comprise the new and improved apparatus or system 210 of the present invention for manufacturing the collated array of temporary raised pavement markers (TRPMs). As disclosed within FIG. 6, and with additional reference also being made to FIGS. 5 and 8–10, the drive motor 346 is operated so as unreel a suitable amount of the protective covering material 348 from the supply reel 344 in order to form a slack amount or dependent loop portion 352 of the protective covering material 348. The protective covering material 348, which forms the dependent loop portion 352, is then conducted upwardly over a horizontally disposed idler roller 354, and subsequently, the protective covering material 348 is further conducted in the downstream direction between a pair of upstanding idler rollers 356,356. The protective covering material 348 can therefore be appropriately guided further in the downstream direction in order to ultimately be engaged with and mounted upon the temporary raised pavement marker (TRPM) extrusion 222 so as to thereby cover or overlie the reflective strips or tapes 286,290 which were previously deposited and adhered within the channels 272 of the temporary raised pavement marker (TRPM) extrusion 222.

Figure 9:
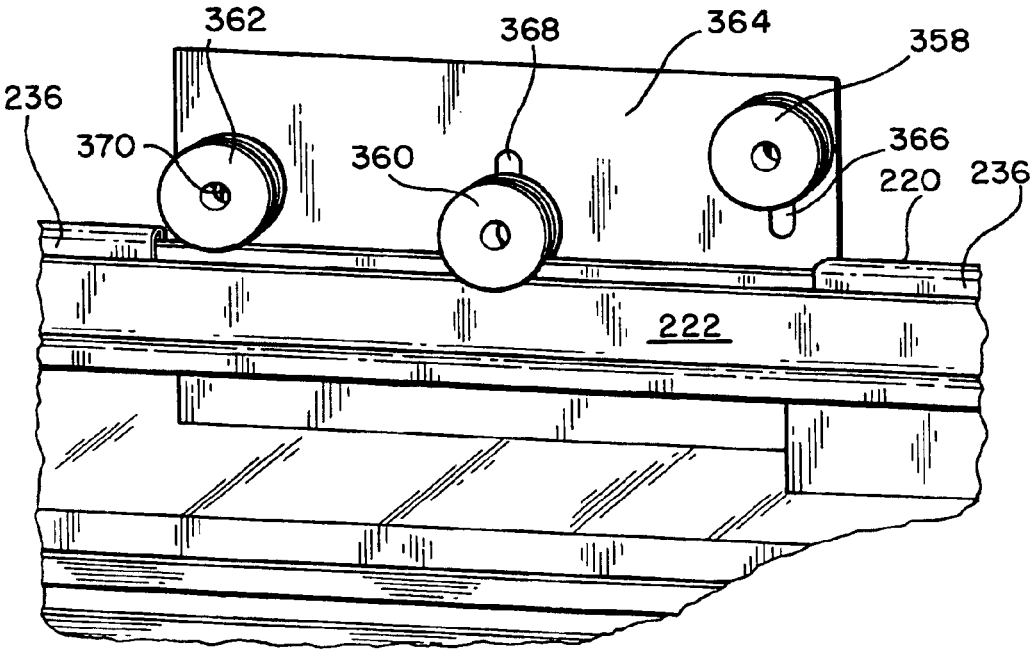
FIG. 9 is an enlarged side elevational view of the roller mechanism, as disclosed within FIG. 8, for applying the continuous protective cover onto the continuous temporary raised pavement marker (TRPM) extrusion, showing, in particular, the adjustable mounting of the individual application rollers for engaging the continuous protective covering so as to properly mount the same upon the continuous temporary raised pavement marker (TRPM) extrusion.
Figure 8:
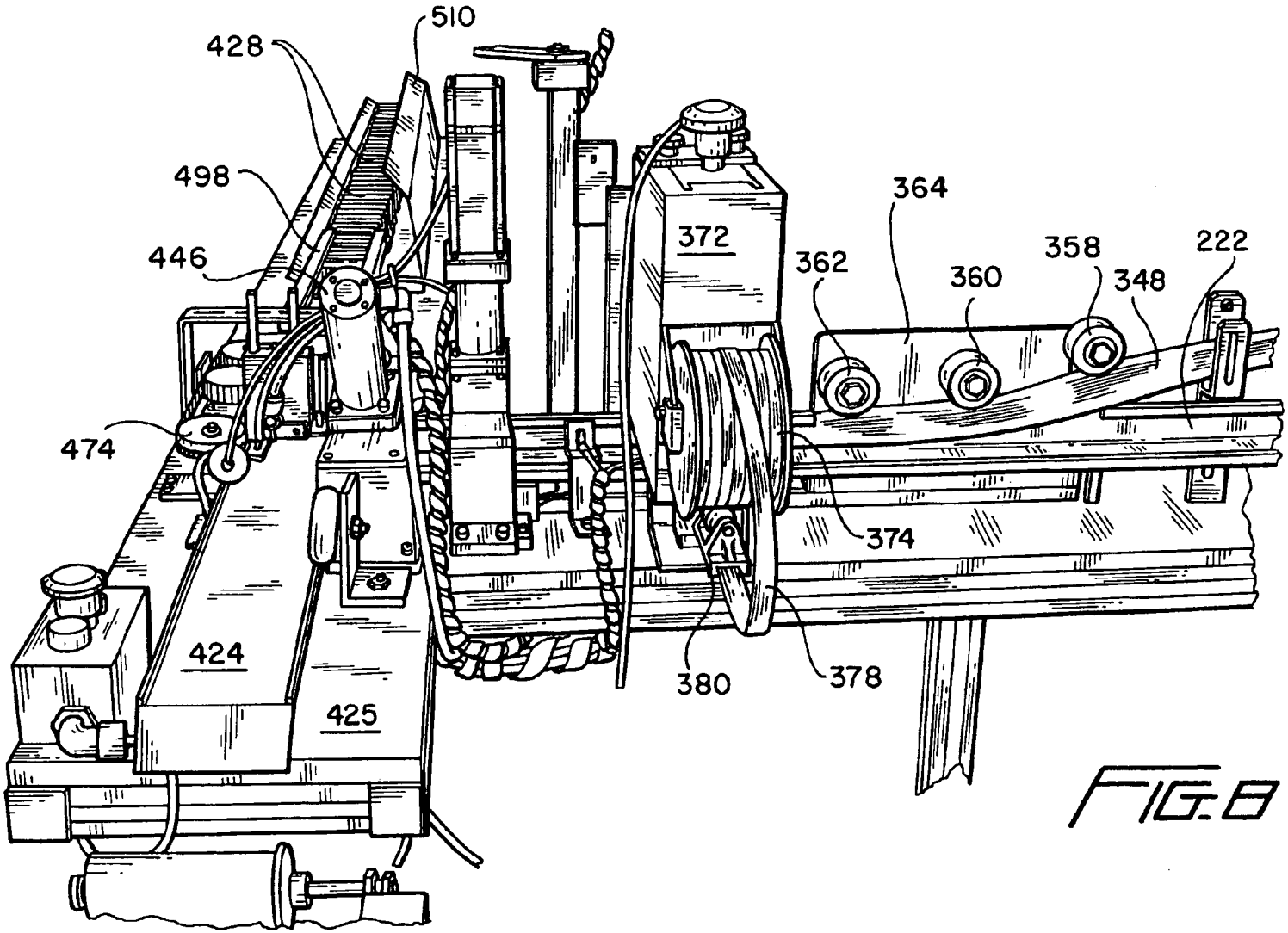
FIG. 8 is an enlarged side perspective view of the downstream end portion of the new and improved apparatus or system as disclosed within FIG. 3 showing, in detail, the roller mechanism for applying the continuous protective cover onto the continuous temporary raised pavement marker (TRPM) extrusion; the stitching mechanism for fixedly securing the continuous protective cover onto the continuous temporary raised pavement marker (TRPM) extrusion; the second one of the servo-drive mechanisms for indexably feeding the continuous temporary raised pavement marker (TRPM) extrusion from the extruder toward the downstream end portion of the apparatus or system; the release sheet supply and support components for providing the continuous release sheet, having the plurality of adhesive patches predisposed thereon, onto which the plurality of temporary raised pavement markers (TRPMs) are to be deposited; the applicator and cutter mechanisms for serially applying end portions of the continuous temporary raised pavement marker (TRPM) extrusion onto the continuous release sheet, and for serially severing such end portions of the continuous temporary raised pavement marker (TRPM) extrusion as applied onto the continuous release sheet, such that a plurality of longitudinally spaced individual temporary raised pavement markers (TRPMs) are disposed upon the continuous release sheet; and the mechanism for forming the plurality of longitudinally spaced individual temporary raised pavement markers (TRPMs), and the continuous release sheet, into the collated array of temporary raised pavement markers (TRPMs) wherein the collated array of temporary raised pavement markers (TRPMs) are then also deposited into the temporary raised pavement marker (TRPM) dispensing container, magazine, or carton.

More particularly, as can best be appreciated from FIG. 1, and as best disclosed within FIGS. 8–10, a second set of application rollers 358,360,362 are rotatably mounted upon a support plate 364 which is disposed at a position, along the conveyor flow path 224, which is located downstream from the reflective strip or tape application rollers 302,304. As can best be appreciated from FIG. 9, the protective covering material application rollers 358, 360,362 are adapted to be adjustably mounted upon the support plate 364 as a result of suitable fasteners or pins, not shown, respectively passing through the rollers 358,360, 362 and being adjustably movable within vertically oriented slots 366,368,370 formed within the support plate 364. In this manner, the relative elevational disposition of each application roller 358,360, 362 upon and with respect to the support plate 364 can be appropriately determined. Accordingly, as can best be appreciated from FIG. 8, the incoming protective covering material 348 can be properly guided toward the temporary raised pavement marker (TRPM) extrusion 222 being conveyed in the downstream direction, and it is particularly noted that the last or third protective covering material application roller 362 is operatively engaged with the upper edge portion of the temporary raised pavement marker (TRPM) extrusion 222 so as to effectively form a nip therewith. The protective covering material 348 is therefore disposed within such nip so as to effectively be forced onto and applied over the upper edge portion of the temporary raised pavement marker (TRPM) extrusion 222 in order to protect the previously applied and adhered reflective strips or tapes 286,290.

As has been previously noted in connection with the reflective strip or tape application rollers 302, 304, and as can be clearly appreciated from FIGS. 8–10, a portion of the substantially inverted U-shaped vertical channel portion 236 of the guide track 220 is again effectively discontinued so as to in fact permit the protective covering material application rollers 358,360,362 to guide the protective covering material toward the temporary raised pavement marker (TRPM) extrusion 222, and in particular, to permit the third or downstream application roller 362 to form the aforenoted nip with the upper edge portion of the temporary raised pavement marker (TRPM) extrusion 222. It is noted still further that the presence of the substantially inverted U-shaped vertical channel portion 236 of the guide track 220 is again effectively continued at a location immediately downstream of the third or last application roller 362 in order to effectively cooperate with the upper edge portion of the temporary raised pavement marker (TRPM) extrusion 222. In this manner, the protective covering material 348 is effectively retained at its desired position upon the upper edge portion of the temporary raised pavement marker (TRPM) extrusion 222 whereby the same can truly cover the upper edge portion of the temporary raised pavement marker (TRPM) extrusion 222 so as to protect the reflective strips or tapes 286,290 disposed within the channels 272 thereof.

Subsequent to the aforenoted disposition of the protective covering material 348 upon the upper edge portion of the temporary raised pavement marker (TRPM) extrusion 222, it is desired to fixedly secure the protective covering material 348 upon the upper edge portion of the temporary raised pavement marker (TRPM) extrusion 222 by means of a suitable fastener or the like which may be similar to the fastener or staple 128 as disclosed within FIG. 2 in connection with the conventional PRIOR ART temporary raised pavement marker (TRPM) 110. Accordingly, as can be seen in FIGS. 3,8,10, and 11, a stitcher or stitching mechanism 372 is utilized. The stitcher or stitching mechanism 372 is seen to be disposed immediately downstream of the third or last protective covering material application roller 362, and it is further seen that a supply roll of stitching wire, disclosed at 374, is rotatably mounted upon the housing of the stitching mechanism 372 by means of a pair of laterally spaced mounting brackets 376,376. The front side of the stitching mechanism 372 is provided with an arcuately configured chute member 378, as best seen in FIG. 8, for guiding the fastening wire, as the same is unreeled from the supply roll of stitching wire 374, to the entrance 380 into the base of the stitching mechanism 372.

Figure 11:
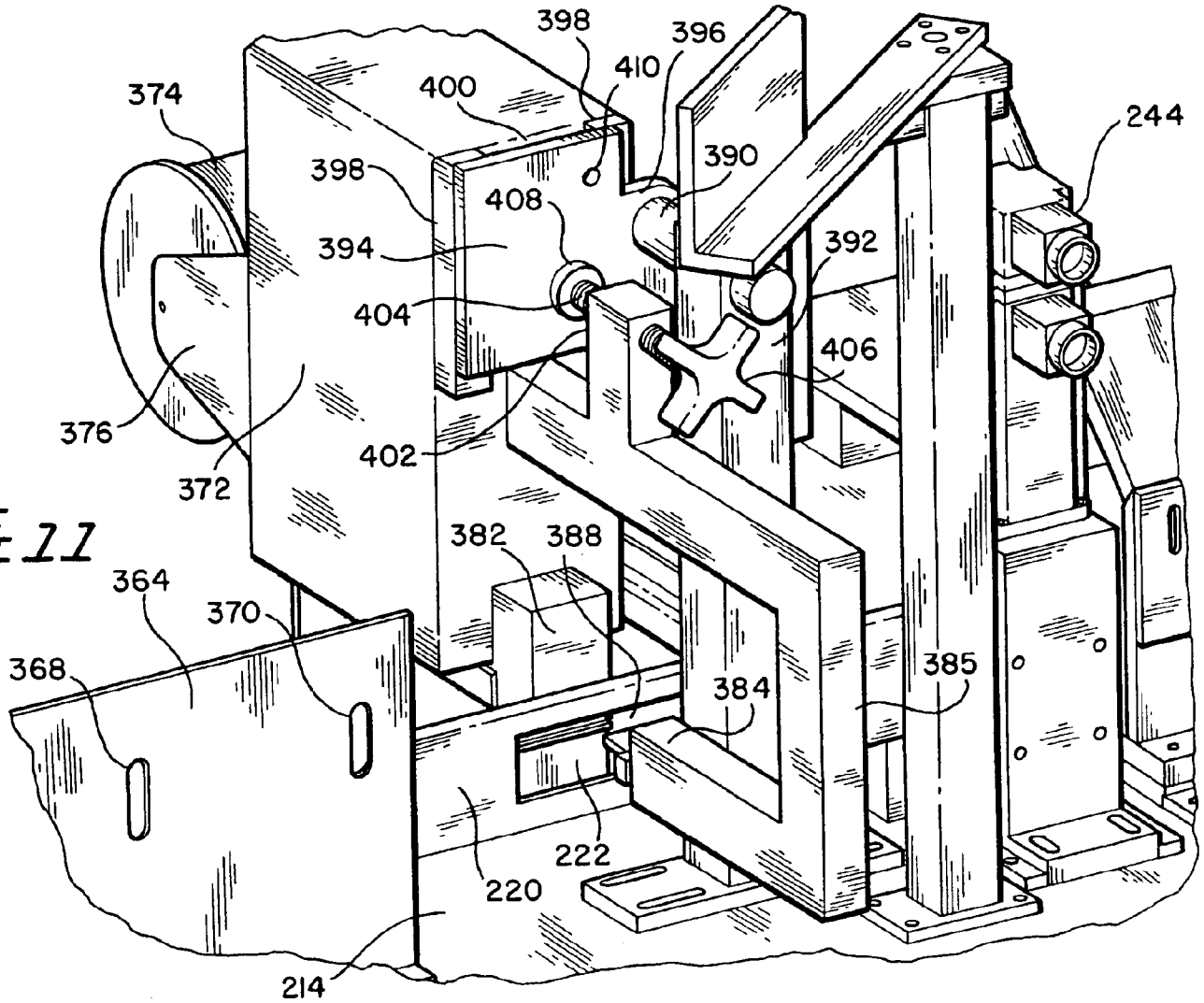
FIG. 11 is an enlarged, side perspective view corresponding to that of FIG. 10 in that the same discloses the details of the stitching mechanism, however, the stitching mechanism is viewed from the opposite side thereof.

As can best be seen from FIG. 11, a wire stitch former 382 is disposed upon a lower rear surface portion of the stitching mechanism 372, and it is to be appreciated that the stitch former 382 is disposed in front of the temporary raised pavement marker (TRPM) extrusion 222 and the guide track 220. An anvil mechanism 384, which is provided upon the lower end portion of a substantially C-shaped mounting bracket or arm 386 which is fixedly mounted in a cantilevered manner upon the rear surface of the stitching mechanism 372, is disposed rearwardly of the back side of the guide track 220. The anvil mechanism 384 is effectively aligned with the wire stitch former 382 in order to operatively cooperate therewith so as to form a stitch, which is similar to the staple or other fastener as disclosed within FIG. 2 in connection with the conventional PRIOR ART temporary raised pavement marker (TRPM) 110, and in this manner, the protective covering material 348 will be fixedly secured to the temporary raised pavement marker (TRPM) extrusion 222. It is noted that, along with the other operative components of the apparatus or system 210 of the present invention, the stitching mechanism 372 is operatively coupled to the programmable logic controller (PLC) 350 such that when the programmable logic controller (PLC) 350 cyclically energizes the stitching mechanism 372, in conjunction with the longitudinal conveyance of the temporary raised pavement marker (TRPM) extrusion 222 along the conveyor flow path 224, a plurality of wire stitches will be serially inserted into the temporary raised pavement marker (TRPM) extrusion 222 so as to fixedly secure the protective covering material 348 thereon. It is lastly noted that, in conjunction with the formation of the wire stitches as a result of the operative cooperation between the stitch former 382 and the anvil mechanism 384, the guide track 220 is provided with an aperture 388 whereby the stitch former 382 and the anvil mechanism 384 can in fact operatively cooperate with each other, upon opposite sides of the temporary raised pavement marker (TRPM) extrusion 222, so as to form and insert the wire stitches into the temporary raised pavement marker (TRPM) extrusion 222 so as to fixedly secure the protective covering material 348 thereon.

With reference continuing to be made to FIGS. 10 and 11, it is further noted, in connection with the disposition of the stitching mechanism 372 within the apparatus or system 210 of the present invention, that the stitching mechanism 372 is capable of being pivotally moved between a first lowered operative position as illustrated within FIGS. 10 and 11, and a second elevated non-operative position, not illustrated, at which, for example, maintenance operations may be performed upon the stitching mechanism 372, such as, for example, the removal of a depleted supply roll 374 of the stitching wire, and the installation of a new or fresh supply roll 374 of the stitching wire. More particularly, as can best be appreciated from FIG. 11, a shaft member 390 is mounted within an upstanding stanchion 392 in such a manner as to be rotatable, around its axis, with respect to the upstanding stanchion 392, but is incapable of undergoing axial movement with respect to the upstanding stanchion 392. A mounting plate 394 has an ear member 396 integrally attached to the shaft member 390 whereby the mounting plate 394 is fixed in position with respect to the upstanding stanchion as considered in the axial direction defined by means of the shaft member 390, and a pair of laterally spaced rubber bumper pads 398,398 are also fixedly mounted upon the rear surface of the stitching mechanism 372 so as to effectively define a framed space 400 therebetween. A secondary plate, not shown, is fixedly mounted upon the front surface, not visible, of the mounting plate 394 and is adapted to be disposed within the framed space 400 defined between the laterally spaced rubber bumper pads 398,398.

It is further seen that the substantially C-shaped mounting arm or bracket 386 has an upstanding post 402 integrally connected to the upper leg portion thereof, and that an externally threaded adjustment or positioning rod 404 is threadedly engaged within an internally threaded passageway defined within the upper end portion of the upstanding post 402. One end of the adjustment or positioning rod 404 is provided with a substantially X-shaped manipulation knob 406, and the opposite end of the adjustment or positioning rod 404 is provided with a bumper element 408 which is adapted to engage the axially fixed mounting plate 394 when, for example, the manipulation knob 406 is rotated in the clockwise direction as viewed in FIG. 11. Accordingly, in order to operatively mount the stitching mechanism 372 onto the upstanding stanchion 392, the stitching mechanism 372 is positioned as illustrated within FIG. 11 such that the secondary plate, not shown but fixedly mounted upon the front surface of the mounting plate 394, will be aligned with and preliminarily positioned within the framed space 400 defined between the laterally spaced rubber bumper pads 398,398. Subsequently, as the manipulation knob 406 is rotated in the clockwise direction as viewed in FIG. 11 such that the threaded positioning or adjustment rod 404 will threadedly advance relative to the upstanding post 402 of the substantially C-shaped mounting arm or bracket 386, the bumper element 408 will ultimately or eventually engage the rear surface of the mounting plate 394.

However, since the mounting plate 394 is axially fixed in position, as a result of the mounting plate 394 being integral with the shaft member 390, and as a result of the shaft member 390 being axially confined with respect to the upstanding stanchion 392, further clockwise rotation of the manipulation knob 406 and the threaded adjustment or positioning rod 404 will effectively cause the upstanding post of the substantially C-shaped mounting arm or bracket 386, and therefore the substantially C-shaped mounting arm or bracket 386 per se, as well as the stitching mechanism 372 fixedly attached thereto, to move rearwardly. As a result of such movement, the secondary plate, not shown but fixedly mounted upon the front surface of the mounting plate 394, will effectively be entrapped within the framed space 400 defined between the laterally spaced rubber bumper pads 398, 398, and the peripheral edge portions of the mounting plate 394 will effectively be compressively embedded within the laterally spaced rubber bumper pads 398,398, thereby fixedly securing the stitching mechanism 372 upon the mounting plate 394 and the upstanding stanchion 392.

It is therefore to be appreciated that the entire assembly, comprising the stitching mechanism 372 and the substantially C-shaped mounting arm or bracket 386, can be pivotally moved relative to the upstanding stanchion 392, as a result of the pivotal movement afforded by means of the shaft member 390, between the illustrated lowered operative position and a non-illustrated elevated non-operative position.

It is noted that the mounting plate 394 has an aperture 410 defined therein, and as illustrated within FIGS. 3 and 10, a similar aperture 412 is defined within a vertically oriented bracket 414 which is, in turn, fixedly secured upon a transversely oriented vertical support plate 416. The support plate 416 is fixedly secured upon an upstanding post 418 which projects upwardly from the support surface or table 214. Accordingly, when the entire stitching assembly is pivotally moved to its elevated, non-operative position, a suitable pin fastener, not shown, can be inserted through both apertures 410,412 so as to maintain the entire stitching assembly at its elevated, non-operative position. Removal of the pin fastener, not shown, from the aperture 410 defined within the mounting plate 394 of course permits the entire stitching assembly to be pivotally moved to the lowered operative position as illustrated within FIGS. 10 and 11. Accordingly, when the entire stitching assembly is located at its lowered operative position, the ear member 396 will engage the transversely oriented support plate 416 whereby the entire stitching assembly will be disposed in a stabilized position so as to be capable of performing its stitching function.

Having completed a cyclical stitching operation, wherein as a result of a plurality of such cyclical stitching operations having been performed, the protective covering material 248 is fixedly secured upon the temporary raised pavement marker (TRPM) extrusion 222 by means of a plurality of serially arranged, longitudinally spaced stitching fasteners similar to the fastener or staple 128 as disclosed within FIG. 2, the temporary raised pavement marker (TRPM) extrusion 222, having the protective covering material 248 fixedly secured thereon, is then indexably advanced by means of the first and second servo motor drives 240,244, under the control of the programmable logic controller (PLC) 350, so as to move the temporary raised pavement marker (TRPM) extrusion 222 in the downstream direction toward an operational station at which the temporary raised pavement marker (TRPM) extrusion 222 will be successively severed, in accordance with suitable cyclical operations, into a plurality of individual temporary raised pavement markers (TRPMs) similar to the temporary raised pavement marker (TRPM) 110 as disclosed within FIG. 2. Furthermore, the plurality of individual temporary raised pavement markers (TRPMs) will also be fixedly secured upon a common release sheet in preparation for the formation of the plurality of temporary raised pavement markers (TRPMs), as disposed upon the common release sheet, into the desired collated array of temporary raised pavement markers (TRPMs) as disclosed within U.S. patent application Ser. No. 10/302,994 which was filed on Nov. 25, 2002 and which is entitled COLLATED ROAD MARKER ASSEMBLY, AND SYSTEM AND METHOD FOR AUTOMATICALLY APPLYING COLLATED ROAD MARKERS TO ROADWAY SURFACES.

More particularly, then, as can be best appreciated from FIGS. 3,10, and 12, a supply roll of the continuous common release sheet or release paper is disclosed at 420 whereby the continuous common release sheet or release paper 422 is adapted to be unreeled from the supply roll 420 and conveyed along a support tray 424 by means of a conveying or withdrawal means, to be described shortly hereinafter, along a release paper conveying path PCP, the support tray 424 being supported upon a second support surface or table 425. The release sheet 422 is provided with a plurality of adhesive patches 426 which are disposed upon the release sheet 422 in a longitudinally extending serial array wherein each adhesive patch 426 is separated from each adjacent adhesive patch 426 by means of a predetermined distance, such as, for example, one and one-half inches (1.50"), one and five-eighths inches (1.625"), one and three-quarters inches (1.75"), or the like, depending upon the predetermined spacing desired to be defined between successive ones of the individual temporary raised pavement markers (TRPMs) 428, as adhesively attached to the release sheet 422, in accordance with the ultimate desired dispensing of the temporary raised pavement markers (TRPMs) 428 onto the roadway surface. It is noted that the width dimension of the release sheet or release paper 422 is greater than that of each adhesive patch 426, and that the release sheet or liner 422 is further provided with a top sheet, not shown and adapted to be removed just prior to the release sheet or liner 422 being operatively conveyed onto the support tray 424, for effectively covering the individual adhesive patches 426 such that the adhesive patches 426 do not stick to successive layers of the release sheet or liner 422 when the release sheet or liner 422 is disposed upon the supply roll 420.

It is additionally noted that the oppositely disposed edge portions of the support tray 424 are respectively provided with upstanding side walls 430,432 in order to effectively guide the release paper or release sheet 422 as the same is conveyed in the downstream direction from the supply roll 420 and along the release paper conveying path PCP over the support tray 424. Still further, it is to be remembered that the continuous, longitudinal temporary raised pavement marker (TRPM) extrusion 222 is being axially conveyed along the conveyor flow path 224, and it is therefore to be appreciated that the extrusion conveyor flow path 224 is oriented substantially perpendicular with respect to the release paper conveying path PCP. Still yet further, in order to permit the leading or downstream end portion of the temporary raised pavement marker (TRPM) extrusion 222 to be moved into position immediately above the release paper 422, with only a vertical clearance of, for example, 0.05 inches, therebetween, so as to ultimately be able to be deposited and adhered thereon by means of one of the adhesive patches 426, the upstanding side wall 432 is effectively discontinued as at 434. Concomitantly therewith, the upstanding side wall 430 also effectively serves as a stop member against which the leading end portion of the temporary raised pavement marker (TRPM) extrusion 222 is disposed so as to properly position the leading end portion of the temporary raised pavement marker (TRPM) extrusion 222 in preparation for the severance of the leading end portion of the temporary raised pavement marker (TRPM) extrusion 222, from the residual or remaining continuous temporary raised pavement marker (TRPM) extrusion 222, and the formation of an individual temporary raised pavement marker (TRPM) 428 to be deposited and adhered upon the release sheet 422.

Continuing further, and in order to in fact form the individual temporary raised pavement markers (TRPMs) 428, and to achieve the deposition and adherence of the same upon the single common release sheet 422, a cutting blade mechanism or assembly 436 is disposed downstream from the stitching mechanism 372, and is likewise disposed immediately upstream of the vertical plane within which the upstanding side wall 432 of the support tray 424 is disposed, so as to sever the leading end portion of the temporary raised pavement marker (TRPM) extrusion 222 from the remaining or residual continuous temporary raised pavement marker (TRPM) extrusion 222. In addition, an applicator mechanism or assembly 438 is positioned directly above the support tray 424 so as to be capable of acting upon the leading end portion of the temporary raised pavement marker (TRPM) extrusion 222 in order to deposit and adhere the leading end portion of the temporary raised pavement marker (TRPM) extrusion 222 onto one of the adhesive patches 426 disposed upon the single common release sheet 422. More particularly, as can best be seen in FIGS. 10 and 12, the cutting blade mechanism or assembly 436 is seen to comprise a cutting blade element 440 which is bolted, as at 442, to a lower end portion of a piston rod 444 of an air cylinder mechanism 446 so as to be movable within a vertical plane. The air cylinder mechanism 446 is fixedly mounted upon a support platform 448, and it is seen that a pair of cutter blade guide members 450,450 are fixedly mounted upon the side of the support platform 448 so as to effectively guide the cutting blade element 440 during its upward and downward movements attendant its cutting operations. Operatively associated with the cutting blade element 440 and the piston rod 444, the cutting blade mechanism or assembly 436 further comprises a hold-down implement 452.

The applicator mechanism or assembly 438 is seen to comprise a pneumatic or air cylinder housing or mechanism 454 within which there is movably guided a pair of piston rods 456,456, and upon the lower free end portions of the piston rods 456,456, there is fixedly mounted an applicator piston 458. The air-cylinder housing 454 is fixedly mounted upon a support bracket 460, and it is seen that the support bracket 460 is, in turn, fixedly mounted upon a support plate 462. As has been noted hereinbefore in connection with all of the motorized or actuated components of the apparatus or system 210 of the present invention, the air cylinder mechanisms 446,454 are adapted to be controlled in accordance with timely modes of operation by means of the programmable logic controller (PLC) 350. Therefore, in accordance with such modes of operation, after the temporary raised pavement marker (TRPM) extrusion 222 has been indexably advanced by means of the servo drive motors 240,244 such that the leading end portion of the temporary raised pavement marker (TRPM) extrusion 222 has been abutted up against the upstanding side wall 430 of the release paper support tray 424, the air cylinder mechanism 454 will be activated so as to move the applicator piston 458 downwardly into contact with the leading end portion of the temporary raised pavement marker (TRPM) extrusion 222 whereby the leading end portion of the temporary raised pavement marker (TRPM) extrusion 222 will be forced into contact with that one of the plurality of adhesive patches 426, disposed upon the release sheet 422, which has been indexably moved beneath the applicator piston 458 such that the leading end portion of the temporary raised pavement marker (TRPM) extrusion 222 will be adhesively bonded to that particular adhesive patch 426.

At substantially the same time, or immediately thereafter, the air cylinder mechanism 446 is activated in accordance with a two-stage movement or actuation mode whereby in accordance with the first-stage movement or actuation of the air cylinder mechanism 446, the hold-down implement 452 is moved into contact with that portion of the temporary raised pavement marker (TRPM) extrusion 222 which is disposed immediately upstream of the release paper support tray 424, while in accordance with the second-stage movement or actuation of the air cylinder mechanism 446, the cutting blade element 440 is moved downwardly against, for example, the force of a spring-biasing mechanism, not shown. In view of the fact that the temporary raised pavement marker (TRPM) extrusion 222 is respectively securely held or retained upon both the release sheet support tray 424, as well as upon the guide track 220, by means of the applicator piston 458 and the hold-down implement 452, the cutting blade element 440 is able to operatively cooperate with the side edge portion of the release sheet support tray 424 and thereby sever the leading end portion of the temporary raised pavement marker (TRPM) extrusion 222 from the remaining or residual portion of the temporary raised pavement marker (TRPM) extrusion 222 so as to form one of the individual temporary raised pavement markers (TRPMs) 428. Upon retraction of the air cylinder mechanisms 446,454, the release sheet or paper 422, having one or more of the temporary raised pavement markers (TRPMs)

428 disposed thereon, and the temporary raised pavement marker (TRPM) extrusion 222 are able to be respectively advanced whereby the foregoing operation for forming the individual temporary raised pavement markers (TRPMs) 428 is able to again be cyclically achieved.

Figure 15:
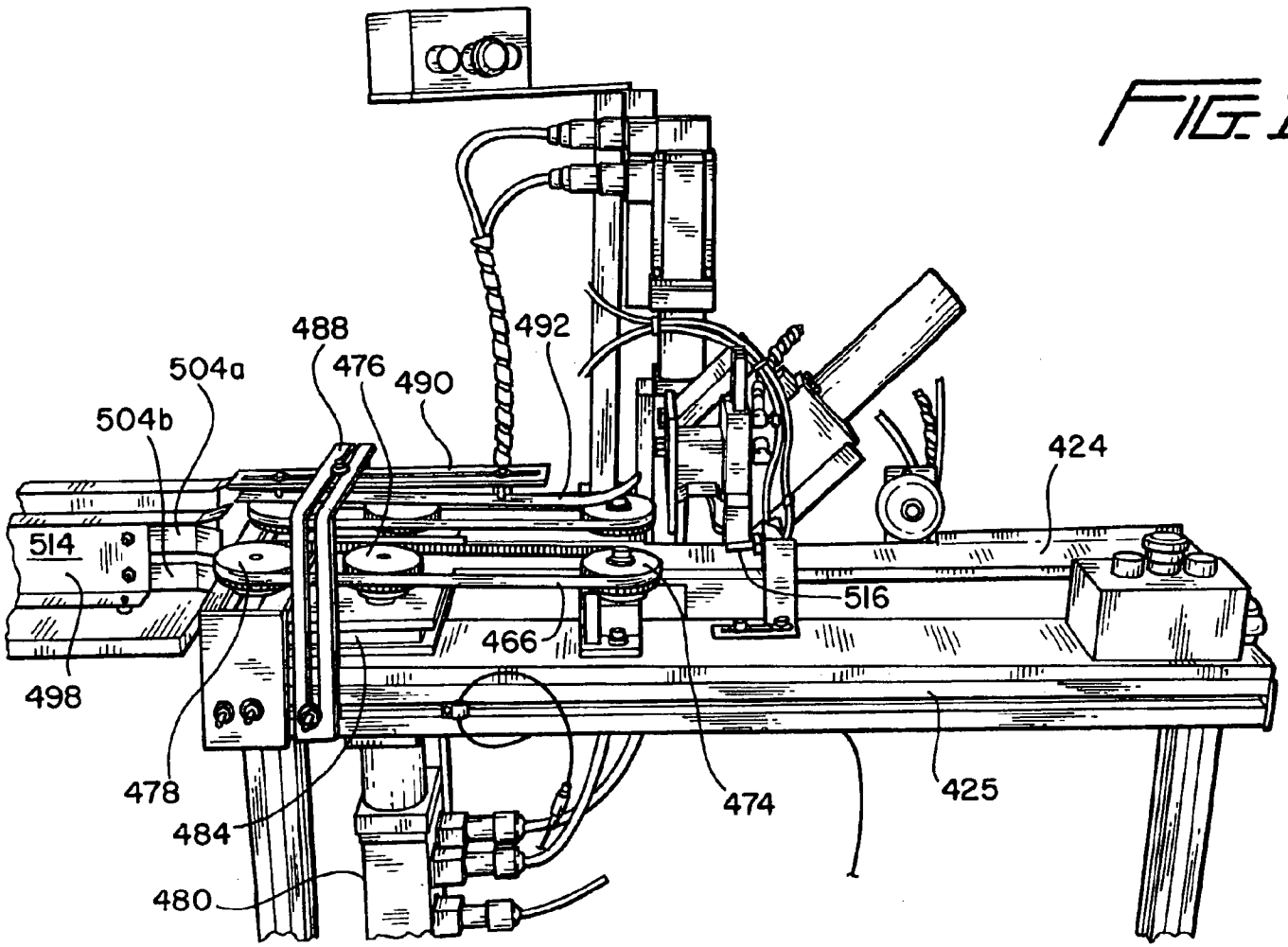
FIG. 15 is an enlarged side perspective view, corresponding to FIGS. 13 and 14, illustrating the conveyor mechanism and the collating mechanism, wherein the collating mechanism is also characterized by an adjustable height dimension.
Figure 16:
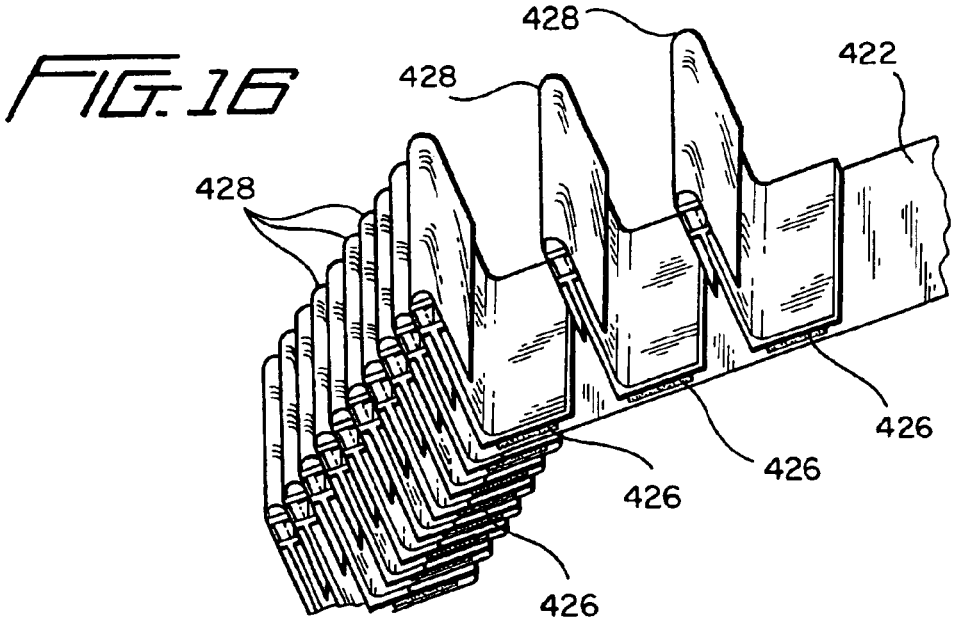
FIG. 16 is a perspective view of a plurality of temporary raised pavement markers (TRPMs) showing the same being arranged within their nested or collated state or array in accordance with the unique and novel teachings and principles of the present invention.

Having formed the individual temporary raised pavement markers (TRPMs) 428 and serially disposed the same upon the single, continuous, common release sheet 422, the assembly, comprising the individual temporary raised pavement markers (TRPMs) 428 and the single, continuous, common release sheet 422, must now be conveyed in the downstream direction along the release paper conveyance path PCP so as to ultimately be formed into the collated array of temporary raised pavement markers (TRPMs) as shown within FIG. 16. More particularly, as can best be appreciated from FIGS. 3 and 12–15, a pair of timing belts 464,466, disposed upon opposite sides of the paper conveying path PCP, are respectively operatively engaged with two sets of rotatable timing wheels 468,470,472, and 474,476, 478 so as to effectively be driven thereby. More specifically, a pair of servo motors 480, only ore of which is visible in FIGS. 12 and 15, are respectively operatively connected to the central ones of the timing wheels 470,476 such that the timing wheels 470, 476 are driving wheels, while in turn, the central ones of the timing wheels 470,476 are operatively connected to the downstream timing wheels 472,478 through means of suitable gearing and pulley belts, not shown, respectively disposed within transmission housings 482,484, such that timing wheels 472, 478 are driven wheels, timing wheels 468,474 comprising idler wheels.

Figure 12:
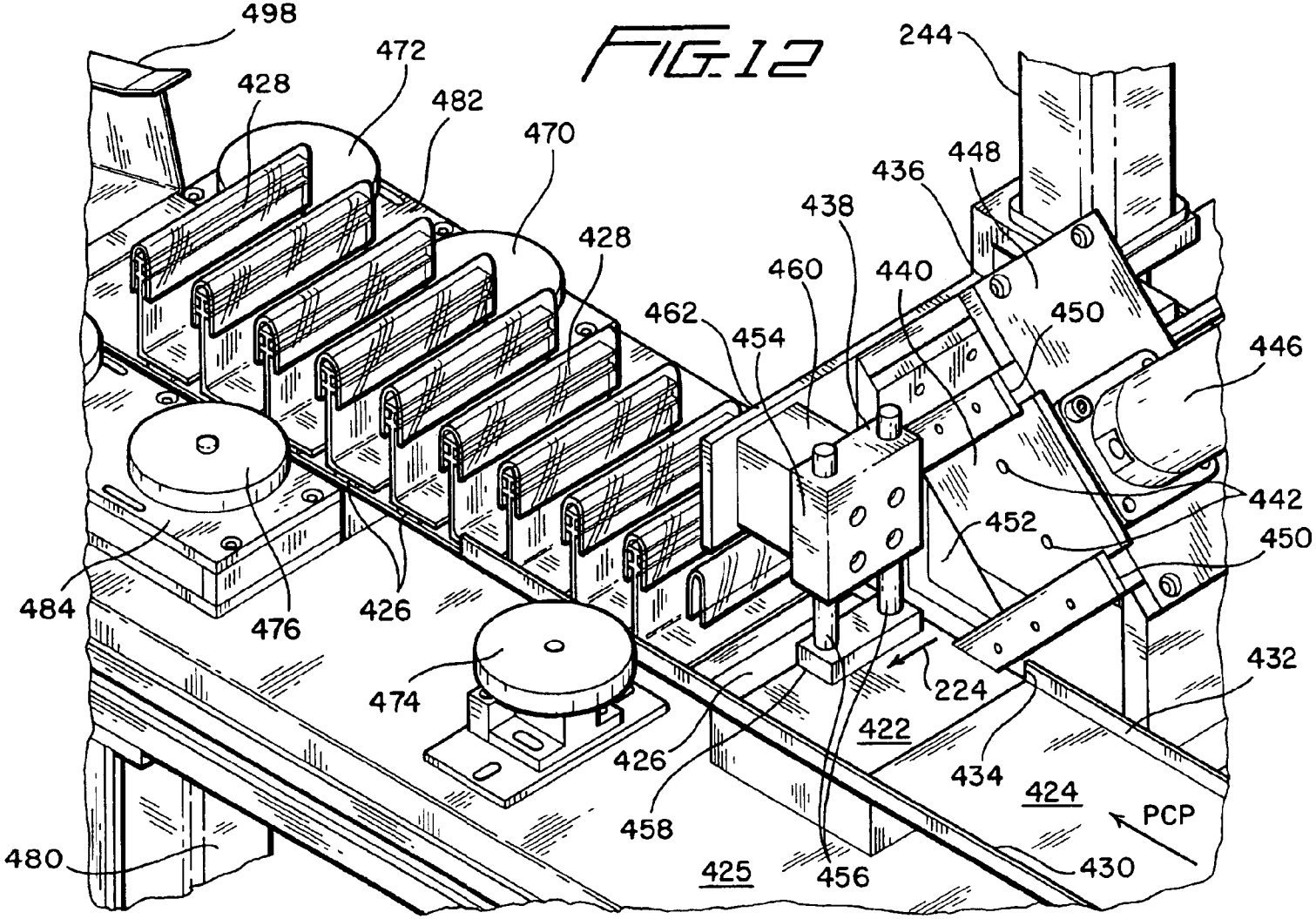
FIG. 12 is an enlarged side perspective view of the downstream end portion of the new and improved apparatus or system as disclosed within FIG. 3 showing, in detail, the release sheet having the plurality of adhesive patches predisposed thereon, onto which the plurality of temporary raised pavement markers (TRPMs) are to be deposited; the applicator and cutter mechanisms for serially applying end portions of the continuous temporary raised pavement marker (TRPM) extrusion onto the continuous release sheet, and for serially severing such end portions of the continuous temporary raised pavement marker (TRPM) extrusion as applied onto the continuous release sheet, such that a plurality of longitudinally spaced individual temporary raised pavement markers (TRPMs) are disposed upon the continuous release sheet; and the conveyor mechanism for conveying the plurality of longitudinally spaced individual temporary raised pavement markers (TRPMs), disposed upon the continuous release sheet, toward the mechanism for forming the plurality of longitudinally spaced individual temporary raised pavement markers (TRPMs), and the continuous release sheet, into the collated array of temporary raised pavement markers (TRPMs)
Figure 13:
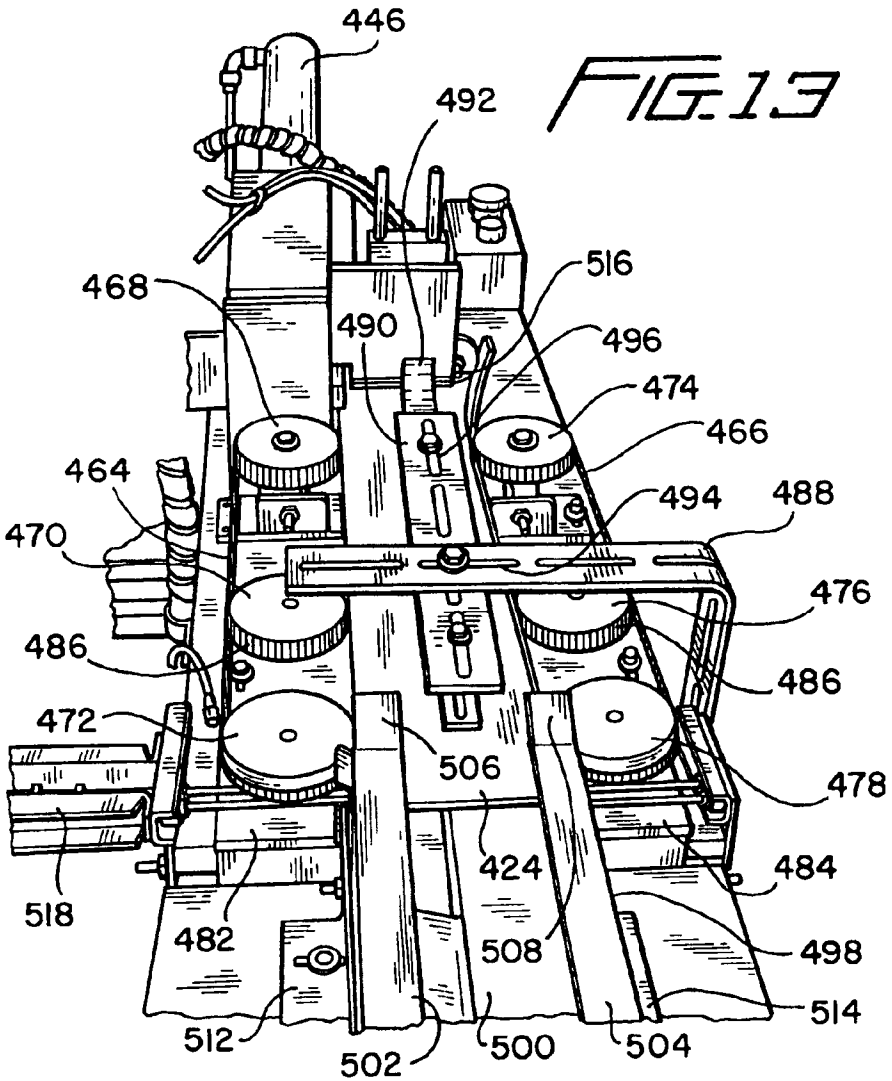
FIG. 13 is an enlarged end perspective view of the conveyor mechanism, partially disclosed within FIG. 12, for conveying the plurality of longitudinally spaced individual temporary raised pavement markers (TRPMs), disposed upon the continuous release sheet, toward the collating mechanism for forming the plurality of longitudinally spaced individual temporary raised pavement markers (TRPMs), and the continuous release sheet upon which the plurality of temporary raised pavement markers (TRPMs) are disposed, into the collating mechanism for forming the collated array of temporary raised pavement markers (TRPMs), wherein the collating mechanism has an adjustable width dimension.
Figure 14:
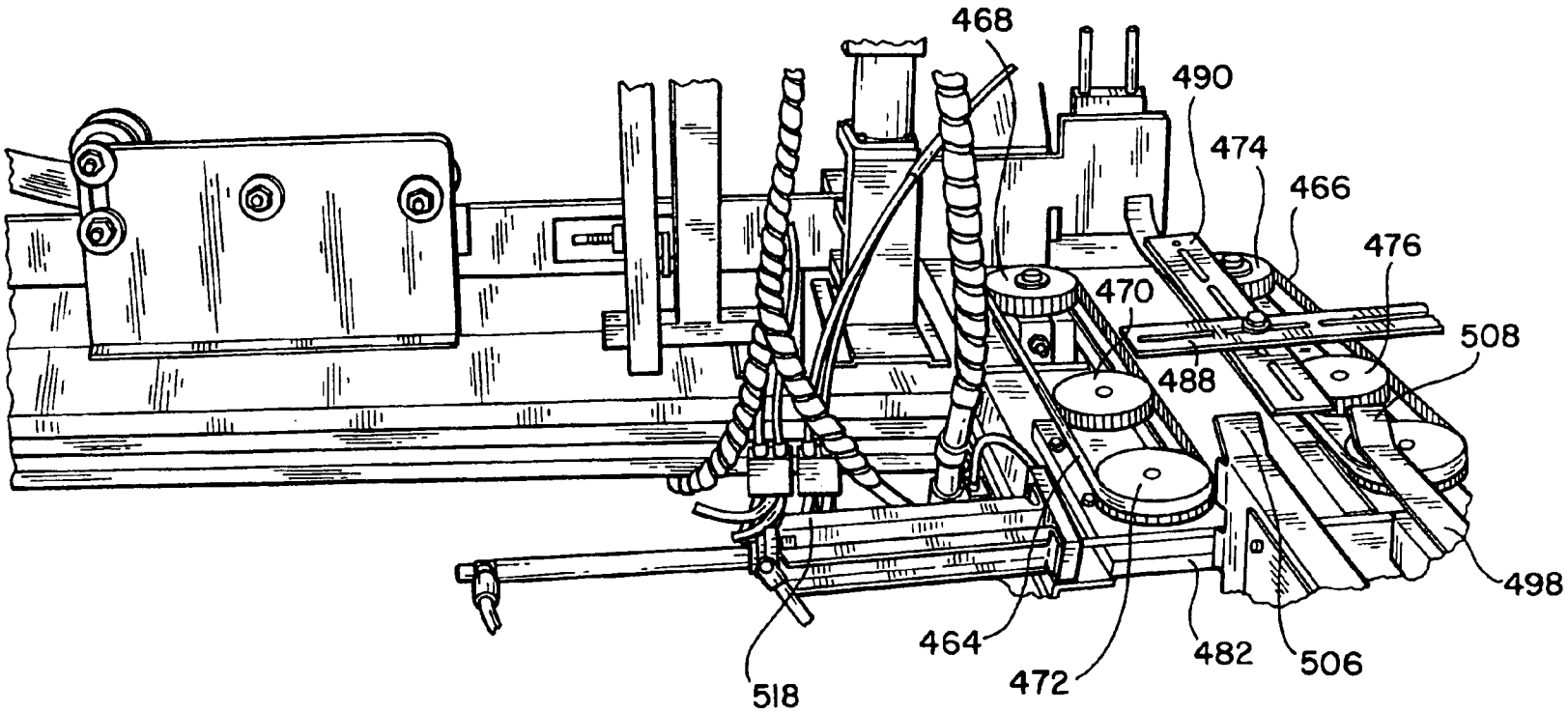
FIG. 14 is an enlarged end perspective view, similar to that of FIG. 13, additionally showing, however, a cutter mechanism for severing the continuous release sheet, having the plurality of longitudinally spaced individual temporary raised pavement markers (TRPMs) disposed thereon, at a predetermined time such that a predetermined number of collated temporary raised pavement markers (TRPMs) can be accommodated within the container, carton, or magazine for containing the temporary raised pavement markers (TRPMs) to be applied onto the roadway surface.

As can best be seen from FIG. 13, the outer periphery of each timing wheel 468–478 is provided with a plurality of timing teeth 486, and it is appreciated that the inner surfaces of each timing belt 464,466 are similarly provided with corresponding timing teeth whereby the timing belts 464, 466 can in fact be operatively engaged with and driven by the timing wheels 468–478. In a similar manner, it can be appreciated from FIGS. 12 and 13 that the outer surfaces of each timing belt 464,466 are likewise provided with timing teeth whereby the inner loop portions of the timing belts 464,466 can effectively engage the opposite sides of the vertically oriented leg sections of the individual temporary raised pavement markers (TRPMs) 428 so as to convey the assembly, comprising the individual temporary raised pavement markers (TRPMs) 428 and the single, continuous, common release sheet 422, along the support tray 424. It is of course noted that the servo motors 480 are activated and controlled by means of the programmable logic controller (PLC) in an indexably timed manner whereby, for example, the assembly, comprising the individual temporary raised pavement markers (TRPMs) 428 and the single, continuous, common release sheet 422, is moved along the support tray 424, in a step-wise manner, a distance which is equivalent to the spacing defined between successive ones of the individual temporary raised pavement markers (TRPMs) 428, as disposed upon the single, continuous, common release sheet 422, in order to in fact correspond with the formation of the individual temporary raised pavement markers (TRPMs) 428 upon the single, continuous, common release sheet 422 as has been previously described. Still yet further, it is noted that in conjunction with the indexable movement of the assembly, comprising the individual temporary raised pavement markers (TRPMs) 428 and the single, continuous, common release sheet 422, along the support tray 424, a suitable braking mechanism, not shown, may be utilized in conjunction with the release sheet or release paper supply roll 420 such that a predetermined amount of slack is maintained within the release sheet 422 as the same is conveyed along the support surface 424.

Continuing further, in order to actually cause the plurality of individual temporary raised pavement markers (TRPMs) 428, as disposed upon the single, continuous, common release sheet 422, as disclosed within FIG. 12, into the collated assemblage as disclosed within FIG. 16, it is further seen that a substantially inverted L-shaped bracket 488 is fixedly mounted upon the second support surface or table 425 so as to extend transversely across the paper conveyance path PCP, and in turn, another bracket 490 is fixedly connected to and support by the L-shaped bracket 488. Still further, a deflector plate 492, having a substantially ski-shaped configuration, is suspendingly supported from the bracket 490, and it is noted that both of the brackets 488, 490 are respectively provided with slotted adjustment means 494,496 whereby, ultimately, the disposition of the deflector plate 492 can be positionally adjusted with respect to the paper conveyance path PCP. Accordingly, as the plurality of temporary raised pavement markers (TRPMs) 428 are conveyed downstream, the upturned upstream end portion of the ski-shaped deflector plate 492 will successively encounter the upper end portion of each temporary raised pavement marker (TRPM) 428 so as to initially cause a tilting of each temporary raised pavement marker (TRPM) 428 whereby the conveyance of the plurality of temporary raised pavement markers (TRPMs) 428 will be permitted to continue as a result of the upper end portion of each temporary raised pavement marker (TRPM) 428 now being disposed beneath the longitudinally extending planar section of the deflector plate 492.

The downstream conveyance of each one of the plurality of temporary raised pavement markers (TRPMs) 428 is continued until each one of the plurality of temporary raised pavement markers (TRPMs) 428 reaches the downstream end of the support tray 424 at which position there is located a collating mechanism 498 which effectively comprises an open-ended container into which the plurality of temporary raised pavement markers (TRPMs) 428 are conveyed. As can best be appreciated from FIGS. 13 and 15, the bottom surface or floor 500 of the container 498 is disposed at an elevational level which is beneath that of the support tray 424. In addition, it is seen that the upstream end of each side wall 502,504 of the collating container 498 is also provided with an upturned deflector portion 506,508, and in this manner, as each one of the temporary raised pavement markers (TRPMs) 428 encounters the deflector portions 506,508, the temporary raised pavement markers (TRPMs) 428 are tilted still further so as to be guided into the collating container 498. As a result of such tilting of the temporary raised pavement markers (TRPMs) 428, and in view of the fact that the floor 500 of the collating container 498 is disposed beneath the level of the support tray 424, each one of the temporary raised pavement markers (TRPMs) 428 will drop down onto the floor portion 500 of the collating container, and a successive upstream one of the temporary raised pavement markers (TRPMs) 428 will be disposed atop the preceding or downstream one of the temporary raised pavement markers (TRPMs) 428 so as to achieve the collated and nested array of the temporary raised pavement markers (TRPMs) 428 as disclosed within FIG. 16, and as more fully discussed within the aforenoted U.S. patent application Ser. No. 10/302,994 which was filed on Nov. 25, 2002 and which is entitled COLLATED ROAD MARKER ASSEMBLY, AND SYSTEM AND METHOD FOR AUTOMATICALLY APPLYING COLLATED ROAD MARKERS TO ROADWAY SURFACES.

With reference again being made briefly to FIG. 8, it can be seen that once a predetermined number of the temporary raised pavement markers (TRPMs) 428 have been conveyed toward the collating container 498 for deposition therein so as to form the collated and nested array of the temporary raised pavement markers (TRPMs) 428 as disclosed within FIG. 16, the collated and nested array of the temporary raised pavement markers (TRPMs) 428 can then be manually transferred from the collating container 498 into a suitable container or carton 510 which will serve as a supply magazine for providing the collated and nested array of the temporary raised pavement markers (TRPMs) 428 to the dispensing apparatus as disclosed within the aforenoted U.S. patent application Ser. No. 10/302,994 which was filed on Nov. 25, 2002 and which is entitled COLLATED ROAD MARKER ASSEMBLY, AND SYSTEM AND METHOD FOR AUTOMATICALLY APPLYING COLLATED ROAD MARKERS TO ROADWAY SURFACES. It is further noted that in order to properly process different sized temporary raised pavement markers (TRPMs) 428 for disposition within correspondingly sized magazine containers or cartons 510, the collating container 498 is longitudinally split into halves such that the side walls 502,504 of the collating container 498 are respectively mounted upon substantially L-shaped, adjustable brackets 512,514 so as to adjustably alter the width dimensions of the collating container 498 as best seen in FIG. 13, and in a similar manner, each side wall 502,504 is split into vertical halves, as disclosed at 504*a*, 504*b* in FIG. 15, which are also adjustably mounted upon the brackets 512,514.

It is lastly noted that in order to actually predetermine the number of temporary raised pavement markers (TRPMs) 428 that are to be ultimately disposed within the magazine container or carton 510, a suitable optical sensor 516, as can best be seen in FIGS. 13 and 15, is provided at the intersection of the extrusion conveyor flow path 224 and the release paper conveyance path PCP. The sensor 516 detects the temporary raised pavement markers (TRPMs) 428 as they are effectively formed and deposited upon the release sheet 422, counts the same, and transmits such count to the programmable logic controller (PLC) 350. The programmable logic controller (PLC) 350, in turn, controls the activation of a cutting blade implement, not shown, which is mounted upon the piston of a double-acting piston-cylinder assembly 518 which is disposed at the downstream end of the support tray 424, and which is disposed transversely with respect thereto and the paper conveyance path PCP.

Accordingly, when the predetermined number of temporary raised pavement markers (TRPMs) 428, as disposed upon the common release sheet 422, have been detected by means of the sensor/counter 516, the programmable logic controller (PLC) 350 will activate the piston-cylinder assembly 518 so as to sever the assembly, comprising the release sheet 422 and the plurality of temporary raised pavement markers (TRPMs) 428 disposed thereon, at a predetermined location such that the predetermined number of temporary raised pavement markers (TRPMs) 428 are delivered into the collating container 498 and ultimately into the magazine container 510. In connection with the feeding or conveyance of the collated assembly, comprising the plurality of temporary raised pavement markers (TRPMs) 428 as disposed upon the release sheet 422, it is to be remembered that in view of the fact that the width dimension of the release sheet 422 is greater than that of the individual adhesive patches 426 disposed thereon, the presence of such adhesive patches 426 does not in any way hinder the conveyance or feeding of the collated assembly, comprising the plurality of temporary raised pavement markers (TRPMs) 428 and the release sheet 422, either within the collating container 498 or within the magazine container 510.

Figure 17:
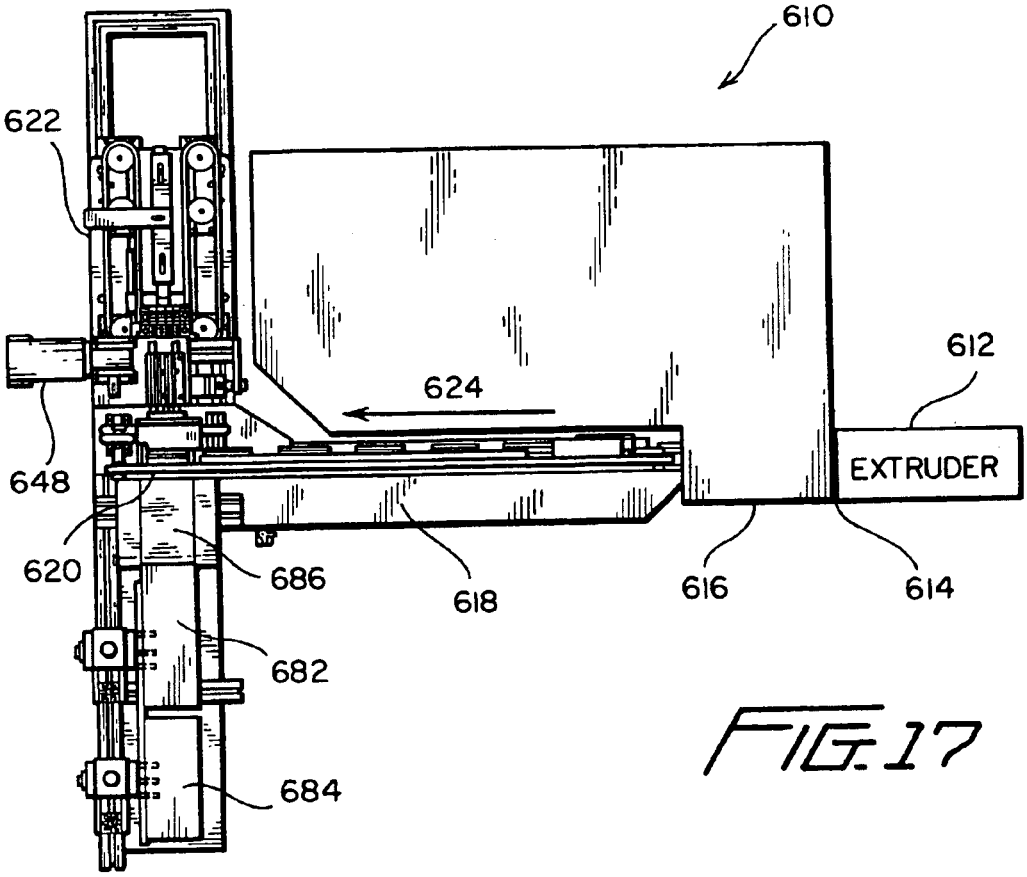
FIG. 17 is a top plan view of a second embodiment of a new and improved apparatus or system, for manufacturing a collated array of temporary raised pavement markers (TRPMs), constructed in accordance with the principles and teachings of the present invention and showing the cooperative parts thereof, including means for conveying a plurality of predeterminedly spaced temporary raised pavement markers (TRPMs) in a downstream direction toward an application station at which the plurality of temporary raised pavement markers (TRPMs) are mounted upon a single continuous common release sheet, and means for forming the plurality of individual temporary raised pavement markers (TRPMs), serially disposed upon the continuous common release sheet, into a collated array of temporary raised pavement markers (TRPMs) for deposition within a container, carton, or magazine to serve as a supply of temporary raised pavement markers (TRPMs) for apparatus for serially applying the temporary raised pavement markers (TRPMs) onto a roadway surface.

Referring again to the drawings, and more particularly to FIG. 17 thereof, a second embodiment of a new and improved apparatus or system constructed in accordance with the principles and teachings of the present invention for manufacturing a collated array of temporary raised pavement markers (TRPMs), and showing the cooperative parts thereof, is disclosed and is generally indicated by the reference character 610. It is to be noted that this second embodiment of the new and improved apparatus or system 610 of the present invention is to be differentiated from the first embodiment of the new and improved apparatus or system 210 of the present invention in that while the first embodiment apparatus or system 210 manufactured or fabricated the plurality of temporary raised pavement markers (TRPMs) 428 from a continuous, single, temporary raised pavement marker (TRPM) extrusion 222, subsequently deposited and adhered the individual temporary raised pavement markers (TRPMs) 428 onto the continuous, single, common release sheet 422, and still further formed the assembly, comprising the plurality of temporary raised pavement markers (TRPMs) 428 and the single common release sheet 422 into the collated, nested array of temporary raised pavement markers (TRPMs) 428, to the contrary, the second embodiment apparatus or system 610 deposits and adheres temporary raised pavement markers (TRPMs), previously manufactured by conventional fabrication techniques, onto a single, common release sheet, and subsequently forms the assembly, comprising the plurality of temporary raised pavement markers (TRPMs) as disposed upon the single common release sheet, into the collated, nested array of temporary raised pavement markers (TRPMs).

More particularly, as can be generally appreciated from FIG. 17, and as will be further appreciated from FIGS. 18–30, the second embodiment of the new and improved apparatus or system 610 of the present invention is seen to comprise apparatus for mounting individual, pre-existing or pre-formed temporary raised pavement markers (TRPMs) onto a common release sheet or release liner, and for subsequently collating the same in a manner similar to that previously disclosed in connection with the first embodiment of the new and improved apparatus or system 210 as has been disclosed within FIGS. 12–16. As disclosed within FIG. 17, a conventional or existing extruder mechanism 612 forms a temporary raised pavement marker (TRPM) extrusion which also has a pair of reflective strips disposed upon the opposite sides thereof, a protective covering disposed over the pair of reflective strips so as to protect the same prior to the use of the temporary raised pavement markers (TRPMs), and an adhesive strip applied to the undersurface portion thereof. A cutter mechanism 614 is operatively disposed at the downstream end of the extruder mechanism 612 so as to continuously cut the temporary raised pavement marker (TRPM) extrusion into a plurality of serially conveyed individual temporary raised pavement markers (TRPMs), all of which are similar to the conventional temporary raised pavement marker (TRPM) 110 as disclosed within FIG. 2 except for the fact that none of the plurality of individual temporary raised pavement markers (TRPMs) have individual release sheets or release liners applied to the undersurface portions of their adhesive strips.

After the temporary raised pavement marker (TRPM) extrusion has been cut into the plurality of serially conveyed individual temporary raised pavement markers (TRPMs) by means of the cutter mechanism 614, the individual temporary raised pavement markers (TRPMs) are conveyed through a conventional temporary raised pavement marker (TRPM) discharge tunnel 616 so as to effectively be grasped, and conveyed further in the downstream direction, by means of a conveyor mechanism 618, constructed in accordance with the principles and teachings of the present invention, toward a station 620 at which the individual temporary raised pavement markers (TRPMs) can be operationally mated with, and deposited and adhered upon, a single, continuous, common release sheet or liner. Subsequently, the assembly, comprising the plurality of temporary raised pavement markers (TRPMs) as adhered upon the single common release sheet or liner, is conveyed by means of a conveyor mechanism 622, similar to that disclosed within FIGS. 12–15, toward a collating mechanism, not shown but similar to the collating mechanism also disclosed within FIGS. 12–15, whereby the collated array of temporary raised pavement markers (TRPMs) is able to likewise be deposited within a suitable container or magazine, similar to the container or magazine 510 as disclosed within FIG. 8, for use in connection with the dispensing apparatus as disclosed within the aforenoted U.S. patent application Ser. No. 10/302,994 which was filed on Nov. 25, 2002 and which is entitled COLLATED ROAD MARKER ASSEMBLY, AND SYSTEM AND METHOD FOR AUTOMATICALLY APPLYING COLLATED ROAD MARKERS TO ROADWAY SURFACES.

With reference therefore now being made to FIGS. 18–21, 25, and 26, the conveyor mechanism 618, constructed in accordance with the principles and teachings of the present invention, and by means of which the plurality of individual temporary raised pavement markers (TRPMs) are conveyed toward the station 620 at which the individual temporary raised pavement markers (TRPMs) are operationally mated with, and deposited and adhered upon, the single, continuous, common release sheet or liner, will be described. More particularly, as can best be appreciated from FIGS. 18 and 19, the plurality of individual temporary raised pavement markers (TRPMs) are transported through, and discharged from, the conventional temporary raised pavement marker (TRPM) discharge tunnel 616 so as to be grasped, and conveyed in the downstream direction 624, by the conveyor mechanism 618. As can best be seen from FIG. 19, the conventional temporary raised pavement marker (TRPM) discharge tunnel 616 comprises a through-passage 626 which has a substantially L-shaped cross-sectional configuration with the long-legged section 628 of the passage 626 being disposed horizontally while the short-legged section 630 of the passage being disposed vertically. In this manner, the individual temporary raised pavement markers (TRPMs) are transported through the passage 626 with their normally vertically oriented long leg portions disposed horizontally and their normally horizontally oriented short leg portions disposed vertically.

Figure 18:
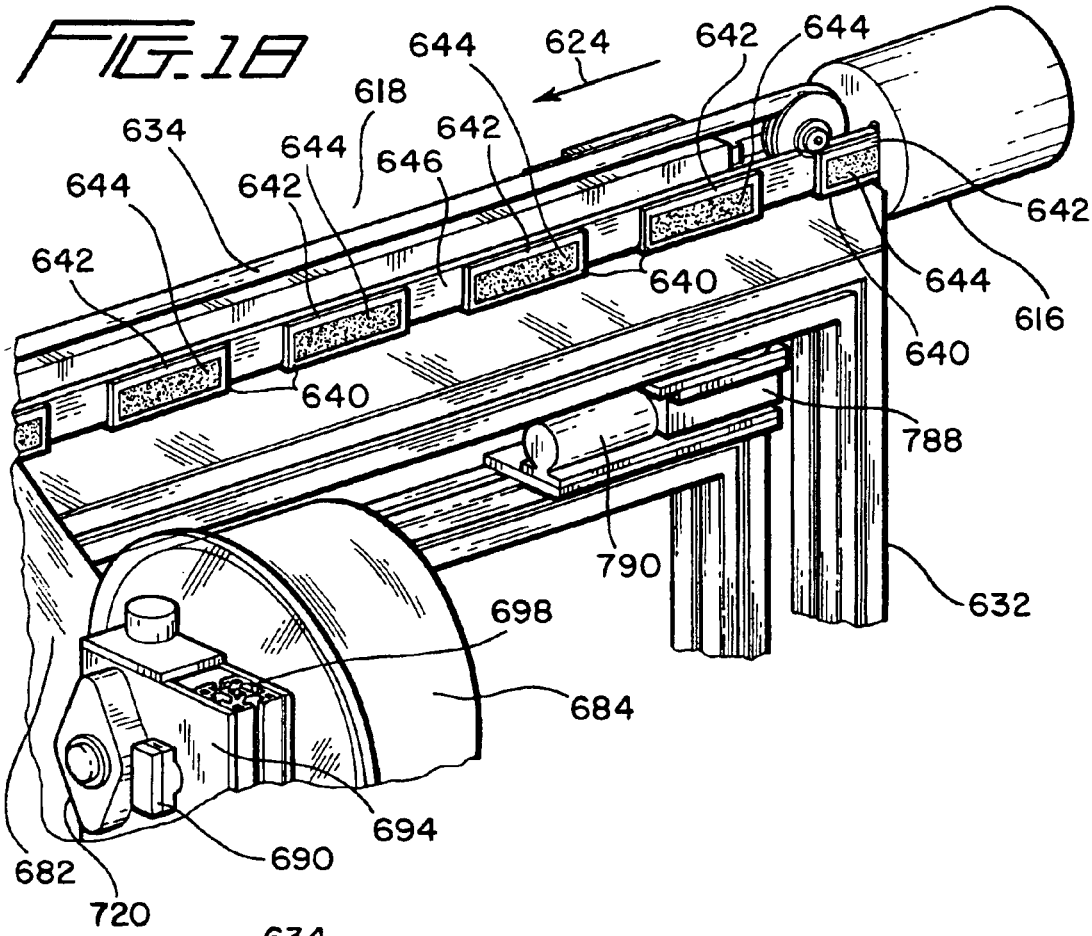
FIG. 18 is a side perspective view showing the upstream end of the conveyor mechanism, for conveying the plurality of temporary raised pavement markers (TRPMs), as disposed immediately downstream from the extruder discharge tunnel, wherein the conveyor mechanism is mounted upon a slide mechanism for adjusting the disposition of the conveyor mechanism with respect to the extruder discharge tunnel.
Figure 19:
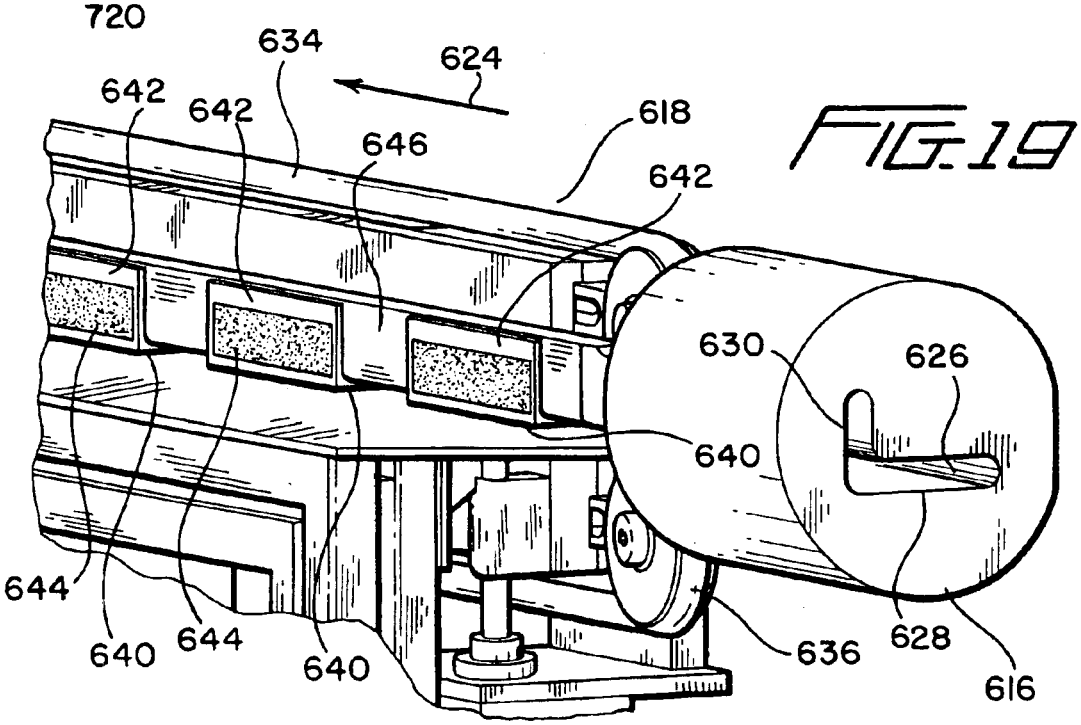
FIG. 19 is an end perspective view showing the upstream end of the conveyor mechanism, for conveying the plurality of temporary raised pavement markers (TRPMs), as disposed immediately downstream from the extruder discharge tunnel, wherein the conveyor mechanism comprises a pair of vertically arranged closed-loop conveyor belts for conveying the plurality of temporary raised pavement markers (TRPMs) as a result of the normally vertically oriented leg members of the temporary raised pavement markers (TRPMs) being trapped between the lower run of the upper conveyor belt and the upper run of the lower conveyor belt.
Figure 21:
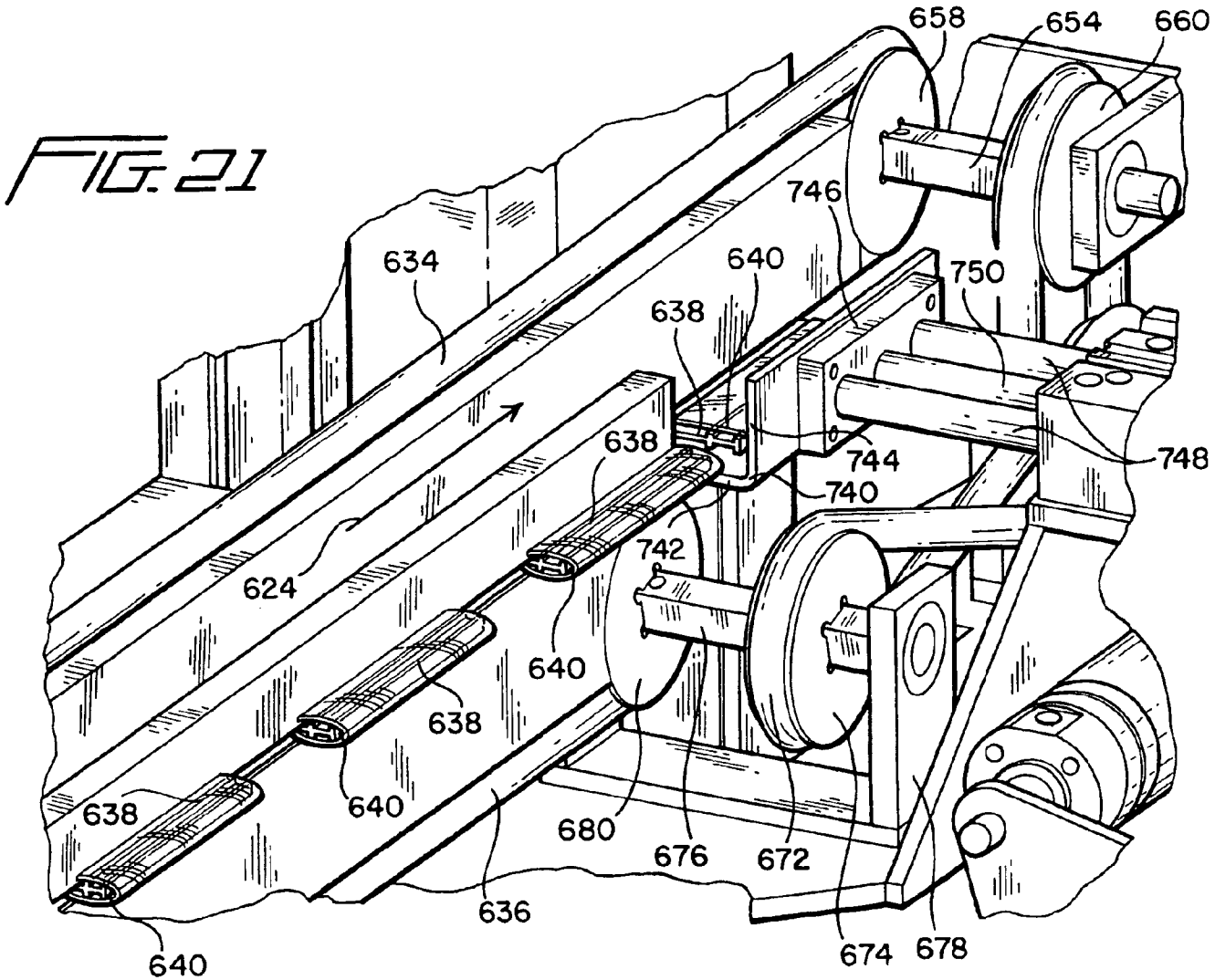
FIG. 21 is a perspective view of the downstream end of the conveyor mechanism, similar to that of FIG. 22, showing, however, in particular, the disposition of one of the temporary raised pavement markers (TRPMs) upon the support plate, as disclosed within FIG. 22, in preparation for the application of such temporary raised pavement marker (TRPM) onto the continuous common release sheet.

As can be additionally appreciated from FIG. 18, the conveyor mechanism 618 is mounted upon a fixed framework 632 and is disposed immediately downstream from the discharge tunnel 616 so as to be capable of immediately receiving the plurality of individual temporary raised pavement markers (TRPMs), as serially discharged from the discharge tunnel 616, and for conveying the same in the downstream direction 624. More particularly, the conveyor mechanism 618 comprises a pair of endless loop conveyor belts 634,636 which are disposed within a vertical array such that the lower loop of the upper conveyor belt 634 operatively cooperates with the upper loop of the lower conveyor belt 636 so as to effectively define a bite therebetween within which the horizontally disposed long leg portions 638 of the individual temporary raised pavement markers (TRPMs) 640 are grippingly disposed, as best seen in FIG. 21, while the vertically disposed short leg portions 642 of the individual temporary raised pavement markers (TRPMs) 640, having adhesive patches 644 fixedly mounted upon undersurface portions thereof, have their upper surface portions disposed in contact with a fixed guide or support rail 646. In order to ensure the fact that the vertically disposed short leg portions 642 of the individual temporary raised pavement markers (TRPMs) 640 are in fact properly disposed in contact with the guide rail 646 so as to effectively be supported thereon during the downstream conveyance of the temporary raised pavement markers (TRPMs) 640 in the conveyance direction 624, it is noted, as can best be appreciated from FIG. 19, that the upstream end portions of the vertically arrayed endless loop conveyor belts 634,636 are effectively disposed within a common vertical plane, however, as can best be appreciated from FIG. 25, the downstream end portions of the vertically arrayed endless loop conveyor belts 634,636 are effectively disposed within laterally offset vertical planes. Considered from a different point of view, the vertical plane, within which the lower endless loop conveyor belt 636 is disposed, is slightly skewed in the transverse direction with respect to the vertical plane within which the upper endless loop conveyor belt 634 is disposed. Accordingly, a bias is effectively impressed upon each one of the temporary raised pavement markers (TRPMs) 640, as they are conveyed in the downstream conveyance direction 624, so as to force the vertically disposed short leg portions 642 of the temporary raised pavement markers (TRPMs) 640 into contact with, and maintain the vertically disposed short leg portions 642 of the temporary raised pavement markers (TRPMs) 640 in contact with, the guide rail 646.

Figure 20:
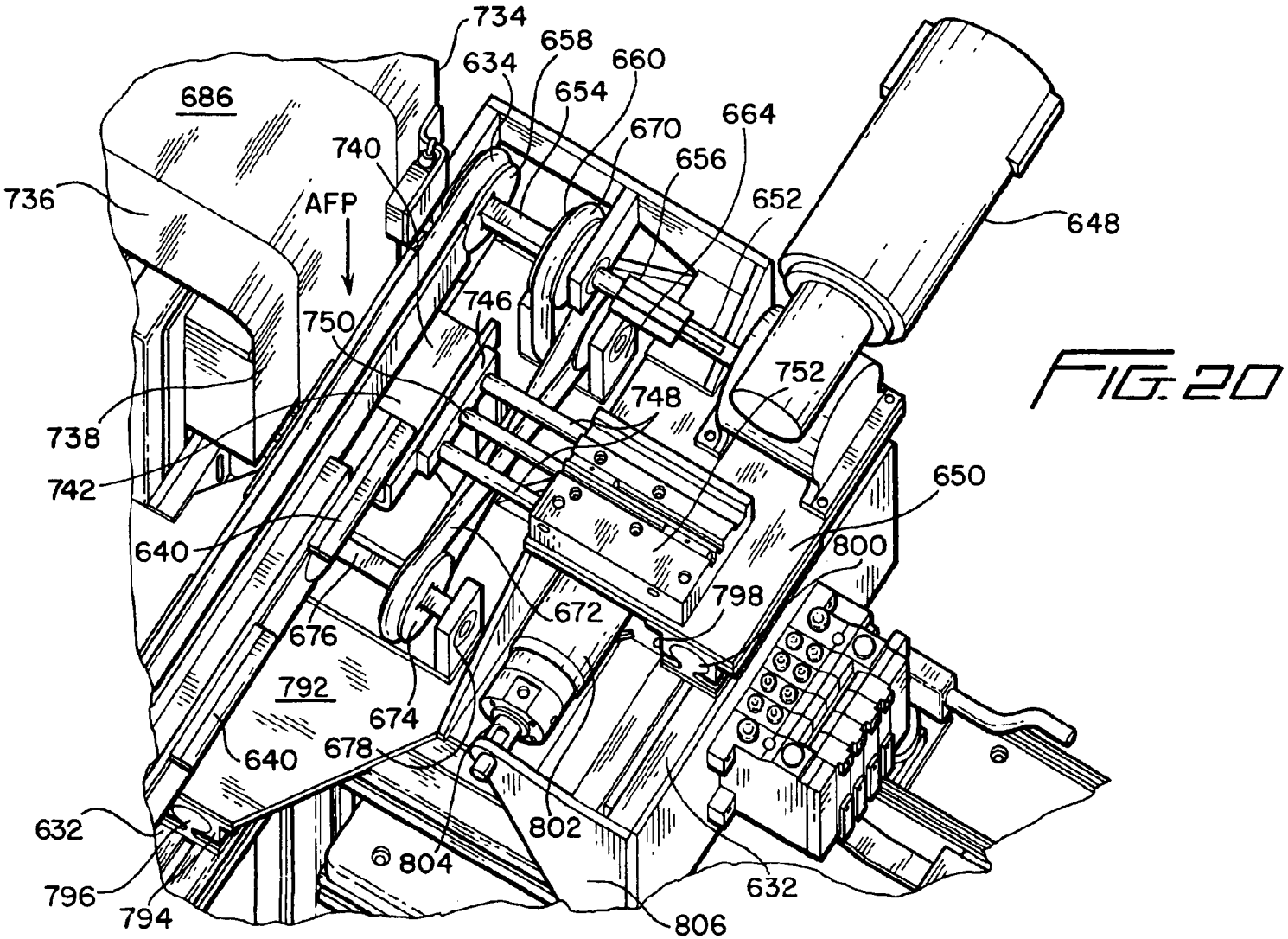
FIG. 20 is a top plan view showing the drive system for the dual-conveyor belt system, the incoming flow path of the continuous common release sheet, and the actuating mechanism for the support plate, as was disclosed within FIG. 22, wherein the actuating mechanism is disposed in its extended state such that one of temporary raised pavement markers (TRPMs) can be transferred onto the support plate.
Figure 25:
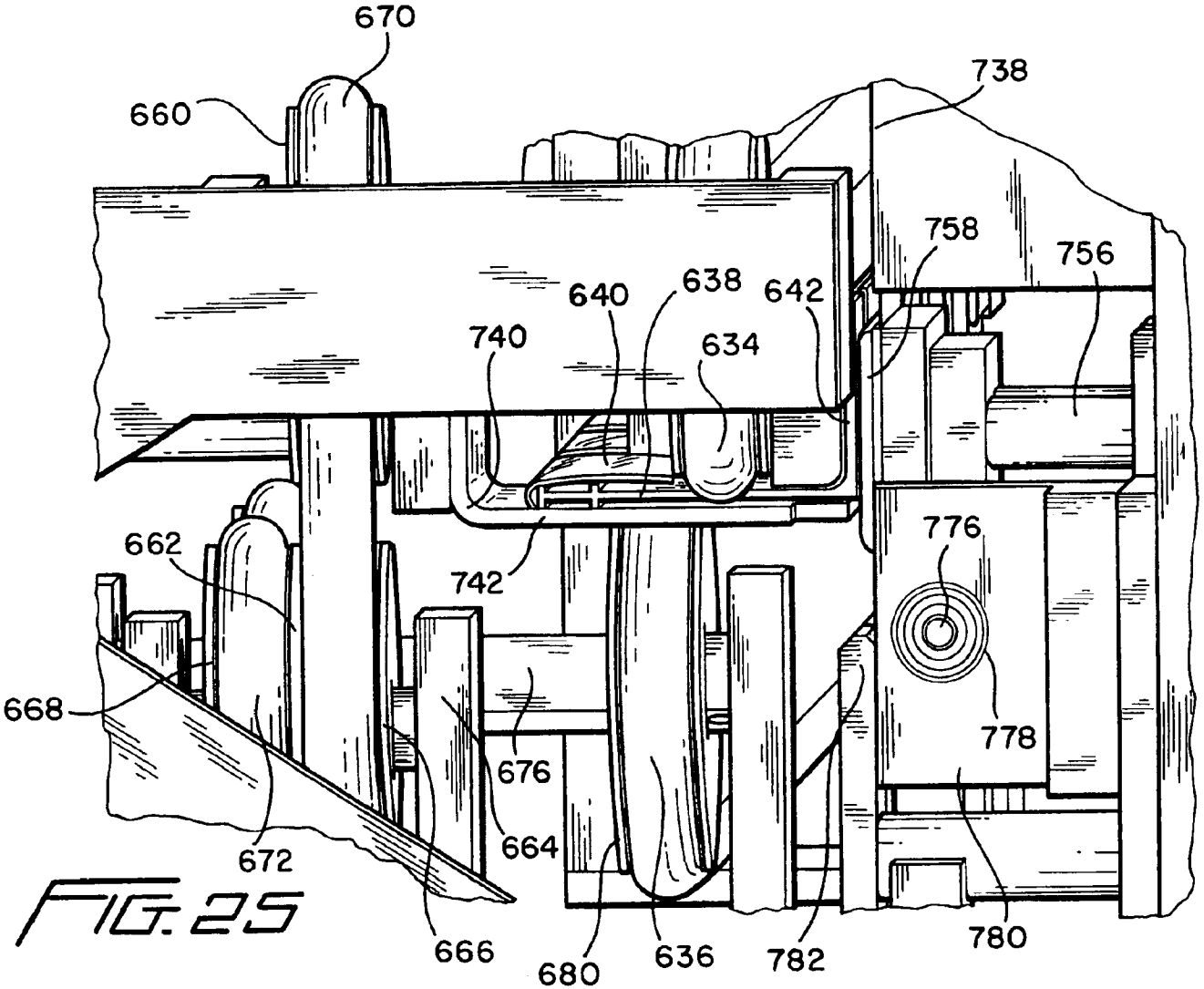
FIG. 25 is a side elevational view showing the downstream end of the conveyor mechanism for conveying the temporary raised pavement markers (TRPMs), the support plate onto which the leading temporary raised pavement marker (TRPM) is transferred, and the placement cylinder for cyclically impressing portions of the release sheet into contact with individual ones of the temporary raised pavement markers (TRPMs)

In order to provide motive drive power to both the upper and lower conveyor belts 634,636, a motor drive system, as can best be appreciated from FIGS. 20 and 21, is disclosed. More particularly, a servo drive motor 648 is fixedly mounted upon a platform 650 which comprises one component of a framework by means of which the entire conveyor mechanism or assembly 618 is movably mounted upon the fixed framework 632, as will be described more fully hereinafter, and the drive motor 648 is seen to further comprise an output drive shaft 652. The output drive shaft 652 is, in turn, drivably connected to an upper conveyor belt drive shaft 654, through means of a drive coupler 656, and the distal end of the upper conveyor belt drive shaft 654 has a first upper conveyor belt drive pulley 658 fixedly mounted thereon such that rotary drive can be transmitted directly from the drive motor 648 to the upper conveyor belt 634 which is disposed around the first upper conveyor belt drive pulley 658. In a similar manner, an upper drive pulley 660 is also fixedly mounted upon the upper conveyor belt drive shaft 654, while a lower, dual drive pulley 662, as best seen in FIG. 25, is mounted within a pulley block 664. The lower, dual drive pulley 662 is seen to comprise, in effect, first and second lower drive pulleys 666,668, and a first endless drive pulley belt 670 is disposed within a vertical plane so as to be drivingly disposed around, and extend between, the upper drive pulley 660 and the first lower drive pulley 666.

A second endless drive pulley belt 672 has a first end portion thereof drivingly disposed around the second lower drive pulley 668, while a second opposite end portion thereof is drivingly disposed around a driven pulley 674. The driven pulley 674 is mounted upon a driven shaft 676 which has one end thereof rotatably mounted within a pulley block 678 while the opposite end thereof is operatively engaged with a lower conveyor belt drive pulley 680 around which the lower conveyor belt 636 is disposed. As can be appreciated from FIGS. 20 and 21, when the second drive pulley belt 672 has its opposite end portions disposed around the lower drive pulley 668 and the driven pulley 674, the drive pulley belt 672 effectively crosses itself so as to have a substantially X-shaped configuration, and in this manner, the rotary drive direction of the upper conveyor belt drive pulley 658 is opposite that of the lower conveyor belt drive pulley 680 so as to achieve the simultaneous conveyance of the temporary raised pavement markers (TRPMs) 640 in the conveyance direction 624. More particularly, as viewed, for example, in FIG. 21, the upper conveyor belt drive pulley 658 is being rotated in the counterclockwise direction such that the lower run of the upper conveyor belt 634 is moved in the conveyance direction 624, while the lower conveyor belt drive pulley 680 is being rotated in the clockwise direction such that the upper run of the lower conveyor belt 636 is likewise moved in the conveyance direction 624.

As may best be appreciated from FIG. 17 which discloses the entire apparatus or system 610 from an overall point of view, as the plurality of individual temporary raised pavement markers (TRPMs) 640 are conveyed in the downstream conveyance direction 624, it is of course desired to effectively assemble or deposit the same upon a single or common release sheet or liner such that the assembly of individual temporary raised pavement markers (TRPMs) 640, as disposed upon the single or common release sheet or liner can subsequently be formed into the collated and nested array of temporary raised pavement markers (TRPMs) for supply to the apparatus for dispensing and applying the temporary raised pavement markers (TRPMs) onto the pavement surface as disclosed within the aforenoted U.S. patent application Ser. No. 10/302,994 which was filed on Nov. 25, 2002 and which is entitled COLLATED ROAD MARKER ASSEMBLY, AND SYSTEM AND METHOD FOR AUTOMATICALLY APPLYING COLLATED ROAD MARKERS TO ROADWAY SURFACES. Accordingly, a pair of supply rolls 682,684 of the single or common release sheet or liner are disposed at the downstream end portion of the conveyor mechanism 618, and it is appreciated that the supply rolls 682,684 are oriented in such a direction that the outfeed of the single or common release sheet or liner paper 686 is oriented in a direction which is substantially perpendicular to the infeed direction of the temporary raised pavement markers (TRPMs) 640 along the conveyance path 624. The apparatus or system 610 is provided with a pair of release paper or release liner supply rolls 682,684 so as to render the same operationally redundant and thereby more efficient from a time-wise processing viewpoint, meaning, for example, that when one of the release paper supply rolls 682,684 becomes depleted, the leading end portion of the release sheet or release liner 686 disposed upon the new or fresh one of the release paper supply rolls 682,684 may be attached, such as, for example, by manual means, to the trailing end portion of the release sheet or release liner 686 disposed upon the depleted one of the release paper supply rolls 682,684 whereby the infeeding process or supply of the release sheet or release liner 686 toward the operational station, at which the individual temporary raised pavement markers (TRPMs) 640 are to be applied onto the single or common release sheet or liner 686, may be rendered operationally continuous.

Figure 22:
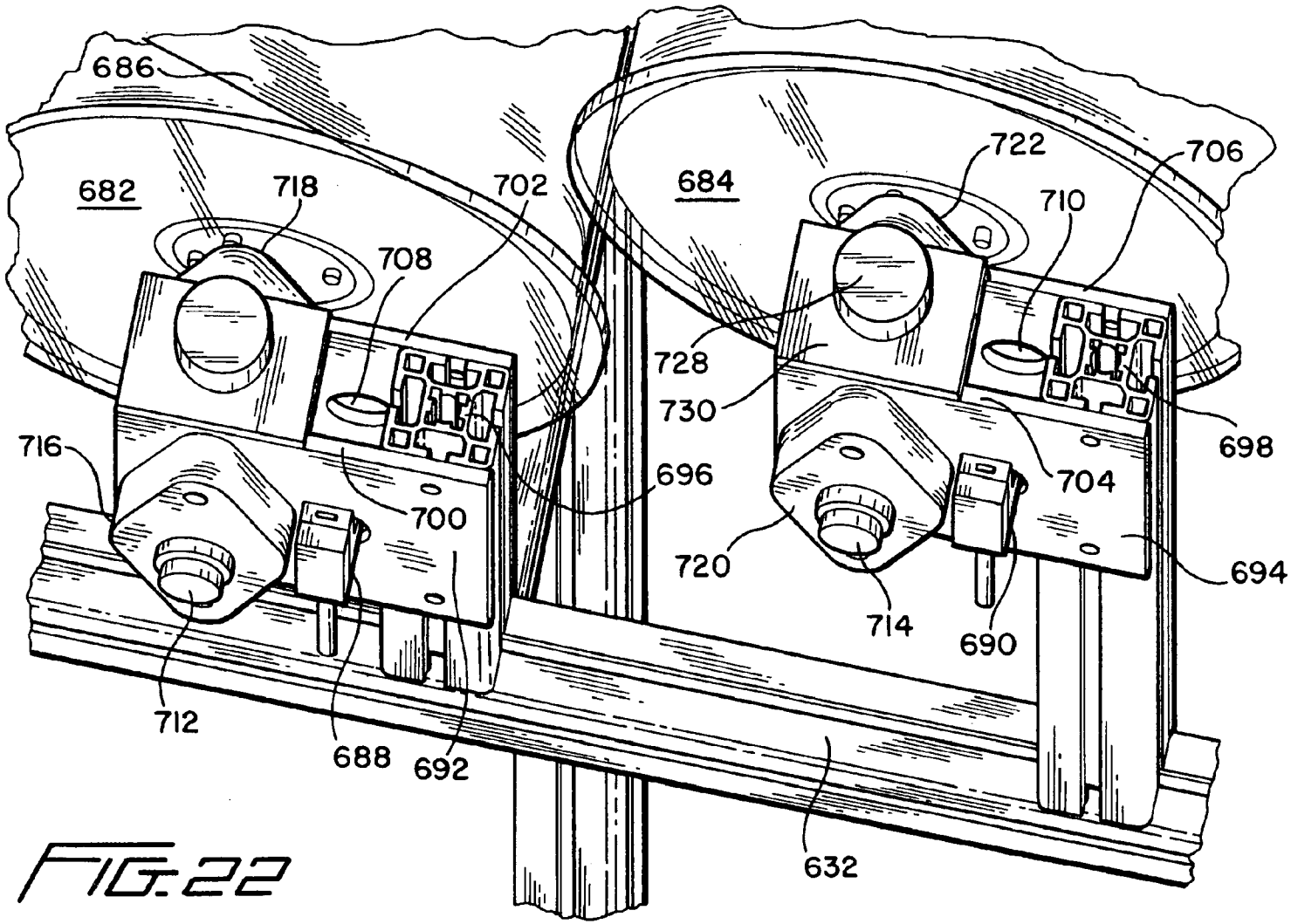
FIG. 22 is a top perspective view showing the release paper supply rolls having photodetector mechanisms operatively associated therewith for informing operator personnel when the supply of the release paper has become depleted.

As is further disclosed within FIGS. 18,22 and 23, in order to actually determine the depletion state of the supply of the release sheet or release liner 686 upon each one of the release paper supply rolls 682,684, the release paper supply rolls 682,684 respectively have operatively associated therewith an optical sensor or monitor 688,690, such as, for example, a suitable photodetector or the like. The sensors or monitors 688,690 are seen to be respectively fixedly mounted upon housings 692,694 upon which the release paper supply rolls 682,684 are rotatably mounted, and in turn, the housings 692,694 are both fixedly mounted upon upstanding columns 696,698 which are fixedly secured to the main framework 632 of the system or apparatus 610. As can best be appreciated from FIG. 22, each one of the housing 692,694 is seen to comprise a pair of oppositely disposed side walls 700, 702, and 704,706, and it is seen that the sensors or monitors 688,690 are respectively mounted upon the side walls 700,704, while side walls 702,706 are respectively provided with view ports 708,710 by means of which the optical sensors or monitors 688,690 can in fact view the diametrical extent of the amount of release paper or release liner disposed upon the release paper supply rolls 682,684 so as to effectively monitor when the supply of release paper or release liner disposed upon the release paper supply rolls 682,684 becomes depleted.

It is lastly noted, in connection with the mounting of the release paper supply rolls 682,684 upon their respective housings 692,694, that each one of the release paper supply rolls 682,684 is respectively mounted upon a shaft 712,714 which is respectively rotatably mounted within suitable bearing blocks 716,718, and 720,722 which are respectively mounted upon the side walls 700,702, and 704,706 of the housings 692,694. As can best be appreciated from FIG. 23, the rotary shafts 712,714, upon which the release paper supply rolls 682,684 are respectively mounted, are provided with a suitable braking mechanism so as to impart a predetermined resistance level with respect to the rotation of the shafts 712,714, rotatably disposed within the bearing blocks 716,718, and 720,722, whereby as the release paper or release liner 686 is unreeled from the particular one of the particular one of the release paper supply rolls 682,684 that is currently being used, the release paper or release liner 686 will be able to be supplied to the operating station, at which the individual temporary raised pavement markers (TRPMs) 640 are deposited upon the release paper or release liner 686 in a manner which will be more fully described hereinafter, will in fact be supplied in a relatively taut state without excessive slack.

It is noted that only the braking mechanism 724, operatively associated with the rotary shaft 714 of the release paper supply roll 684, is visible in FIG. 23, and therefore, while the description of the braking mechanism will accordingly be confined to the braking mechanism 724 operatively associated with the rotary shaft 714 of the release paper supply roll 684, it is to be understood that the braking mechanism, not visible, but operatively associated with the rotary shaft 712 of the release paper supply roll 682, will comprise similar structure as that of the braking mechanism 724. As seen in FIG. 23, the braking mechanism 724 is provided with an arcuately configured internal braking block member 726 which is adapted to operatively engage the outer peripheral surface of the rotary shaft 714, and a control knob 728, which is adjustably mounted within a cap member 730 of the housing 694, is operatively connected to the braking mechanism 724 through means of a shaft 732. In this manner, upon rotation of the control knob 728, respectively in the clockwise and counterclockwise directions, the braking mechanism 724, and in particular, the braking block member 726 thereof, can be positionally adjusted so as to either be closer to or further away from the outer peripheral surface of the rotary shaft 714 whereby the level of the braking force as impressed upon the rotary shaft 714 can be desirably adjusted.

Figure 24:
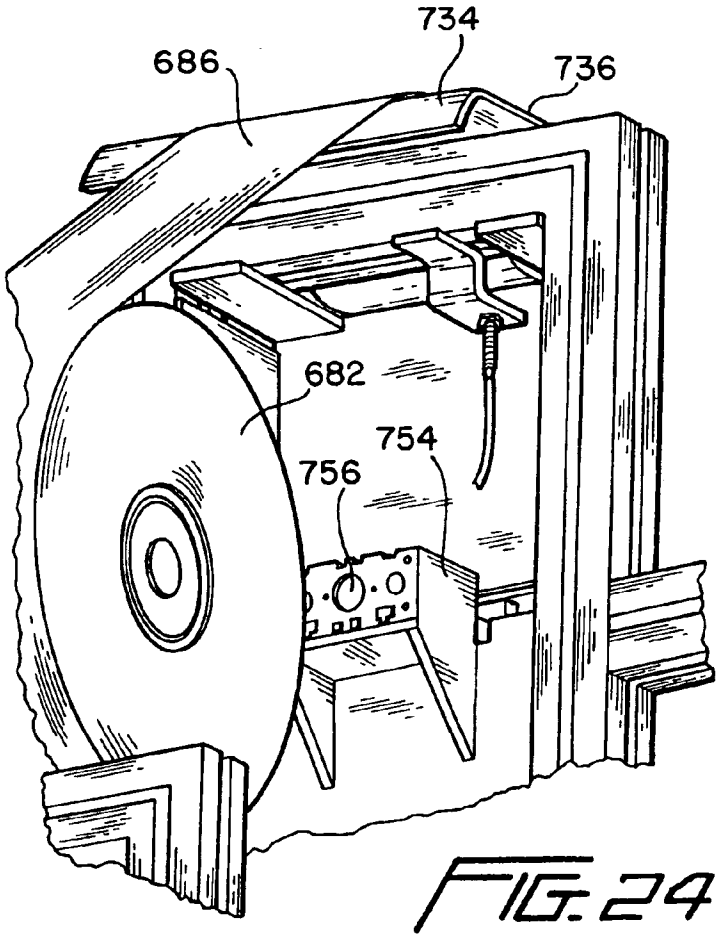
FIG. 24 is a perspective view showing one of the release sheet supply rolls, the conveyance of the release sheet, from the release sheet supply roll, over the top of a mounting plate forming a release sheet conveyance flow path, and the rear side of a placement cylinder for cyclically impressing portions of the release sheet into contact with individual ones of the temporary raised pavement markers (TRPMs)
Figure 26:
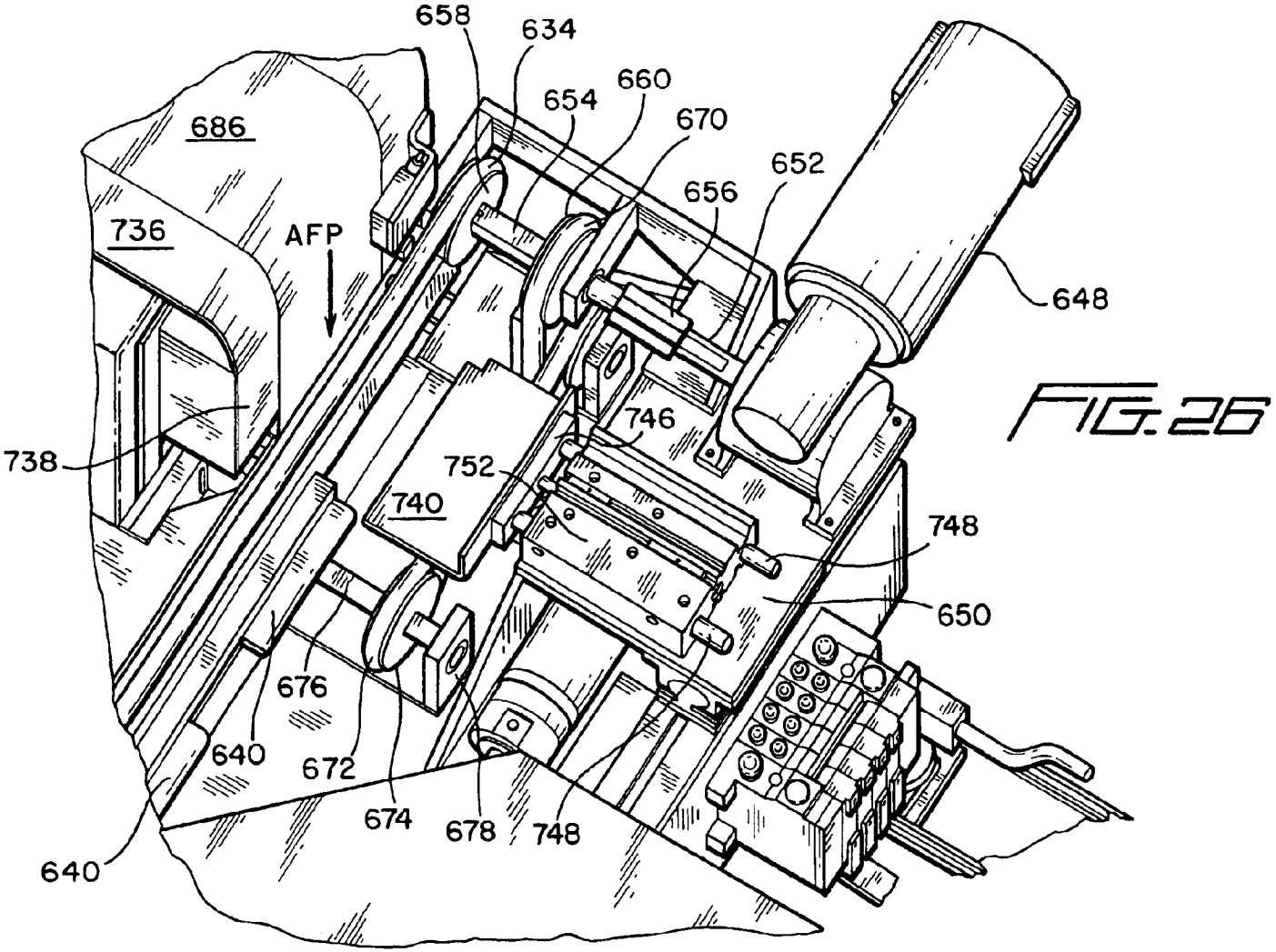
FIG. 26 is a top plan view, similar to that of FIG. 22, showing, however, the actuating mechanism for the support plate being disposed in its retracted state such that the temporary raised pavement marker (TRPM), which has just been applied onto the release sheet, can be conveyed further downstream toward the collating mechanism of the apparatus.

Having described the mechanisms and operative implements for achieving the serial downstream conveyance of the plurality of individual temporary raised pavement markers (TRPMs) 640 toward the station at which the plurality of individual temporary raised pavement markers (TRPMs) 640 will be individually deposited and adhered upon the single, common release sheet or release paper 686, the additional mechanisms and operative implements for achieving the deposition and adherence of the plurality of individual temporary raised pavement markers (TRPMs) 640 onto the single, common release sheet or release paper 686 will now be described. With reference therefore being made to FIGS. 20, 24, and 26, a release paper guide plate 734, having a substantially inverted L-shaped configuration, is fixedly mounted upon an upper part of the main apparatus or system framework 632 so as to be within the vicinity of the downstream end of the conveyor mechanism or system 618. In this manner, as can best be appreciated from FIGS. 20 and 24, the release paper or release liner 686 can be unrolled from release paper supply roll 682, conducted over the upper horizontally disposed guide surface 736 of the guide plate 734, and conducted downwardly along the vertically disposed guide surface 738 of the guide plate 734. It is to be noted that the vertically disposed guide surface 738 thus constitutes the upstream end of an assembly flow path AFP along which the assembly, comprising the serially arranged temporary raised pavement markers (TRPMs) 640, as disposed upon the common release paper or release sheet 686, will be conducted so as to ultimately achieve the collation and nested arrangement of the temporary raised pavement markers (TRPMs) 640 upon the common release sheet 686, as will be more fully disclosed hereinafter.

As can best be appreciated from FIG. 21, the longitudinal extent of the upper conveyor drive system, comprising, for example, the upper conveyor belt 634 and the upper conveyor belt drive pulley 658, is greater than the longitudinal extent of the lower conveyor drive system, comprising, for example, the lower conveyor belt 636 and the lower conveyor belt drive pulley 680. More particularly, the lower conveyor belt drive pulley 680 is located at a position which is substantially upstream from the position at which the upper conveyor belt drive pulley 658 is located, whereby the downstream end of the lower conveyor belt system terminates at a position which is upstream of the downstream end of the upper conveyor belt system, as considered along the temporary raised pavement marker (TRPM) conveyance path 624. The reason for this relative disposition of the various operative components comprising the upper and lower conveyor belt systems is to ultimately enable the temporary raised pavement markers (TRPMs) to be transferred from their entrapped positions between the upper and lower conveyor belts 634,636, onto the common release sheet or release liner 686, and to transport or convey the common release sheet or release liner 686, having the plurality of serially arranged temporary raised pavement markers (TRPMs) 640 fixedly adhered thereon, to a downstream collating mechanism by means of which the assembly, comprising the serially arranged temporary raised pavement markers (TRPMs) 640, and the common release paper or release sheet 686, will be collated and nested as has heretofore been described in connection with the first embodiment apparatus or system 210 of the present invention and as disclosed within FIG. 16.

Continuing further, then, and with reference being made to FIGS. 20,21,25, and 26, a support plate 740, having a substantially L-shaped configuration as viewed in FIG. 25 and as best seen in FIG. 21, is provided for reciprocal movement between an extended state, as disclosed within FIGS. 20,21, and 25, and a retracted state as disclosed within FIG. 26. More particularly, as can best be seen in FIG. 21, the substantially L-shaped support plate 740 comprises a horizontally disposed support leg 742, and a vertically disposed mounting leg 744. The vertically oriented mounting leg 744 is fixedly secured to a mounting plate or mounting block 746, and it is further seen that the mounting plate or mounting block 746 is fixedly secured upon the free or distal ends of a pair of laterally spaced guide rods 748 as well as upon the free or distal end of a centrally located piston rod 750. The three rods 748,750,748 are operatively associated with a cylinder mechanism 752, which may be, for example, a pneumatic cylinder, whereupon actuation of the cylinder mechanism 752 either in its extension or retraction modes, the support plate 740 will be moved between its extended position, as disclosed within FIGS. 20,21, and 25, and its retracted position as disclosed within FIG. 26. When the support plate 740 is disposed at its extended position, as may best be appreciated from FIGS. 20, 21, and 25, the horizontally disposed support leg 742 is disposed at an elevational level which substantially corresponds to the elevational level at which the upper run or loop portion of the lower conveyor belt 636 is disposed. In this manner, the upper run or loop portion of the lower conveyor belt 636 can effectively transfer each temporary raised pavement marker (TRPM) 640 onto the horizontally disposed support leg 742 of the support plate 740.

Subsequently, as can best be appreciated from FIGS. 21 and 25, in lieu of the long leg portion 638 of each temporary raised pavement marker (TRPM) 640 being entrapped between the lower run or loop portion of the upper conveyor belt 634 and the upper run or loop portion of the lower conveyor belt 636, the long leg portion 638 of each temporary raised pavement marker (TRPM) 640 is now entrapped between the lower run or loop portion of the upper conveyor belt 634 and the upper surface portion of the horizontally disposed support leg 742 of the support plate 740. Accordingly, this particular one of the temporary raised pavement markers (TRPMs) 640 is now ready to be deposited onto and adhered to the common release sheet or release liner 686. In order to therefore deposit and adhere each one of the temporary raised pavement markers (TRPMs) 640 onto the common release sheet or release liner 686, a placement or application piston-cylinder assembly, comprising a cylinder housing 754, as best seen in FIG. 24, and a piston assembly, comprising a piston rod 756 and an application plate 758, as best seen in FIGS. 25 and 27, is disposed at an elevational level which is just below that of the vertically disposed guide surface 738 of the guide plate 734 so as to be within the vicinity of the horizontally disposed support leg 742 of the support plate 740 when the support plate 740 is disposed at its extended position.

In this manner, the application plate 758 is also located at an elevational level which substantially corresponds to that of the vertically disposed short leg portion 642 of the temporary raised pavement marker (TRPM) 640 which is entrapped between the lower run or loop portion of the upper conveyor belt 634 and the upper surface portion of the horizontally disposed support leg 742 of the support plate 740. The piston assembly, comprising the piston rod 756 and the application plate 758, can of course be actuated for movement between an extended position as illustrated within FIG. 25, at which position the application plate 758 moves beyond, or to the left of, the plane within which the release sheet or release paper 686 is normally disposed as a result of being conveyed downwardly along the vertically disposed guide surface 738 of the guide plate 734, and a retracted position, not illustrated, at which position the application plate 758 will be disposed to the right of the plane within which the release sheet or release paper 686 is normally disposed as a result of being conveyed downwardly along the vertically disposed guide surface 738 of the guide plate 734.

Accordingly, it can be readily appreciated that when the piston rod 756 is moved from its retracted position to its extended position, the application plate 758 will engage the release sheet or release paper 686 and force the same into contact with the adhesive patch 644 disposed upon the vertically disposed short leg portion 642 of the temporary raised pavement marker (TRPM) 640 which is entrapped between the lower run or loop portion of the upper conveyor belt 634 and the upper surface portion of the horizontally disposed support leg 742 of the support plate 740. Consequently, that particular temporary raised pavement marker (TRPM) 640 is now deposited and adhered upon the common release sheet or release paper 686. In order to permit successive ones of the plurality of temporary raised pavement markers (TRPMs) 640 to be deposited and adhered onto the common release sheet or release paper 686, the piston rod 750 is retracted into the cylinder housing 752 so as to correspondingly move the support plate 740 to its retracted position as illustrated within FIG. 26. This operation will permit the common release sheet or release paper 686, and the temporary raised pavement marker (TRPM) 640 just deposited thereon, to be indexably moved downwardly along the vertically disposed guide surface 738 of the guide plate 734. Subsequently, the piston rod 750 is again extended with respect to the cylinder housing 752 so as to correspondingly move the support plate 740 to its extended position as illustrated within FIG. 20 in preparation for receiving a successive one of the temporary raised pavement markers (TRPMs) 640 which is now in fact conveyed onto the support plate 740 as a result of the conveyor mechanism 618 likewise being indexably moved along the conveyance direction 624.

Figure 27:
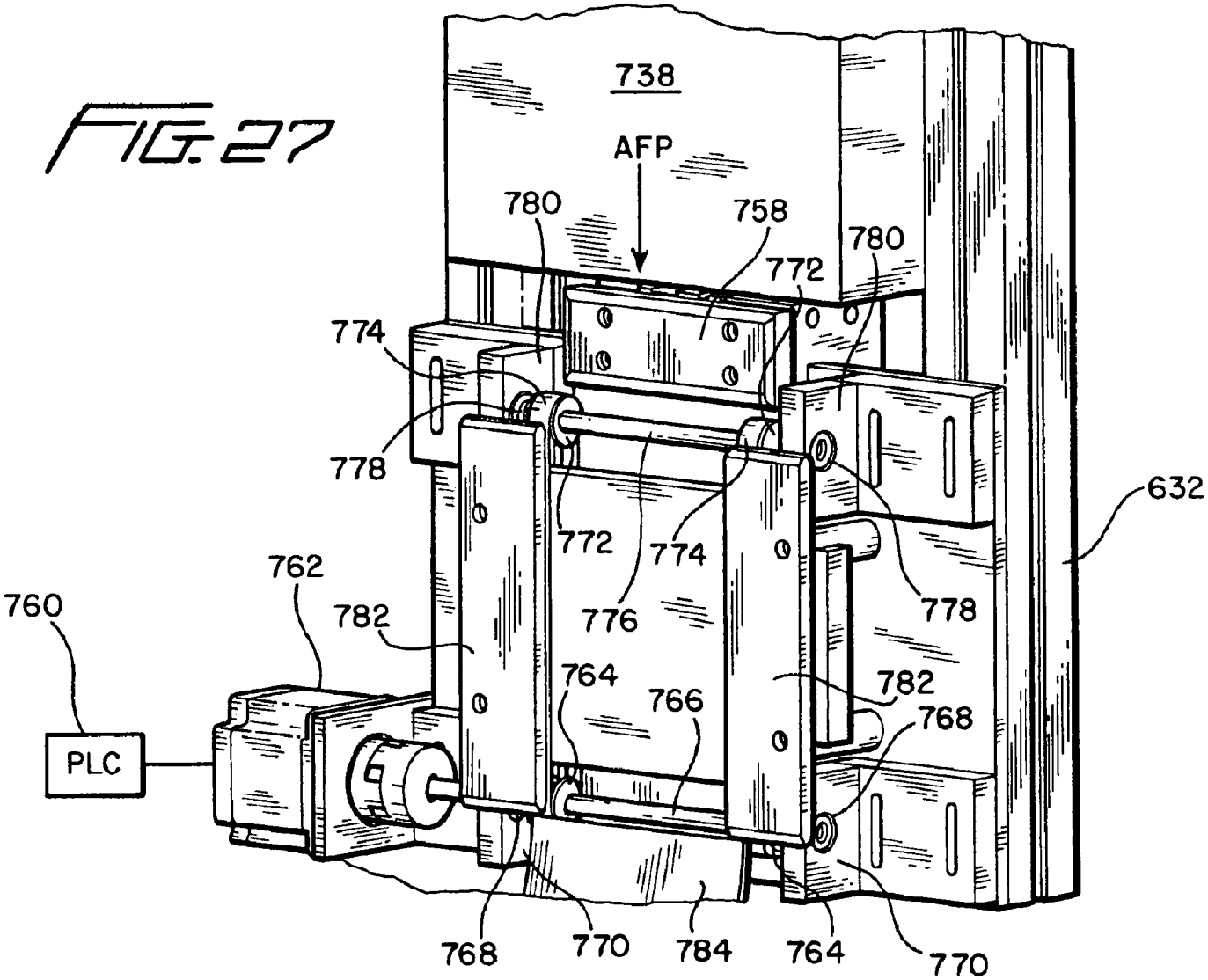
FIG. 27 is a perspective view showing the drive system for cyclically advancing the single continuous common release sheet with respect to the plurality of temporary raised pavement markers (TRPMs) to be secured thereon.

It is noted, as was the case with the first embodiment of the apparatus or system 210 of the present invention, that all of the cyclic, indexable movements of the various operative components of the second embodiment of the apparatus or system 610 of the present invention are under the control of a programmable logic controller (PLC) 760 which is schematically illustrated within FIG. 27. Accordingly, it is to be appreciated that the programmable logic controller (PLC) 760 will in fact control the indexable movement of the common release sheet or release paper 686 from the supply rolls 682,684, as well as the indexable movement of the assembly, comprising the common release liner 686 and the plurality of temporary raised pavement markers (TRPMs) 640 as deposited and adhered upon the common release sheet or release liner 686, along the assembly flow path AFP. Still further, the programmable logic controller (PLC) 760 will of course operatively coordinate such movements with the indexable conveyance or movement of the plurality of individual temporary raised pavement markers (TRPMs) 640 along the conveyance path 624 prior to the operative mating of the plurality of temporary raised pavement markers (TRPMs) 640 with the common release sheet or release liner 686 so as to in fact achieve the desired deposition and adherence of the plurality of temporary raised pavement markers (TRPMs) 640 onto the common release sheet or release liner 686. In order to therefore achieve the indexably controlled drive of the release sheet or release liner 686, both to and beyond the station or location at which the release sheet or release liner 686 is effectively mated with the plurality of individual temporary raised pavement markers (TRPMs) 640 being conveyed along the conveyance path 624, a drive system, as illustrated within FIG. 27, is provided.

More particularly, it is seen that the release sheet or release paper drive system comprises a drive motor 762 which is operatively connected to a set of laterally spaced drive pulleys 764,764 through means of an output drive shaft 766 of the drive motor 762 upon which the drive pulleys 764 are mounted. The output drive shaft 766 has its opposite ends rotatably mounted within a pair of bearing members 768,768 which are respectively mounted within a pair of bearing blocks 770,770, and the drive pulleys 764,764 are respectively operatively connected to a pair of laterally spaced driven pulleys 772,772 through means of a pair of pulley belts 774,774. The driven pulleys 772,772 are mounted upon a driven shaft 776, and the opposite ends of the driven shaft 776 are mounted within a pair of bearing members 778, 778 which are respectively mounted within a pair of bearing blocks 780,780. A pair of vertically oriented, laterally spaced guide plates 782,782 are mounted upon a portion of the main framework 632 such that the interior surface portions thereof are disposed in a substantially coplanar manner with respect to the external vertically disposed guide surface 738 of the guide plate 734 as can best be appreciated from FIG. 25. In this manner, as the release sheet or release liner 686 is conveyed along the assembly flow path AFP, as defined upon the external guide surface 738 of the guide plate 734, the release sheet or release liner 686 will also be interposed between the upper interior surface portions of the guide plates 782,782 and the external surfaces of the pulley belts 774,774 as disposed around the driven pulleys 772,772, as well as being interposed between the lower interior surface portions of the guide plates 782,782 and the external surfaces of the pulley belts 774,774 as disposed around the drive pulleys 764,764. In this manner, in accordance with the indexable drive movements imparted to the drive and driven pulleys 764,764,772,772 by means of the drive motor 762, and in accordance with suitable control signals issued by means of the programmable logic controller (PLC) 760, the release sheet or release liner 686, having the plurality of temporary raised pavement markers (TRPMs) 640 disposed thereon, is indexably advanced in the downstream direction. It is noted that the lateral width dimension of the release sheet or liner 686 is greater than that of each one of the individual temporary raised pavement markers (TRPMs) 640, and accordingly, the opposite edge regions of the release sheet or liner 686 are actually caught or entrapped within the bite regions defined between the pulley belts 774,774 and the guide plates 782,782, while the temporary raised pavement markers (TRPMs) 640 are disposed between the laterally spaced guide plates 782,782 so as to effectively pass through such region in a non-obstructing manner.

Figure 28:
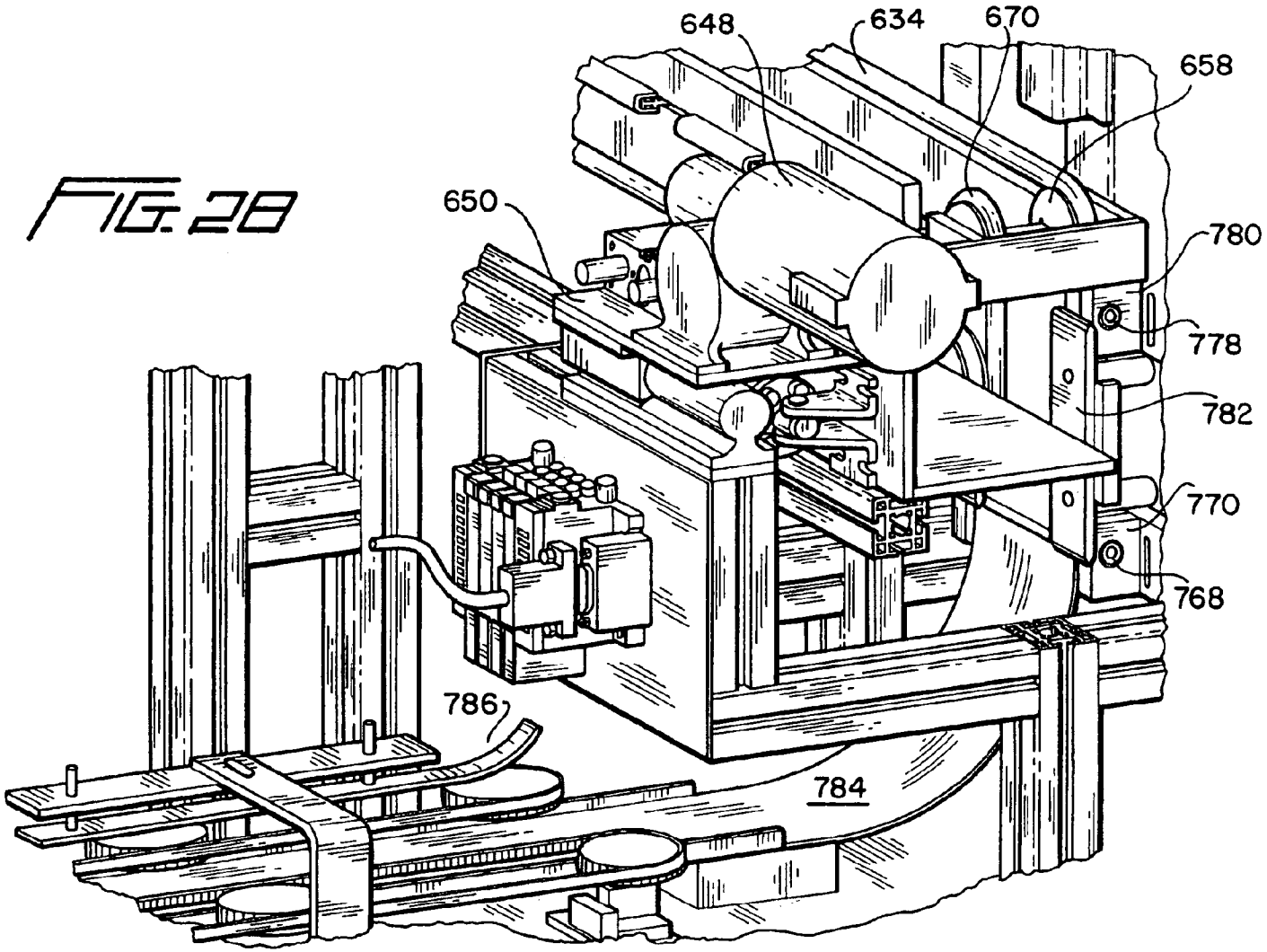
FIG. 28 is a perspective view showing an arcuate chute mechanism for conveying the single continuous common release sheet, having the plurality of temporary raised pavement markers (TRPMs) secured thereon, toward the collating mechanism of the apparatus.
Figure 29:
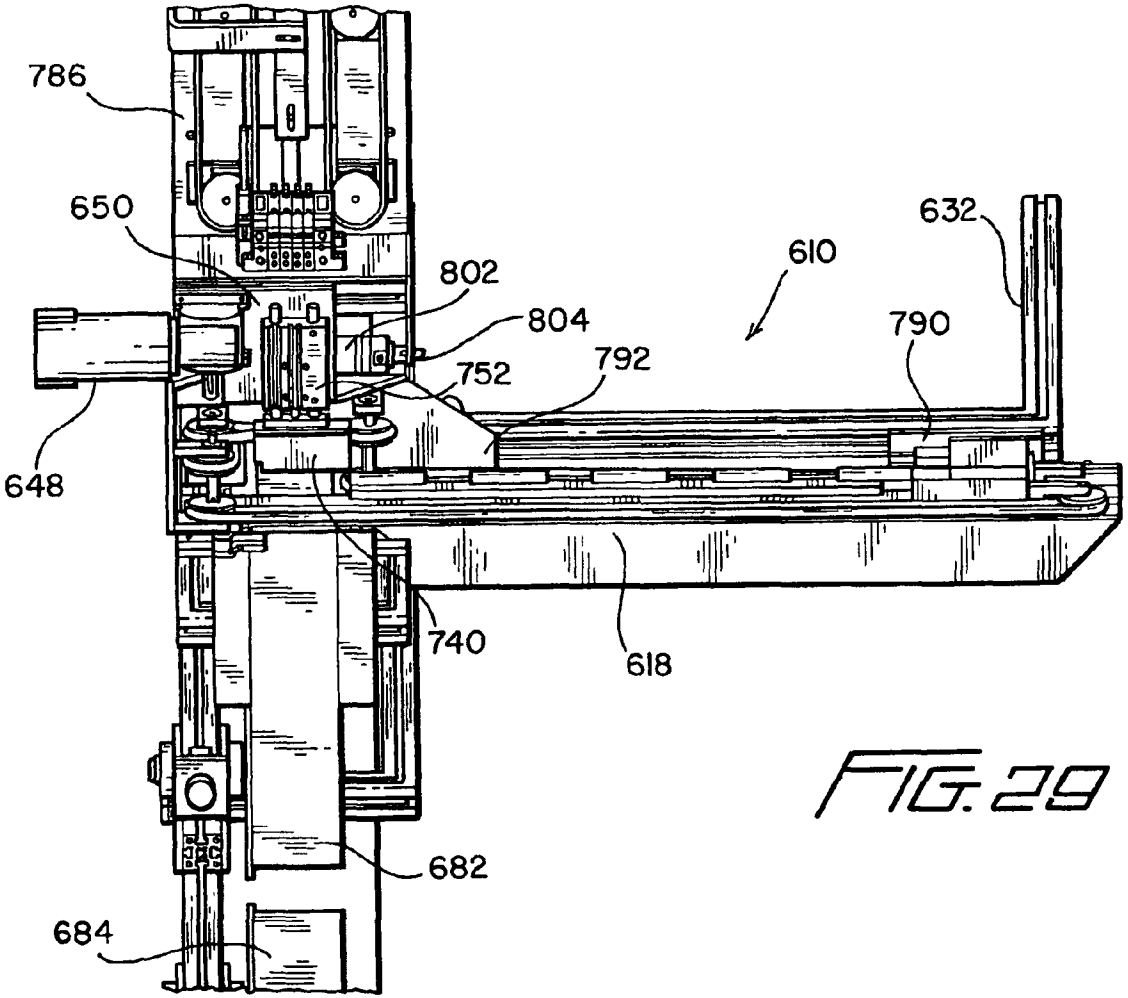

As can further be seen in FIGS. 27 and 28, as the assembly, comprising the release sheet or release liner 686 and the plurality of temporary raised pavement markers (TRPMs) 640 disposed thereon, passes beyond the lower edge portions of the guide plates 782,782, the assembly will be conveying transferred onto an upstream, arcuately configured chute member 784 which, in turn, conducts or conveys the assembly of temporary raised pavement markers (TRPMs) 640, as disposed upon the single, common release sheet or release liner 686 to a conveying mechanism 786. It will also be noted that the conveying mechanism 786 is substantially identical to the conveying mechanism as disclosed within FIGS. 13–15 in connection with the first embodiment apparatus or system 210 of the present invention, and accordingly, a detailed description of the conveying mechanism 786 will be omitted for brevity purposes. It is still further noted that in addition to the conveying mechanism 786, a collating system, similar to the collating container 498 as also utilized within the first embodiment apparatus or system 210 of the present invention, is adapted to be utilized in conjunction with the conveying mechanism 786 of the second embodiment apparatus or system 610 of the present invention whereby, again, the collated and nested array of temporary raised pavement markers (TRPMs) 640, similar to the array of temporary raised pavement markers (TRPMs) 428 as disclosed within FIG. 16, can also be achieved.

Figure 29:
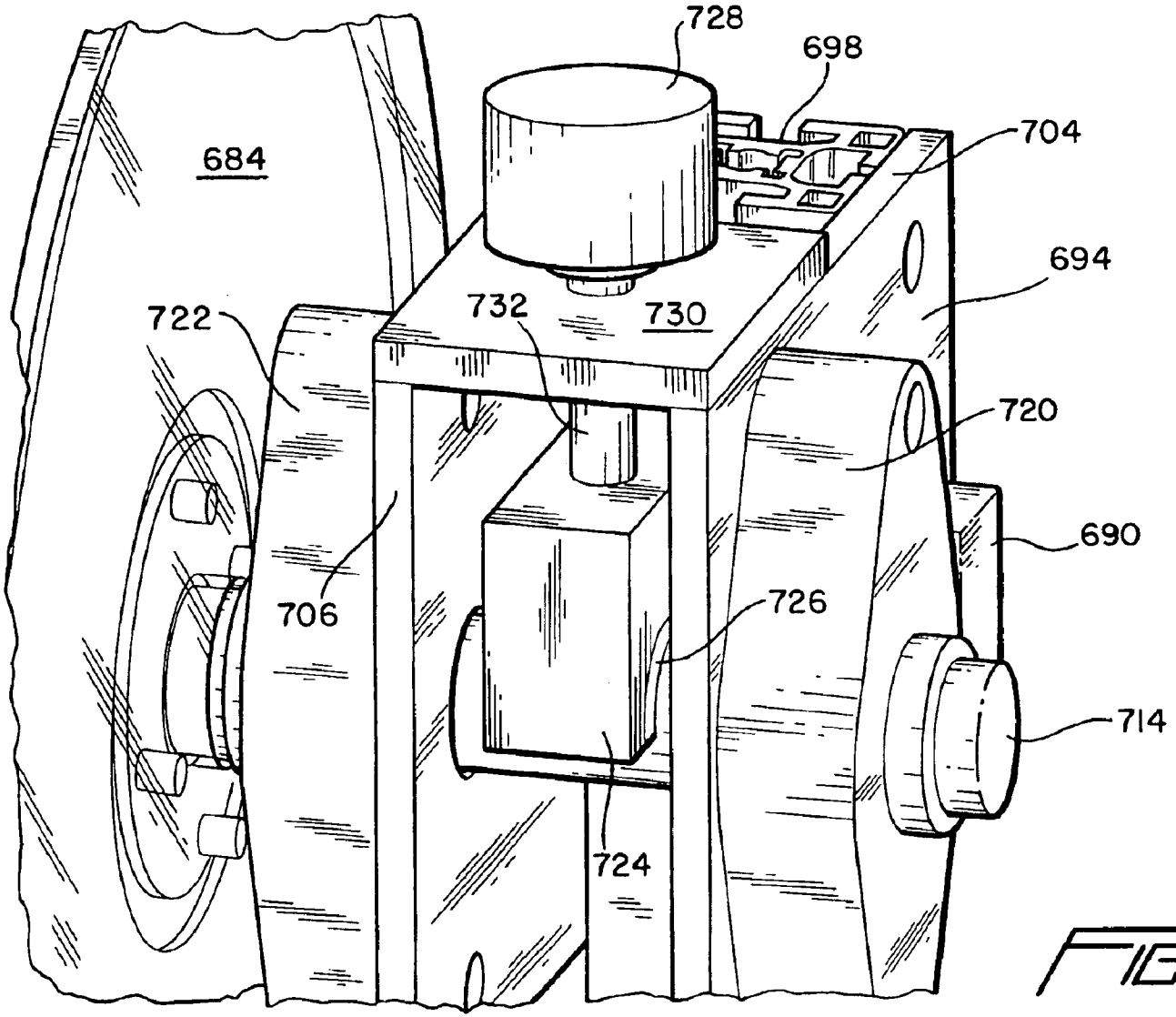
FIG. 29 is an enlarged, partial top plan view, similar to that of FIG. 17, showing the slidable mounting of the conveyor system, and its drive components, upon the main framework of the apparatus, as being disposed at its extended position with respect to the extruder discharge tunnel such that the individual temporary raised pavement markers (TRPMs) can be conveyed downstream by the conveyor system.
Figure 30:
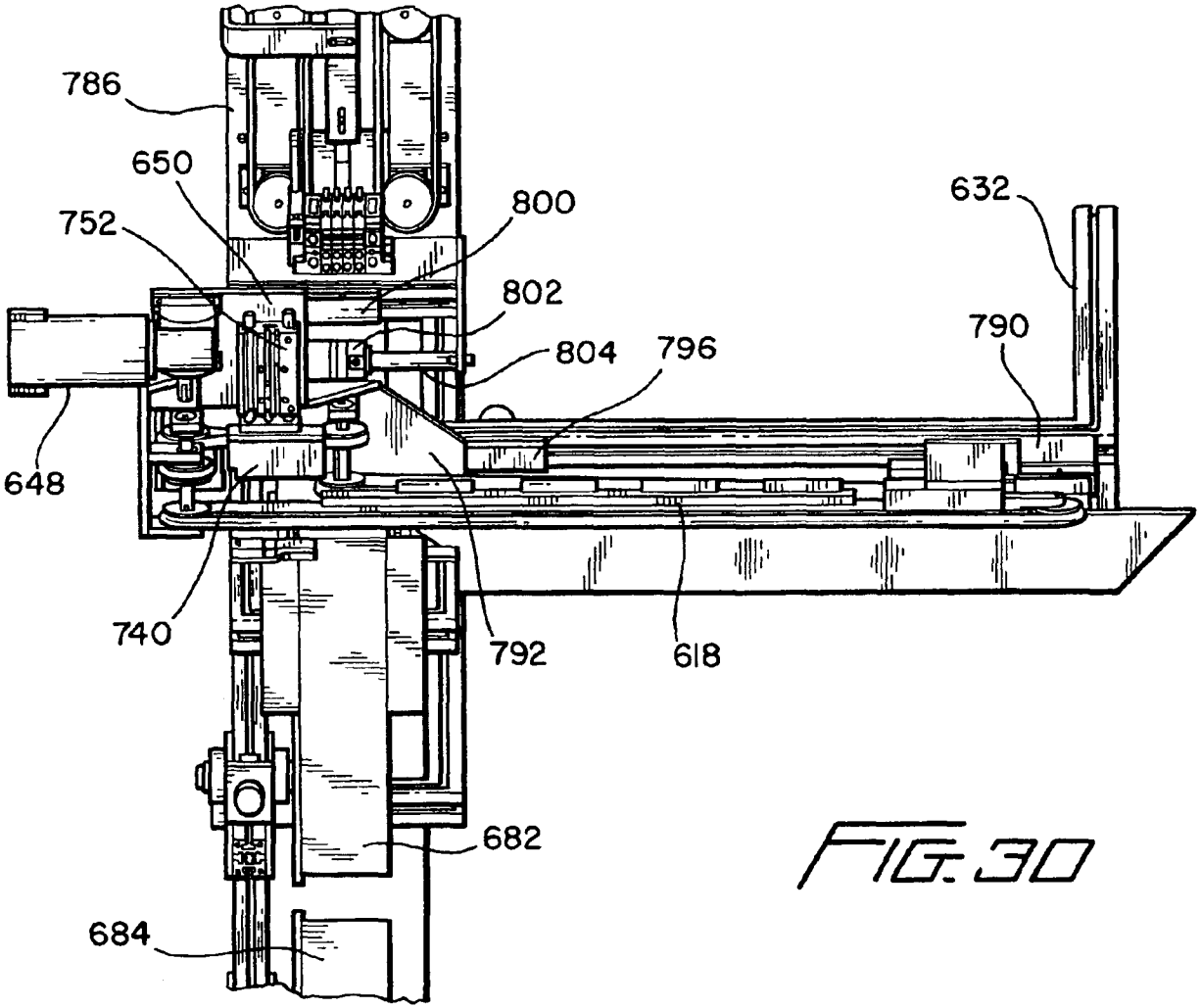

With reference lastly being made to FIGS. 29 and 30, a last feature characteristic of the second embodiment of the apparatus or system 610 of the present invention resides in the fact that the conveyor mechanism 618, the drive motor 648 therefor, the support plate assembly 740,752, and the platform 650 upon which the drive motor 648 and the cylinder housing 752 are mounted, are mounted upon a framework which is slidably mounted upon the fixed framework 632 such that the upstream end portion of the conveyor mechanism 618 can be alternatively and selectively disposed at an extended position, as illustrated within FIG. 29, at which the upstream end portion of the conveyor mechanism 618 will be disposed immediately adjacent to the output end of the extrusion discharge tunnel 616, and a retracted position as illustrated within FIG. 30, at which the upstream end portion of the conveyor mechanism 618 will be disposed at a position which is located a short distance away from the output end of the extrusion discharge tunnel 616. In this manner, when the various noted components of the system 610 are disposed at the extended position such that the upstream end portion of the conveyor mechanism 618 is disposed immediately adjacent to the output end of the extrusion discharge tunnel 616, then the plurality of individual temporary raised pavement markers (TRPMs) 640 can be processed further so as to collate and nest the same in order to achieve a collated array of temporary raised pavement markers (TRPMs) similar to that disclosed within FIG. 16, whereas when the various noted components of the system 610 are disposed at the retracted position such that the upstream end portion of the conveyor mechanism 618 is disposed at a position which is located a short distance away from the output end of the extrusion discharge tunnel 616, then the plurality of individual temporary raised pavement markers (TRPMs) 640 can simply be collected, for example, within a suitable container or the like so as to be used independently or individually, as opposed to being collated and nested.

In order to achieve such slidable mounting of the noted system components upon the fixed framework 632, it is noted, for example, as can best be appreciated from FIG. 18, that the upstream end portion of the conveyor mechanism 618 is fixedly mounted upon a first slide block 788, and that the first slide block 788 is slidably mounted upon a first slide guide 790 which is fixedly mounted upon the fixed framework 632. In addition, as may best be appreciated from FIG. 20, the support platform 792, upon which the pulley block 678 is fixedly mounted, is integrally formed atop a second slide block 794, and the second slide block 794 is slidably mounted upon a second slide guide 796 which is also fixedly mounted upon the fixed framework 632. Still yet further, and in a similar manner, the support platform 650, upon which the cylinder mechanism 752 is fixedly mounted, is integrally formed atop a third slide block 798, and the third slide block 798 is slidably mounted upon a third slide guide 800 which is also fixedly mounted upon the fixed framework 632.

Continuing further, a piston-cylinder assembly, comprising a cylinder housing 802 and a piston rod 804, is provided for moving the previously noted components with respect to the fixed framework 632. More particularly, the free or distal end of the piston rod 804 is fixedly attached to a mounting bracket 806 of the fixed framework 632, while the cylinder housing 802 is fixedly attached to the undersurface portion of the support platform 650. Accordingly, when the piston-cylinder assembly 802,804 is activated whereby the piston rod 804 is effectively extended with respect to the cylinder housing 802, since the free or distal end of the piston rod 804 is fixedly attached to the mounting bracket 806 of the fixed framework 632, the cylinder housing 802 is caused to move relative to the piston rod 804. Consequently, support platform 650, support platform 792, and the conveyor mechanism 618 are moved relative to the fixed framework 632 from the extended position, as illustrated within FIG. 29, to the retracted position as illustrated within FIG. 30.

Thus, it may be seen that in accordance with the principles and teachings of the present invention, there has been provided two embodiments of apparatus or systems for forming a serial array of temporary raised pavement markers (TRPMs), disposed upon a single, common release sheet or release liner, into a collated and nested array of the temporary raised pavement markers (TRPMs) such that the collated and nested array of temporary raised pavement markers (TRPMs) can be supplied to apparatus for dispensing and applying the temporary raised pavement markers (TRPMs) onto pavement surfaces. More particularly, in accordance with the first embodiment of the apparatus or system of the present invention, the plurality of temporary raised pavement markers (TRPMs) are formed from a single temporary raised pavement marker (TRPM) extrusion, the temporary raised pavement markers (TRPMs) are mounted upon the single, common release sheet or release liner which has a plurality of adhesive patches previously disposed thereon, and the assembly, comprising the plurality of temporary raised pavement markers (TRPMs) and the common release sheet or release liner, are formed into a collated and nested array, whereas in accordance with the second embodiment of the apparatus or system of the present invention, a plurality of pre-formed temporary raised pavement markers (TRPMs), having adhesive patches already disposed thereon, are serially deposited and adhered onto a single, common release sheet or release liner, and the assembly, comprising the plurality of temporary raised pavement markers (TRPMs) and the common release sheet or release liner, are formed into a collated and nested array.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Apparatus for automatically forming a collated and nested array of pavement markers, comprising:

means for conveying a release liner with respect to an assembly station;

means for depositing a plurality of pavement markers onto predeterminedly spaced regions of said release liner, disposed at said assembly station, so as to define an assembly comprising a serial array of said plurality of pavement markers fixedly disposed upon said release liner; and means for forming said assembly, comprising said serial array of said plurality of pavement markers fixedly disposed upon said release liner, into a collated and nested array of pavement markers.

2. Apparatus as set forth in claim 1, further comprising:

means for conveying an elongated pavement marker extrusion with respect to said assembly station; and means for cutting said elongated pavement marker extrusion into a plurality of individual pavement markers whereby said plurality of individual pavement markers define said serial array of said plurality of individual pavement markers fixedly disposed upon said release liner.

3. Apparatus as set forth in claim 2, wherein:

said means for conveying said release liner with respect to said assembly station comprises means for indexably moving said release liner with respect to said assembly station whereby said predeterminedly spaced regions of said release liner are successively disposed at said assembly station; and said means for conveying said elongated pavement marker extrusion with respect to said assembly station comprises means for indexably moving said elongated pavement marker extrusion with respect to said assembly station so as to successively present a leading end portion of said elongated pavement marker extrusion to said means for cutting said elongated pavement marker extrusion into individual pavement markers whereby said means for cutting said elongated pavement marker extrusion into said individual pavement markers successively severs said leading end portion of said elongated pavement marker extrusion from a residual portion of said elongated pavement marker extrusion so as to successively form said individual pavement markers.

4. Apparatus as set forth in claim 3, wherein:

said means for indexably moving said release liner with respect to said assembly station comprises first servo drive means; and said means for indexably moving said elongated pavement marker extrusion with respect to said assembly station comprises second servo drive means.

5. Apparatus as set forth in claim 4, further comprising:

programmable logic controller (PLC) means, operatively connected to said first and second servo drive means, for controlling said first and second servo drive means so as to achieve said indexable movements of said release liner and said elongated pavement marker extrusion with respect to said assembly station.

6. Apparatus as set forth in claim 4, wherein:

said elongated pavement marker extrusion has a substantially L-shaped cross-sectional configuration comprising a relatively large vertically oriented leg portion, and a relatively small horizontally oriented leg portion; and said second servo drive means is operatively engaged with opposite sides of said relatively large vertically oriented leg portion.

7. Apparatus as set forth in claim 1, wherein:

said release liner has a plurality of adhesive patches predisposed thereon at said predeterminedly spaced regions thereof for adhesively bonding said plurality of pavement markers onto said release liner.

8. Apparatus as set forth in claim 2, further comprising:

means for conveying reflective strips onto said elongated pavement marker extrusion; and means for conveying protective covering material onto said elongated pavement marker extrusion so as to protect said reflective strips disposed upon said elongated pavement marker extrusion.

9. Apparatus as set forth in claim 8, further comprising:

stitching means for fastening said protective covering material onto said elongated pavement marker extrusion in order to fixedly secure said protective covering material upon said elongated pavement marker extrusion and thereby ensure said protection of said reflective strips disposed upon said elongated pavement marker extrusion.

10. Apparatus as set forth in claim 5, wherein:

said elongated pavement marker extrusion has a substantially L-shaped cross-sectional configuration, comprising a relatively large vertically oriented leg portion, and a relatively small horizontally oriented leg portion, whereby when said means, for cutting said elongated pavement marker extrusion into said individual pavement markers, cuts said elongated pavement marker extrusion into said individual pavement markers, each one of said individual pavement markers will likewise have a substantially L-shaped cross-sectional configuration comprising a relatively large vertically oriented leg portion, and a relatively small horizontally oriented leg portion; and said means for conveying said release liner with respect to said assembly station is operatively connected to said first servo drive means, and comprises means for operatively engaging opposite sides of said relatively large vertically oriented leg portion of each one of said individual pavement markers, so as to achieve said indexable movement of said release liner with respect to said assembly station, and to indexably convey said assembly, comprising said serial array of said individual pavement markers fixedly disposed upon said release liner, toward said means for forming said assembly, comprising said serial array of said individual pavement markers fixedly disposed upon said release liner, into said collated and nested array of pavement markers.

11. Apparatus as set forth in claim 10, wherein said means for forming said assembly, comprising said serial array of said plurality of pavement markers fixedly disposed upon said release liner, into said collated and nested array of pavement markers comprises:

an open-ended collating container which is disposed downstream from said means for operatively engaging said opposite sides of said relatively large vertically oriented leg portion of each one of said individual pavement markers, and which is disposed at an elevational level which is beneath that of said means for operatively engaging said opposite sides of said relatively large vertically oriented leg portion of each one of said individual pavement markers, so as to form said assembly, comprising said serial array of said plurality of pavement markers fixedly disposed upon said release liner, into said collated and nested array of pavement markers.

12. Apparatus as set forth in claim 11, further comprising:

first means, operatively associated with said means for operatively engaging said opposite sides of said relatively large vertically oriented leg portion of each one of said individual pavement markers, for causing tilting of each one of said individual pavement markers, disposed upon said release liner, as said individual pavement markers are conveyed toward said open-ended container; and second means mounted upon said open-ended collating container for causing further tilting of each one of said individual pavement markers, disposed upon said release liner, as said individual pavement markers are conveyed into said open-ended container.

13. Apparatus as set forth in claim 11, further comprising:

cutting means, operatively connected to said programmable logic controller (PLC) and disposed downstream of said means for operatively engaging said opposite sides of said relatively large vertically oriented leg portion of each one of said individual pavement markers, for cutting said assembly comprising said serial array of said individual pavement markers fixedly disposed upon said release liner; and sensor means for detecting a predetermined number of said individual pavement markers, fixedly disposed upon said release liner, which corresponds to the number of individual pavement markers which can be accommodated within said open-ended collating container, and operatively connected to said programmable logic controller (PLC) for transmitting count signals to said programmable logic controller (PLC) whereby said programmable logic controller (PLC) will activate said cutting means, so as to cut said assembly, comprising said serial array of said individual pavement markers fixedly disposed upon said release liner, at a predetermined time in order to define an assembly, comprising said predetermined number of said individual pavement markers fixedly disposed upon said release liner, which can be accommodated within said open-ended container.

14. Apparatus as set forth in claim 1, further comprising:

means for conveying a plurality of individual pavement markers toward said assembly station.

15. Apparatus as set forth in claim 14, wherein said means for conveying said plurality of individual pavement markers toward said assembly station comprises:

upper and lower endless loop conveyor belts wherein said plurality of individual pavement markers are respectively entrapped between a lower run portion of said upper endless loop conveyor belt and an upper run portion of said lower endless loop conveyor belt.

16. Apparatus as set forth in claim 15, wherein:

each one of said plurality of individual pavement markers has a substantially L-shaped cross-sectional configuration comprising a relatively large, normally vertically oriented leg portion, and a relatively small, normally horizontally oriented leg portion;

each one of said relatively small, normally horizontally oriented leg portions of said plurality of individual pavement markers is disposed within a vertical plane while said plurality of individual pavement markers are being conveyed by said upper and lower endless loop conveyor belts, and has an adhesive patch disposed upon an undersurface portion thereof; and each one of said relatively large, normally vertically oriented leg portions of said plurality of individual pavement markers is disposed within a horizontal plane so as to be entrapped between said lower run portion of said upper endless loop conveyor belt and said upper run portion of said lower endless loop conveyor belt and thereby enable said upper and lower endless loop conveyor belts convey said plurality of individual pavement markers toward said assembly station.

17. Apparatus as set forth in claim 16, wherein:

said means for conveying said release liner with respect to said assembly station comprises means for indexably moving said release liner with respect to said assembly station whereby said predeterminedly spaced regions of said release liner are successively disposed at said assembly station; and said means for conveying said plurality of individual pavement markers toward said assembly station comprises means for indexably moving said plurality of individual pavement markers toward said assembly station so as to successively present said plurality of individual pavement markers to said assembly station.

18. Apparatus as set forth in claim 17, wherein:

said means for indexably moving said release liner with respect to said assembly station comprises first servo drive means; and said means for indexably moving said plurality of individual pavement markers toward said assembly station comprises second servo drive means.

19. Apparatus as set forth in claim 18, further comprising:

programmable logic controller (PLC) means, operatively connected to said first and second servo drive means, for controlling said first and second servo drive means so as to achieve said indexable movements of said release liner and said plurality of individual pavement markers with respect to said assembly station.

20. Apparatus as set forth in claim 19, wherein:

said means for conveying said release liner with respect to said assembly station is operatively connected to said first servo drive means, and comprises means for operatively engaging opposite sides of said relatively large vertically oriented leg portion of each one of said plurality of individual pavement markers, so as to achieve said index-able movement of said release liner with respect to said assembly station, and to indexably convey said assembly, comprising said serial array of said plurality of individual pavement markers fixedly disposed upon said release liner, toward said means for forming said assembly, comprising said serial array of said plurality of individual pavement markers fixedly disposed upon said release liner, into said collated and nested array of pavement markers.

21. Apparatus as set forth in claim 20, wherein said means for forming said assembly, comprising said serial array of said plurality of individual pavement markers fixedly disposed upon said release liner, into said collated and nested array of pavement markers comprises:

an open-ended collating container which is disposed downstream from said means for operatively engaging said opposite sides of said relatively large vertically oriented leg portion of each one of said plurality of individual pavement markers, and which is disposed at an elevational level which is beneath that of said means for operatively engaging said opposite sides of said relatively large vertially oriented leg portion of each one of said individual pavement markers, so as to form said assembly, comprising said serial array of said plurality of individual pavement markers fixedly disposed upon said release liner, into said collated and nested array of pavement markers.

22. Apparatus as set forth in claim 21, further comprising:

first means, operatively associated with said means for operatively engaging said opposite sides of said relatively large vertically oriented leg portion of each one of said plurality of individual pavement markers, for causing tilting of each one of said plurality of individual pavement markers, disposed upon said release liner, as said plurality of individual pavement markers are conveyed toward said open-ended container; and second means mounted upon said open-ended collating container for causing further tilting of each one of said plurality of individual pavement markers, disposed upon said release liner, as said plurality of individual pavement markers are conveyed into said open-ended container.

23. Apparatus as set forth in claim 21, further comprising:

cutting means, operatively connected to said programmable logic controller (PLC) and disposed downstream of said means for operatively engaging said opposite sides of said relatively large vertically oriented leg portion of each one of said plurality of individual pavement markers, for cutting said assembly comprising said serial array of said plurality of individual pavement markers fixedly disposed upon said release liner; and sensor means for detecting a predetermined number of said plurality of individual pavement markers, fixedly disposed upon said release liner, which corresponds to the number of said plurality of individual pavement markers which can be accommodated within said open-ended collating container, and operatively connected to said programmable logic controller (PLC) for transmitting count signals to said programmable logic controller (PLC) whereby said programmable logic controller (PLC) will activate said cutting means, so as to cut said assembly, comprising said serial array of said plurality of individual pavement markers fixedly disposed upon said release liner, at a predetermined time in order to define an assembly, comprising said predetermined number of said plurality of individual pavement markers fixedly disposed upon said release liner, which can be accommodated within said open-ended container.

24. Apparatus as set forth in claim 16, wherein:

said means for depositing said plurality of individual pavement markers onto said predeterminedly spaced regions of said release liner, disposed at said assembly station, comprises an applicator piston for respectively moving said predeterminedly spaced regions of said release liner into contact with each one of said adhesive patches disposed upon said undersurface portion of each one of said relatively small leg portions of said plurality of individual pavement markers which are disposed within said vertical plane.

25. Apparatus as set forth in claim 24, further comprising:

a support plate, movably mounted between an extended position at which said support plate respectively supports each one of said plurality of individual pavement markers while said each one of said plurality of individual pavement markers is having said predeterminedly spaced region of said release liner moved into contact with said adhesive patch disposed upon said undersurface portion of said each one of said plurality of individual pavement markers, and a retracted position for permitting said each one of said plurality of individual pavement markers, adhered upon said release liner, to be indexably moved away from said assembly station.

26. Apparatus as set forth in claim 14, further comprising:

a fixed framework; and means for slidably mounting said means for conveying said plurality of individual pavement markers, upon said fixed framework, between an extended position at which said means for conveying said plurality of individual pavement markers can serially receive said plurality of individual pavement markers from an extrusion discharge device and convey said plurality of individual pavement markers toward said assembly station, and a retracted position at which said means for conveying said plurality of individual pavement markers will be disposed away from said extrusion discharge device such that said plurality of individual pavement markers can be collected as said plurality of individual pavement markers are discharged from said extrusion discharge device.

27. A method for automatically forming a collated and nested array of pavement markers, comprising the steps of:

conveying a release liner with respect to an assembly station;

depositing a plurality of pavement markers onto predeterminedly spaced regions of said release liner, disposed at said assembly station, so as to define an assembly comprising a serial array of said plurality of pavement markers fixedly disposed upon said release liner; and forming said assembly, comprising said serial array of said plurality of pavement markers fixedly disposed upon said release liner, into a collated and nested array of pavement markers.

28. The method as set forth in claim 27, further comprising the steps of:

conveying an elongated pavement marker extrusion with respect to said assembly station; and cutting said elongated pavement marker extrusion into a plurality of individual pavement markers whereby said plurality of individual pavement markers define said serial array of said plurality of individual pavement markers fixedly disposed upon said release liner.

29. The method as set forth in claim 28, further comprising the steps of:

providing said release liner with a plurality of adhesive patches predisposed thereon in a serial array at said predeterminedly spaced regions thereof to which said plurality of individual pavement markers are to be adhesively bonded;

presenting a leading end portion of said elongated pavement marker extrusion to said assembly station;

applying said leading end portion of said elongated pavement marker extrusion to a leading one of said plurality of adhesive patches predisposed upon said release liner, and located at said assembly station, so as to adhesively bond said leading end portion of said elongated pavement marker extrusion to said release liner;

cutting said leading end portion of elongated pavement marker, adhesively bonded to said release liner, so as to sever said leading end portion of said elongated pavement marker extrusion from a residual portion of said elongated pavement marker extrusion and thereby form one of said plurality of individual pavement markers upon said release liner; and indexably moving said elongated pavement marker extrusion so as to present a new leading end portion thereof to said assembly station, and indexably moving said release liner so as to present a new leading one of said plurality of adhesive patches to said assembly station, so as to thereby successively form a serial array of said plurality of individual pavement markers upon said release liner.

30. The method as set forth in claim 27, further comprising the step of:

conveying a plurality of preformed, individual pavement markers, arranged within a serial array, toward said assembly station.

31. The method as set forth in claim 30, further comprising the steps of:

providing adhesive patches upon undersurface portions of each one of said plurality of preformed, individual pavement markers;

disposing a leading one of said plurality of preformed, individual pavement markers at said assembly station;

disposing a leading predetermined region of said release liner, upon which said leading one of said plurality of preformed, individual pavement markers is to be adhesively secured, at said assembly station;

forcing said leading predetermined region of said release liner into contact with said adhesive patch, disposed upon said undersurface portion of said leading one of said plurality of preformed, individual pavement markers, so as to adhere said leading one of said plurality of preformed, individual pavement markers onto said release liner; and indexably moving said serial array of individual pavement markers so to present a new leading one of said plurality of performed, individual pavement markers, having a new one of said plurality of adhesive patches disposed up-on said undersurface portion thereof, to said assembly station, and indexably moving said release liner so as to present a new leading one of said predetermined regions of said release liner to said assembly station, so as to thereby successively form a serial array of said plurality of individual pavement markers upon said release liner.

* * * * *